US012677963B2

(12) United States Patent
Juchniewicz

(10) Patent No.: US 12,677,963 B2
(45) Date of Patent: Jul. 14, 2026

(54) INFANT CARE APPARATUS

(71) Applicant: Monahan Products, LLC, Rockland, MA (US)

(72) Inventor: Richard Juchniewicz, Pittsburgh, PA (US)

(73) Assignee: Monahan Products, LLC, Rockland, MA (US)

( * ) Notice: Subject to any disclaimer, the term of this patent is extended or adjusted under 35 U.S.C. 154(b) by 0 days.

(21) Appl. No.: 18/624,822

(22) Filed: Apr. 2, 2024

(65) Prior Publication Data

US 2024/0245229 A1 Jul. 25, 2024

Related U.S. Application Data

(63) Continuation of application No. 17/025,674, filed on Sep. 18, 2020, now Pat. No. 11,944,212.

(60) Provisional application No. 62/902,770, filed on Sep. 19, 2019.

(51) Int. Cl.

| | |
|---|---|
| ***A47D 9/00*** | (2006.01) |
| ***A47D 9/02*** | (2006.01) |
| ***A47D 13/10*** | (2006.01) |

(52) U.S. Cl.

CPC ..... *A47D 9/016* (2022.08); *A47D 9/057* (2022.08); *A47D 13/10* (2013.01)

(58) Field of Classification Search

CPC ..... A47D 9/016; A47D 13/10; A47D 9/057; B60N 2/2821

See application file for complete search history.

(56) References Cited

U.S. PATENT DOCUMENTS

| | | | | |
|---|---|---|---|---|
| 967,609 | A | 8/1910 | Campbell | |
| 4,861,105 | A * | 8/1989 | Merten | B62B 3/1444 297/130 |
| 5,562,548 | A | 10/1996 | Pinch et al. | |
| 5,567,008 | A * | 10/1996 | Cone, II | B60N 2/2821 297/256.16 |
| 5,711,045 | A | 1/1998 | Caster et al. | |
| 6,286,844 | B1 | 9/2001 | Cone, II et al. | |
| 7,175,535 | B1 | 2/2007 | Marmentini | |

(Continued)

FOREIGN PATENT DOCUMENTS

| | | |
|---|---|---|
| CN | 106724392 | 5/2017 |
| CN | 108814138 | 11/2018 |

(Continued)

*Primary Examiner* — Milton Nelson, Jr.
(74) *Attorney, Agent, or Firm* — Perman & Green, LLP

(57) ABSTRACT

An infant care apparatus includes a base. A drive mechanism and a vibratory mechanism are coupled to the base. A movable stage is movably mounted to the base. An infant support is coupled to the movable stage. The drive mechanism imparts a first cyclic motion to the movable stage, and imparts a second cyclic motion to at least part of the movable stage independent of the first cyclic motion and to the vibratory mechanism so that the vibration motor vibrates the movable stage. The infant support is coupled to the movable stage and moves cyclically in both the first and second cyclic motions. The controller is configured to move the infant support in a selectably variable motion profile with selectable vibration modes selected from different selectably variable motion profiles and selectably different vibration modes for each of the different selectable variable motion profiles.

42 Claims, 48 Drawing Sheets

(56) References Cited

U.S. PATENT DOCUMENTS

| | | | | |
|---|---|---|---|---|
| 7,563,170 | B2 | 7/2009 | Bellows et al. | |
| 7,918,742 | B2 | 4/2011 | Clapper et al. | |
| 8,197,005 | B2 | 6/2012 | Hopke et al. | |
| 8,239,984 | B2 | 8/2012 | Hopke et al. | |
| 8,469,832 | B2 | 6/2013 | Gillett | |
| 8,777,311 | B1 * | 7/2014 | Laurel, Jr. | B62B 9/26 297/217.3 |
| 8,827,366 | B2 | 9/2014 | Hopke et al. | |
| 8,942,783 | B2 | 1/2015 | Cervantes | |
| 9,642,474 | B2 | 5/2017 | Hopke et al. | |
| 9,750,350 | B2 | 9/2017 | Armbruster et al. | |
| 9,763,524 | B2 | 9/2017 | Hopke et al. | |
| 9,968,204 | B2 | 5/2018 | Mountz et al. | |
| 10,231,555 | B2 | 3/2019 | Hopke et al. | |
| 10,357,117 | B2 | 7/2019 | Patil | |
| 10,447,972 | B2 | 10/2019 | Patil | |
| 10,539,268 | B2 | 1/2020 | Patil | |
| 2002/0082535 | A1 | 6/2002 | Eaves | |
| 2006/0025226 | A1 | 2/2006 | Nakano et al. | |
| 2009/0284050 | A1 * | 11/2009 | Myers | A47D 1/10 297/118 |
| 2011/0105237 | A1 | 5/2011 | Gillet et al. | |
| 2013/0197387 | A1 | 8/2013 | Lipoma et al. | |
| 2014/0240124 | A1 | 8/2014 | Bychkov | |
| 2014/0250592 | A1 | 9/2014 | Karp et al. | |
| 2014/0339867 | A1 | 11/2014 | Hopke et al. | |
| 2015/0289677 | A1 | 10/2015 | Huntsberger et al. | |
| 2016/0302586 | A1 | 10/2016 | Sandbothe et al. | |
| 2017/0245555 | A1 | 8/2017 | Karp | |
| 2021/0085096 | A1 | 3/2021 | Juchniewicz | |
| 2023/0256352 | A1 | 8/2023 | Hajichristou et al. | |

FOREIGN PATENT DOCUMENTS

| | | | | |
|---|---|---|---|---|
| DE | 202014101886 | U1 | 6/2014 | |
| GB | 2565384 | A * | 2/2019 | A47D 1/08 |
| NO | 301412 | B1 * | 10/1997 | B60N 2/2875 |

* cited by examiner

NO RECLINE

RECLINE

INFANT CARE APPARATUS

CROSS-REFERENCE TO RELATED APPLICATIONS

This application is continuation of U.S. Non-Provisional patent application Ser. No. 17/025,674, filed Sep. 18, 2020, (now U.S. Pat. No. 11,944,212) which claims the benefit of U.S. provisional patent application No. 62/902,770 filed on Sep. 19, 2019, the disclosures of which are incorporated herein by reference in their entireties.

BACKGROUND

1. Field

The disclosed embodiment relates generally to an infant care apparatus and, more particularly, to an infant care apparatus having an occupant area that is movable by a drive mechanism.

2. Description of Related Art

Baby swings, bouncy seats, cradles, and bassinets have been used to hold, comfort, and entertain infants and babies for many years. Prior art bouncy seats are normally constructed with a wire frame that contains some resistance to deformation that is less than or equal to the weight of the child in the seat. Thus, when the child is placed in the seat, his or her weight causes a slight and temporary deformation in the wire structure that is then counteracted by the wire frame's resistance to deformation. The end result is that the child moves up and down slightly relative to the floor. This motion can be imparted to the seat by a caregiver for the purpose of entertaining or soothing the child.

Baby swings normally function in much the same way as swing sets for older children; however, the baby swing usually has an automated power-assist mechanism that gives the swing a "push" to continue the swinging motion in much the same way a parent will push an older child on a swing set to keep them swinging at a certain height from the ground.

There are some products that have recently entered the market that defy easy inclusion into either the bouncy or swing category. One such product includes a motorized motion that can move the infant laterally, but only has a single degree of motorized freedom and is thus limited in the motion profiles that can be generated. While the seat can be rotated so that the baby is moved back and forth in a different orientation, there remains only one possible motion profile.

A need exists for a motorized infant support that is capable of simultaneous or independent movement in at least two directions, and can reproduce a large number of motion profiles with those two directions.

DETAILED DESCRIPTION

Figure 1:
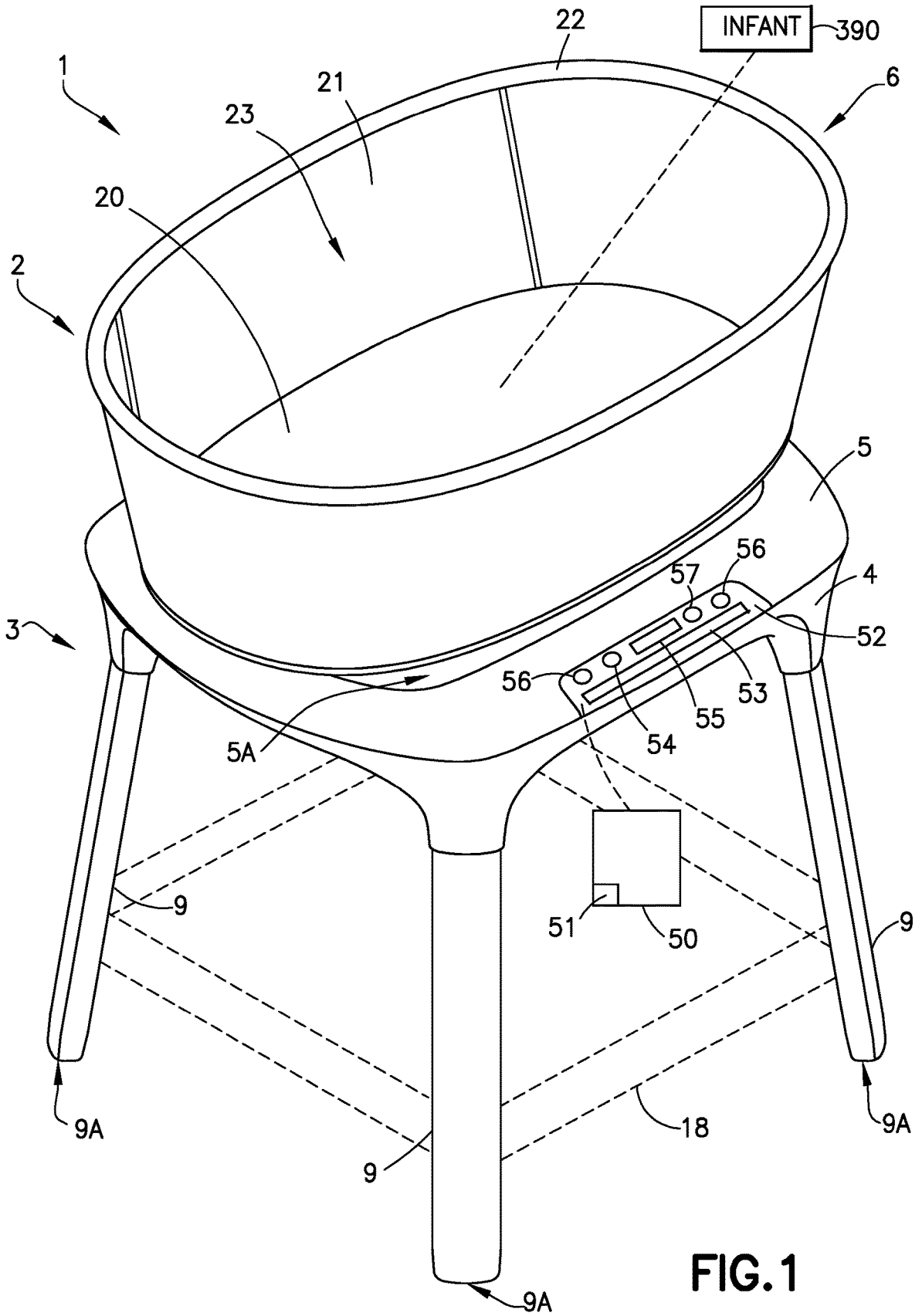
FIG. 1 is a perspective view of an infant care apparatus in accordance with aspects of the disclosed embodiment.
Figure 1A:
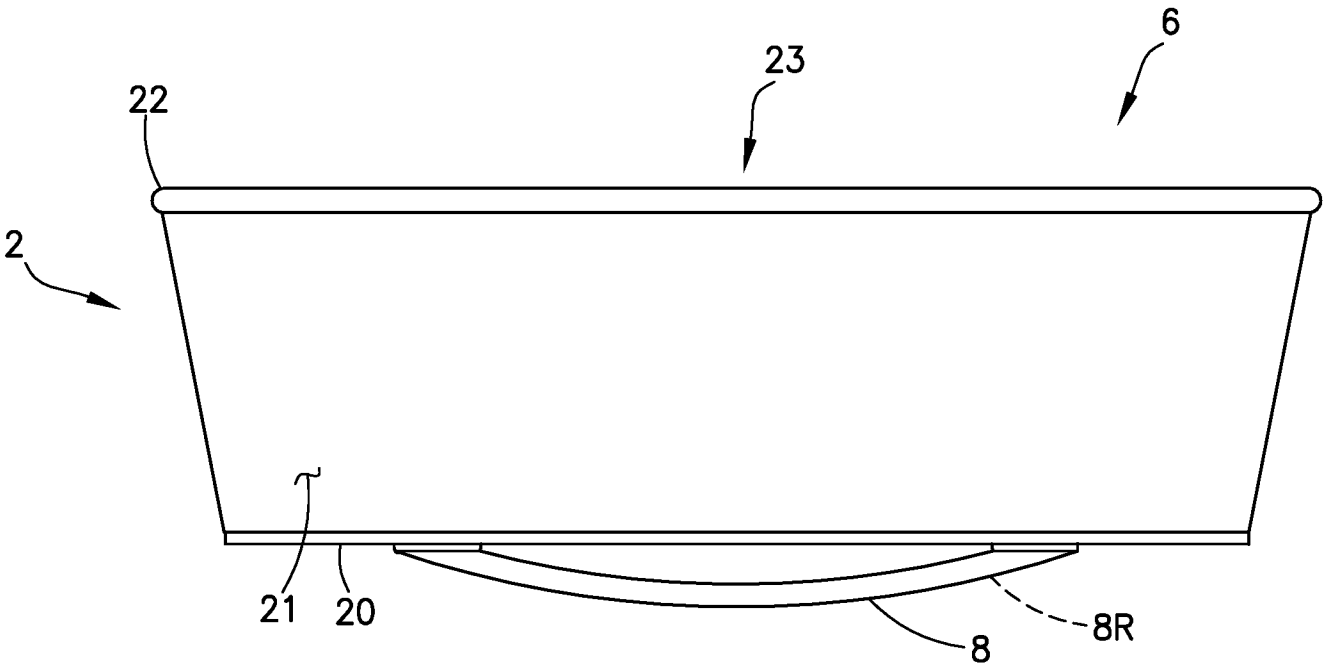
FIG. 1A is a side view of a portion of the infant care apparatus of FIG. 1 in accordance with aspects of the disclosed embodiment.

For purposes of the description hereinafter, the terms "upper", "lower", "right", "left", "vertical", "horizontal", "top", "bottom", "lateral", "longitudinal", and derivatives thereof shall relate to the aspects of the disclosed embodiment as it is oriented in the drawing figures. However, it is to be understood that the aspects of the disclosed embodiment may assume alternative variations and step sequences, except where expressly specified to the contrary. It is also to be understood that the specific devices and processes illustrated in the attached drawings, and described in the following specification, are simply exemplary of the aspects of the disclosed embodiment. Hence, specific dimensions and other physical characteristics related to the aspects of the disclosed embodiment disclosed herein are not to be considered as limiting.

Referring to FIGS. 1, 1A, 2, 2A and 2C an infant care apparatus 1 in accordance with aspects of the disclosed embodiment is illustrated. Although the aspects of the disclosed embodiment will be described with reference to the drawings, it should be understood that the aspects of the disclosed embodiment can be embodied in many forms. In addition, any suitable size, shape, or type of element or material could be used.

In accordance with aspects the of disclosed embodiment, the infant care apparatus 1 generally includes a base 3, an infant support 2, and an infant support coupling 200 (or infant support receiver coupling 200C) arranged so as to releasably couple the infant support 2 to the base 3. The infant support 2 includes a mating support member 8, 8R which is configured to be engaged with the infant support coupling 200 (or infant support receiver coupling 200C) as will be described in greater detail below.

In one aspect, the infant support 2 may be an infant bed 6, such as a bassinet or cradle (as illustrated in FIG. 1). In other aspects, the infant support 2 may be any suitable support such as a seat (see FIG. 2). The infant bed 6 includes a bottom panel 20 and a continuous side wall 21 having a top edge 22. In one aspect, the infant bed 6 may include the mating support member 8, 8R coupled to a bottom surface of the bottom panel 20; while in other aspects, the bottom panel may be coupled to the base substantially directly (as described herein) or in any other suitable manner. The continuous side wall 21 extends about a periphery of bottom panel 20 and is joined to the bottom panel 20 so as to define an enclosed space 23 for an infant or baby to occupy. The side wall 21 may be constructed of any suitable material such as solid fabrics/cloths, mesh fabrics, etc. While the infant bed 6 is illustrated as being elliptical in shape, the infant bed 6 may be any other suitable shape, such as, square, rectangular, circular, etc.

Figure 2:
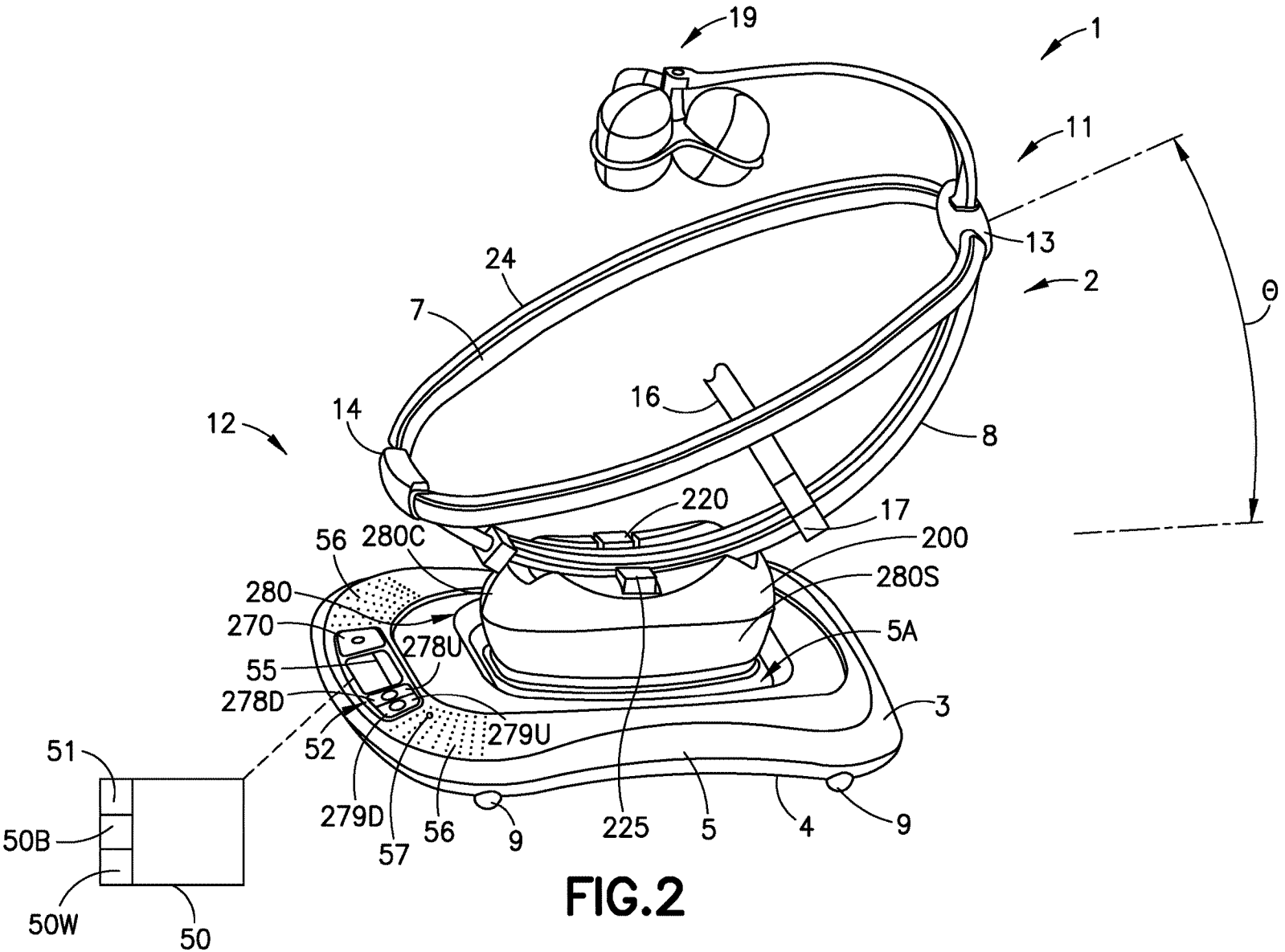
FIG. 2 is a perspective view of an infant care apparatus in accordance with aspects of the disclosed embodiment.
Figure 2A:
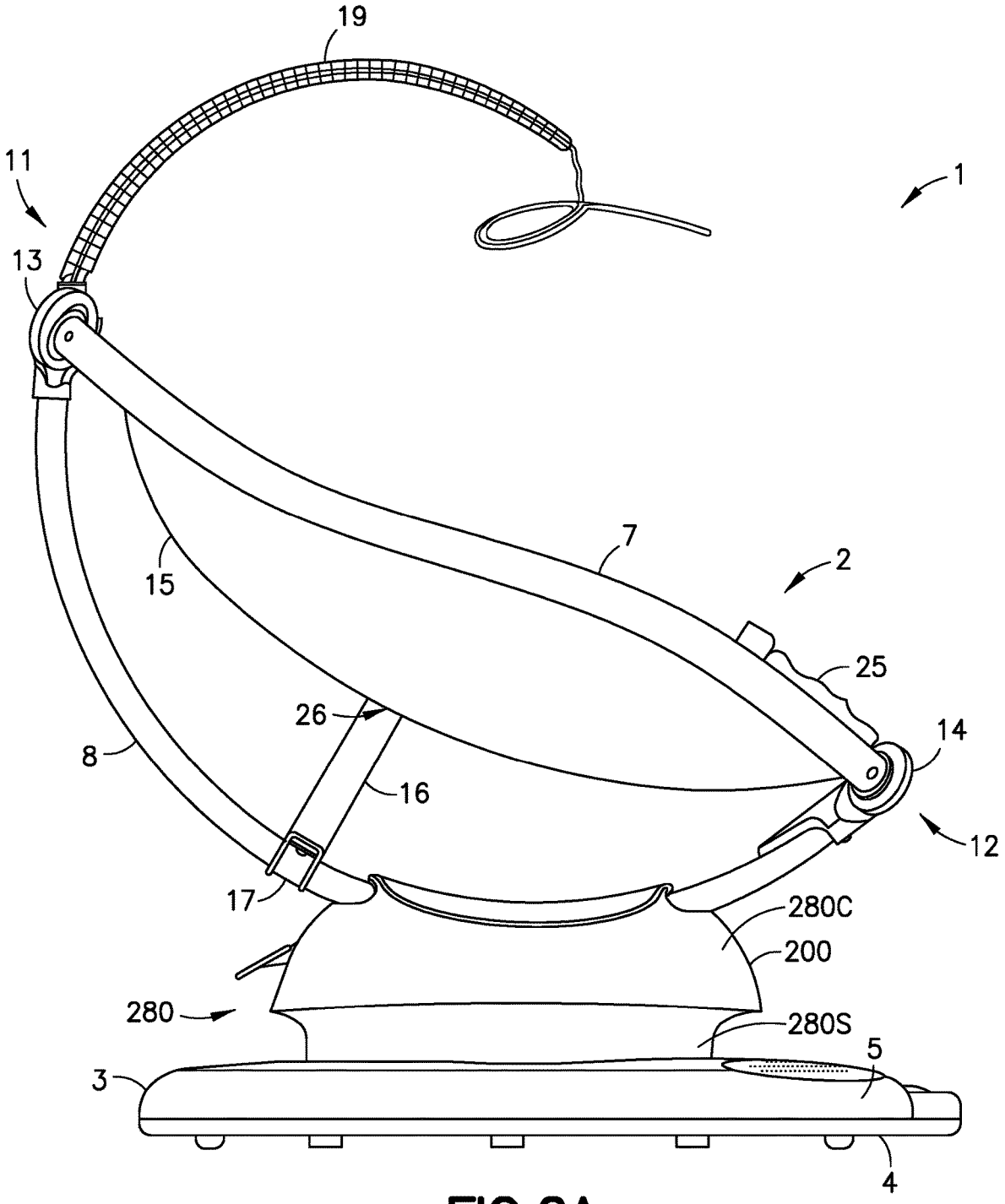
FIG. 2A is a side view of the infant care apparatus of FIG. 2 in accordance with aspects of the disclosed embodiment.

In another aspect, as illustrated in FIGS. 2 and 2A, the infant support 2 may be an infant seat 7 as noted above. A suitable example of the infant seat can be found in U.S. Pat. No. 10,231,555 issued on Mar. 19, 2019, the disclosure of which is incorporated herein by reference in its entirety. Although the infant seat 7 is illustrated as being elliptical in shape, the infant seat 7 may be any other suitable shape, such as, square, rectangular, circular, etc. The infant seat 7 includes the mating support member or frame 8, 8R which is configured to support at least the weight of an infant or baby. In some aspects, as will be described herein, the mating support member or frame 8 forms a rocker 2R with rocker rails 2610R, 2611R, which in one or more aspects fixed relative to the seat 7. In some aspects, the infant seat 7 includes any suitable mobile 19 that may be fixed or releasably coupled to the infant seat 7 in any suitable manner. In one aspect, the infant seat 7 has an upper end 11 and a lower end 12. The infant seat 7 is configured to receive a fabric or other type of material so as to form a seating portion 15 for an infant or baby. The seating portion 15 may be coupled to the infant seat 7 using any suitable fastening mechanism, such as zippers 24. Here, zippers 24 are shown for exemplary purposes but in other aspects, the fastening mechanism can be hook and loop fabric, buttons, or any other suitable fastening mechanism. In one aspect, the seating portion 15 may further include straps 16 to secure the infant or baby to the seating portion 15. The straps 16 are coupled to the mating support member 8, 8R in any suitable manner, such as, with, e.g., clips, rivets, buttons, etc. provided on strap securing members 17. The straps 16 are fed through slots 26 provided in the seating portion 15 to connect into a crotch support 25 of the seating portion 15 to secure the infant or baby. In one aspect, the seating portion 15 and the straps 16 may be easily removed by a user for, e.g., cleaning or replacement. The straps 16, in one or more aspects, form a five-point harness (e.g., with two shoulder straps, two waist straps, and a submarine strap—see FIGS. 2B and 2C) for securing the infant within the infant seat 7; while in other aspects, the straps 16 may form a harness with any suitable number of anchor points/straps, such as a three point harness (e.g., with two waist straps and a submarine strap), for securing the infant within the infant seat 7.

Figure 26A:
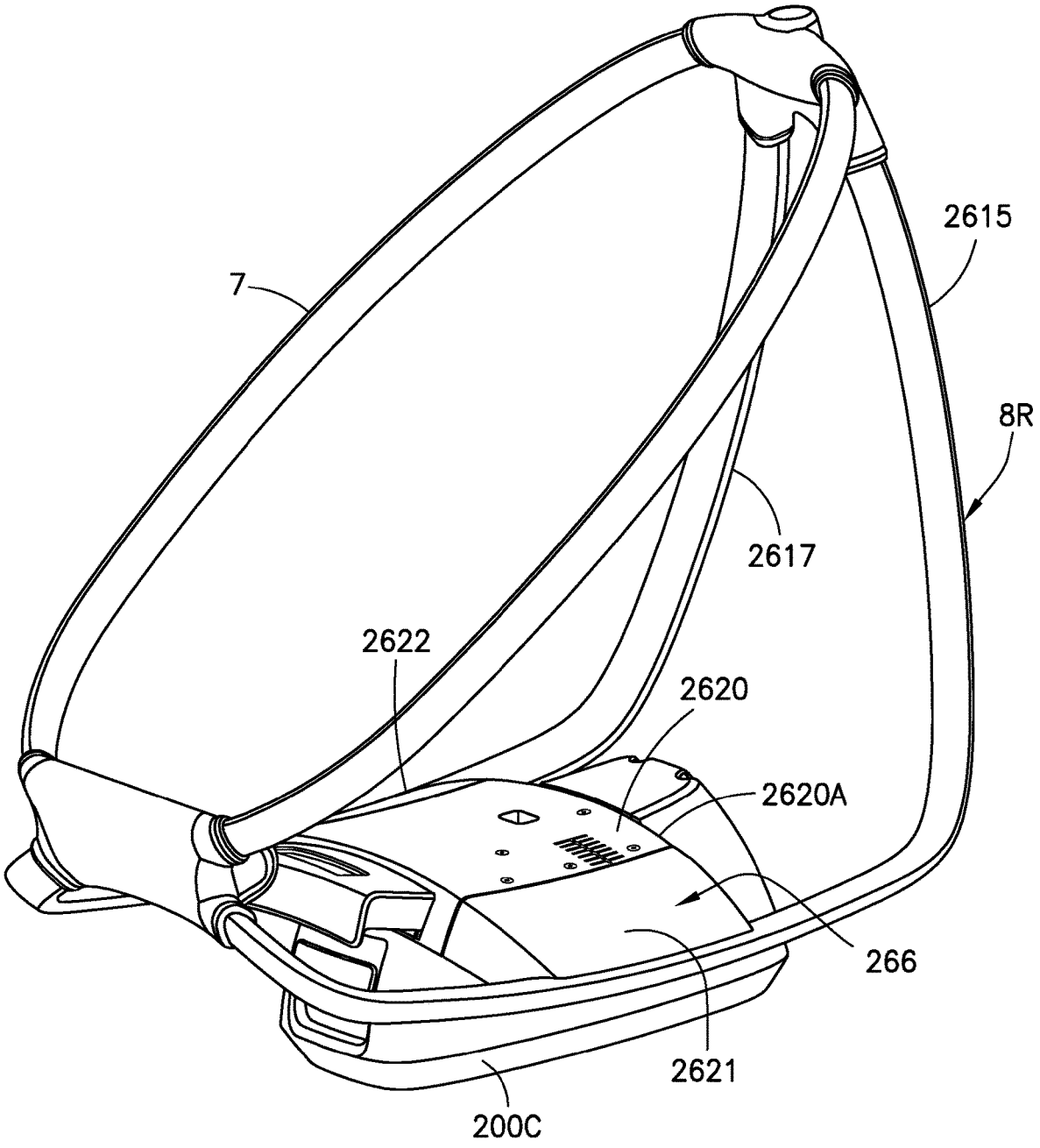
FIG. 26A is a perspective view of a portion of the infant care apparatus of FIG. 2C in a first orientation in accordance with aspects of the disclosed embodiment.
Figure 26B:
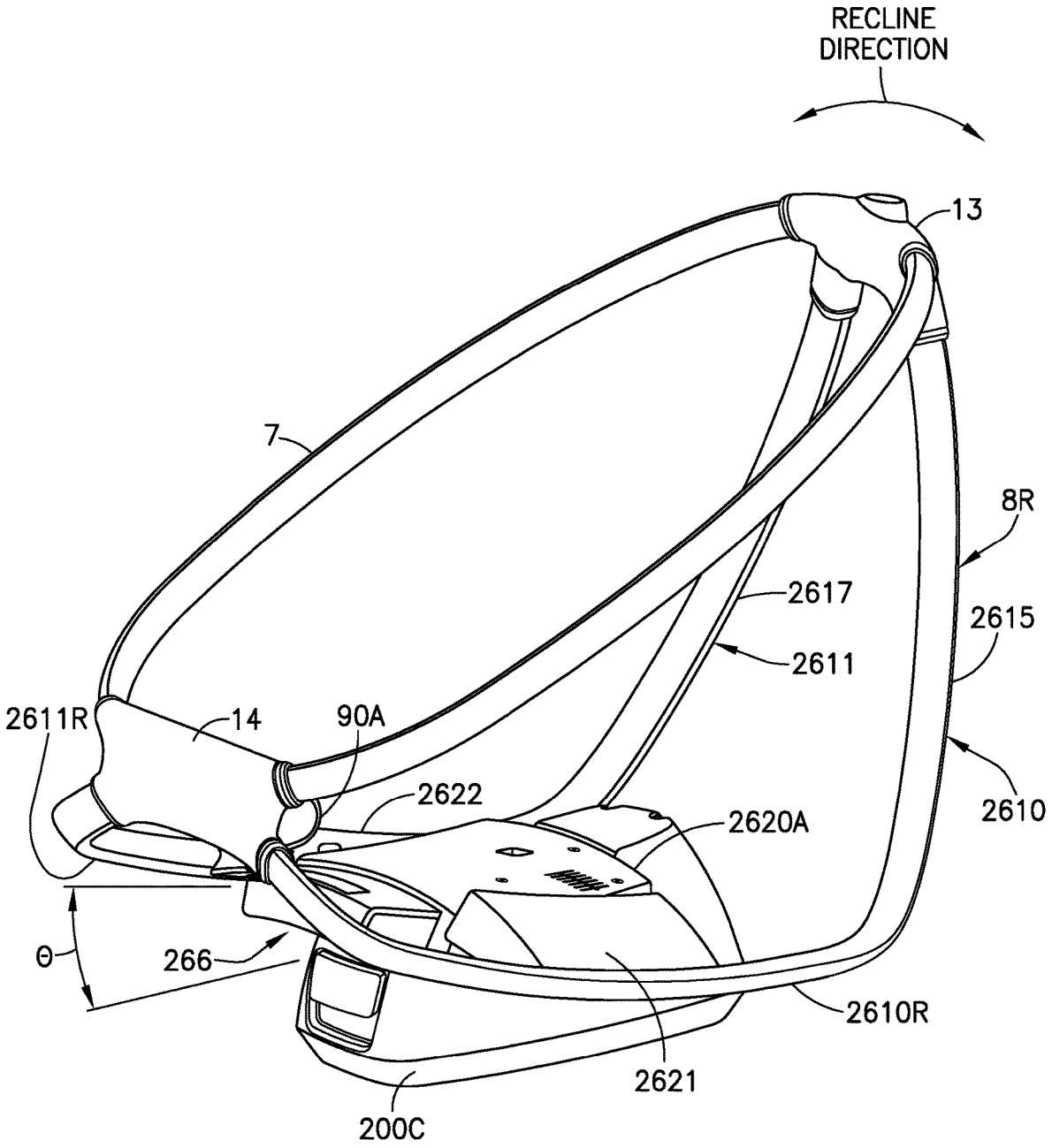
FIG. 26B is a perspective view of a portion of the infant care apparatus of FIG. 2C in a second orientation in accordance with aspects of the disclosed embodiment.

Referring also to FIGS. 2C, 2D and 3A-3D, the mating support member 8, 8R is connected to an upper end 11 of the infant seat 7 by an upper connector 13 and to a lower end 12 of the infant seat 7 by a lower connector 14. The mating support member 8, 8R has any suitable shape so that when coupled to the infant support coupling 200 (or infant support receiver coupling 200C), the mating support member 8, 8R orients the infant seat 7 in a predetermined position. For example, in one or more aspects, the mating support member 8, 8R may have a longitudinal axis extending between the upper end 11 and the lower end 12 of the infant seat 7, where the mating support member 8 forms an arc between the upper end 11 and the lower end 12 of the infant seat 7. Accordingly, the infant seat 7, with the mating support member 8, forms a cradle. The arc may allow for adjusting an angle θ (see FIG. 2) of the infant seat 7 or cradle relative to the base 3. In other aspects, the mating support member 8 may have arcuate portions (see FIG. 3A) coupled to each other so that the arcuate portions set the angle θ. In still other aspects, the mating support member 8R includes an articulated span member 266 (that will be further described herein) so that the articulated span member 266 sets the angle θ (see FIGS. 2C, 26A, and 26B).

Figure 3A:
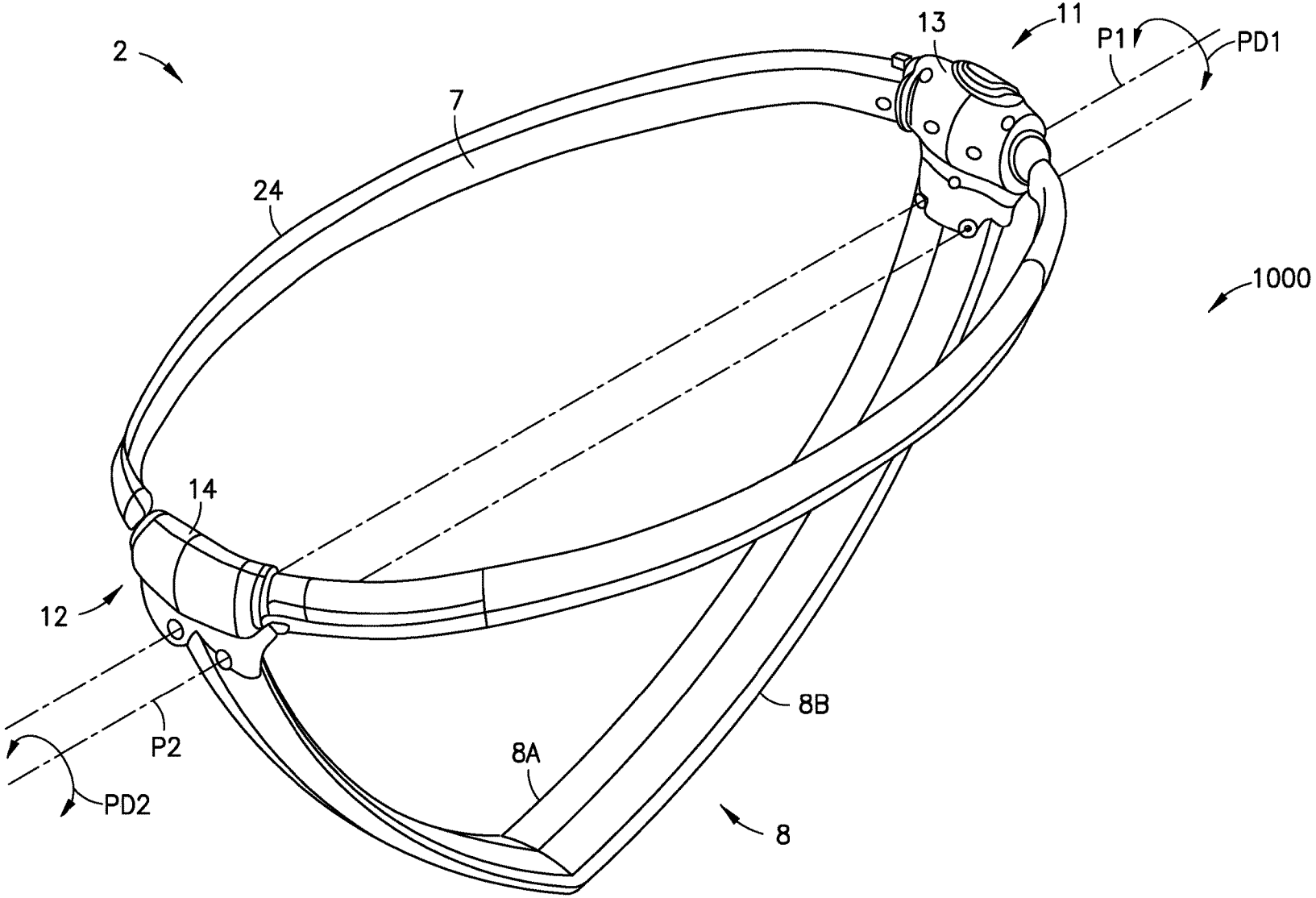
FIG. 3A is a perspective view of a portion of the infant care apparatus of FIG. 2 in accordance with aspects of the disclosed embodiment.
Figure 3B:
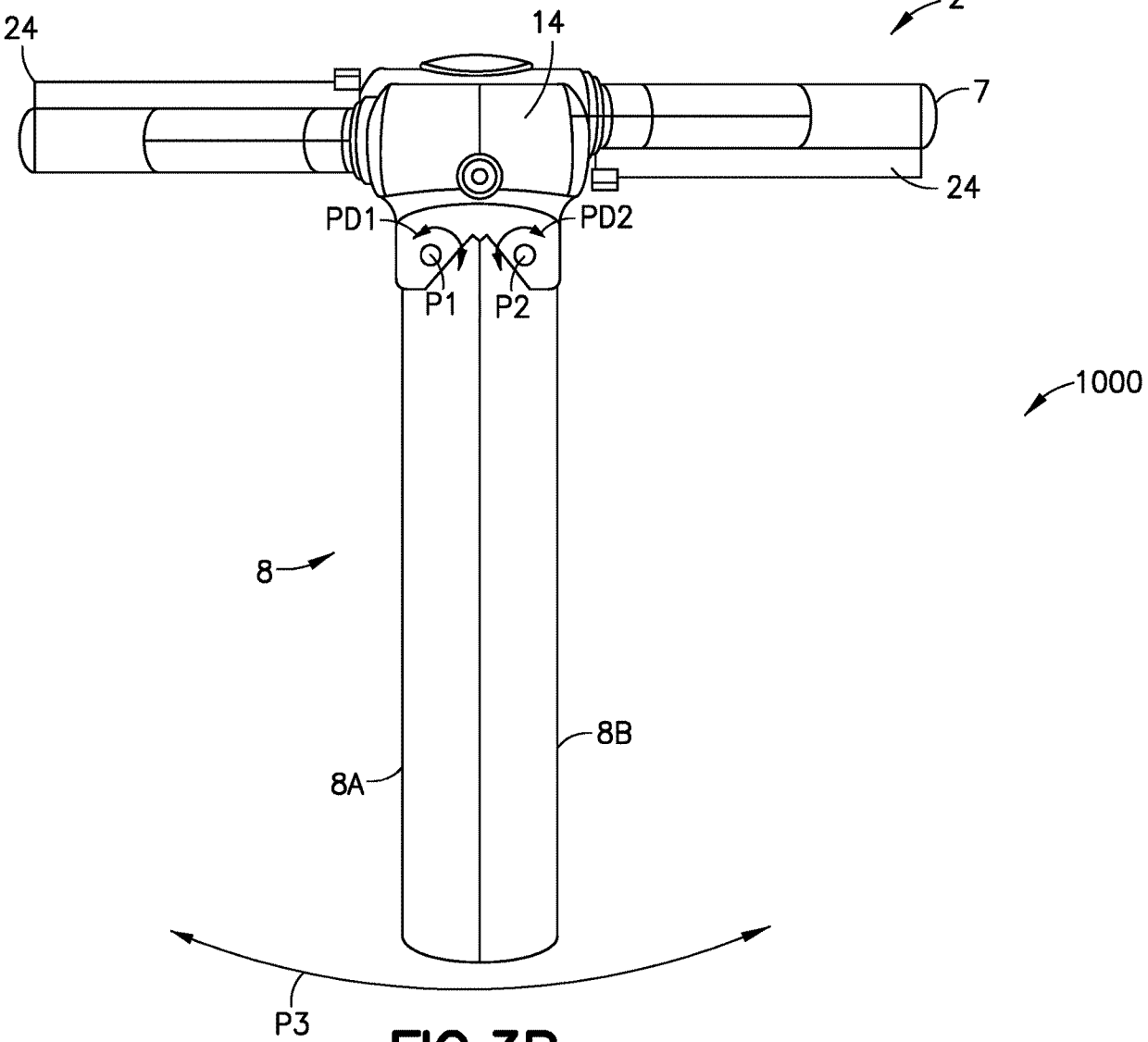
FIG. 3B is a side view of a portion of the infant care apparatus of FIG. 2 in accordance with aspects of the disclosed embodiment.
Figure 3C:
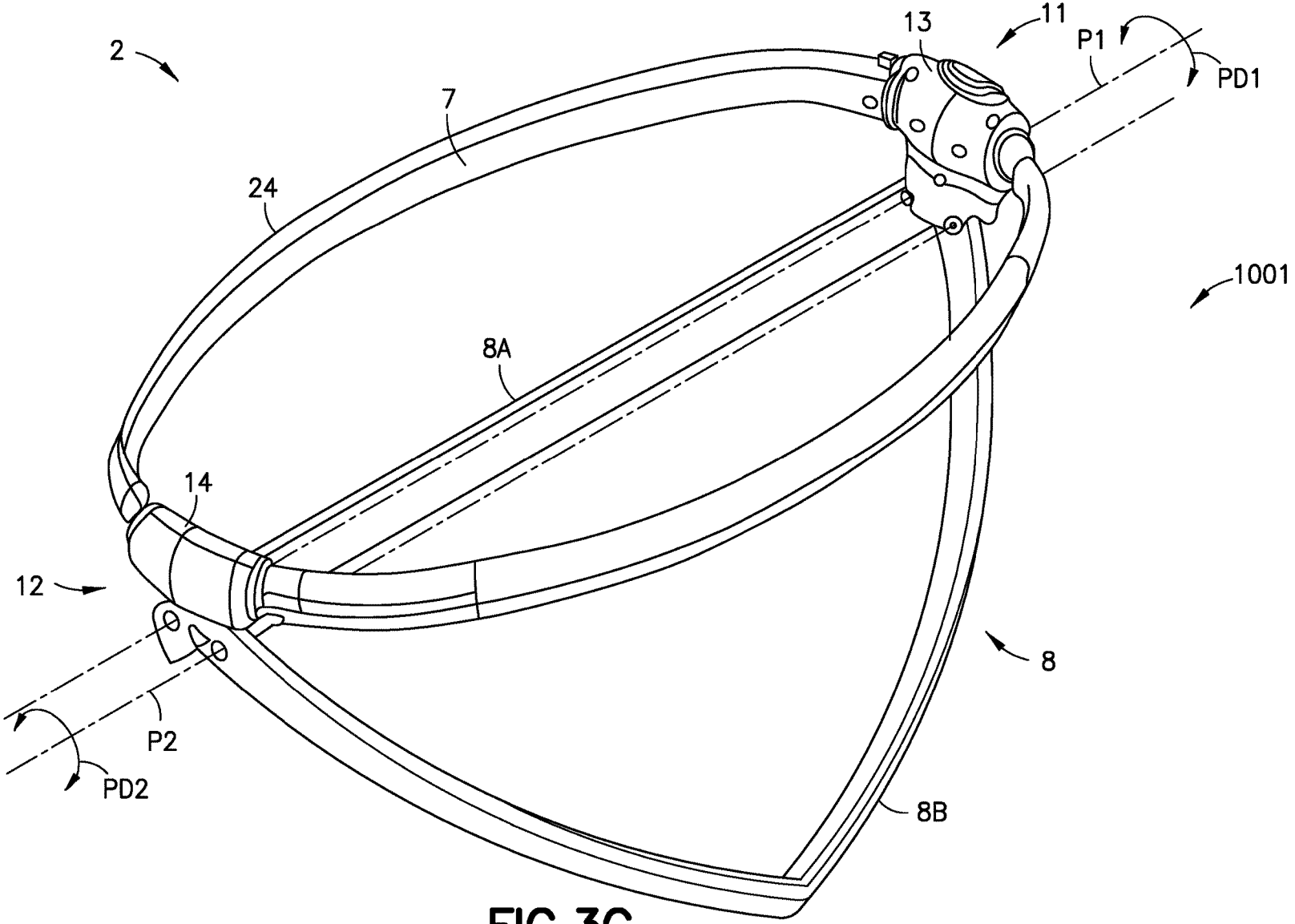
FIG. 3C is a perspective view of a portion of the infant care apparatus of FIG. 2 in accordance with aspects of the disclosed embodiment.
Figure 3D:
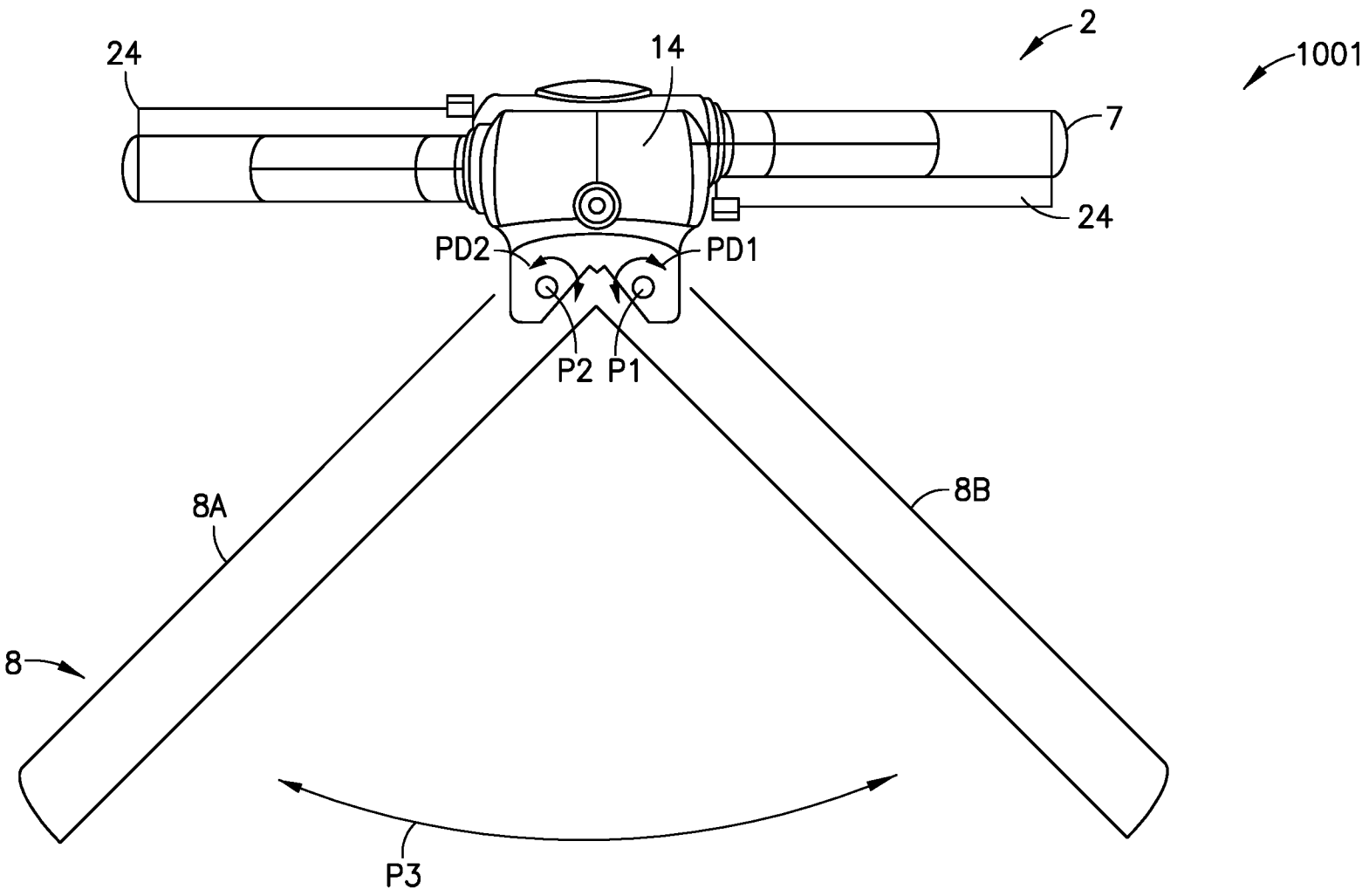
FIG. 3D is a side view of a portion of the infant care apparatus of FIG. 2 in accordance with aspects of the disclosed embodiment.
Figure 3E:
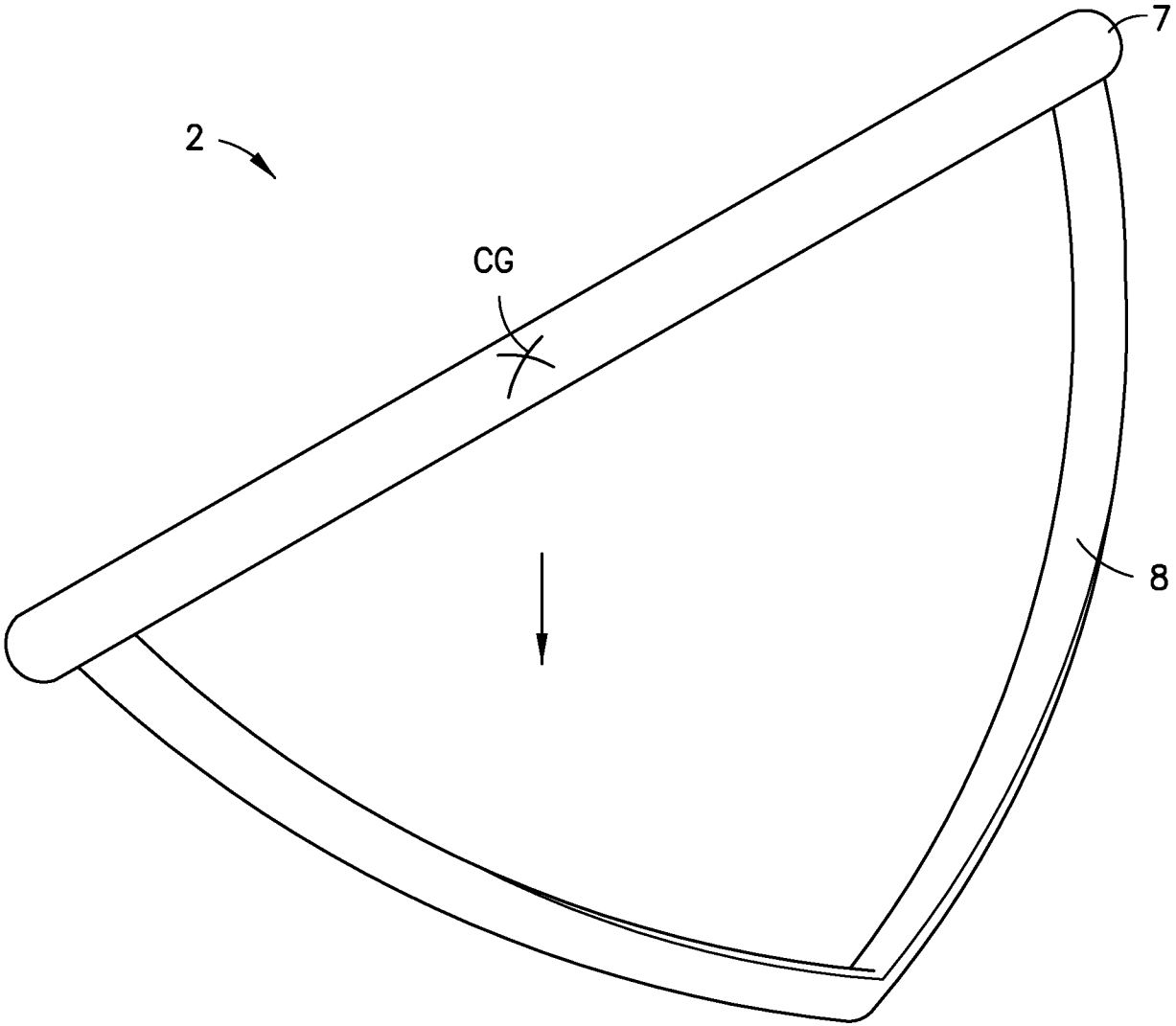
FIG. 3E is a side view of a portion of the infant care apparatus of FIG. 2 in accordance with aspects of the disclosed embodiment.

In one aspect, referring to FIGS. 3A-3E, the mating support member 8 is a bisected or divided support that includes two support tubes 8A, 8B arranged side by side along the longitudinal axis of the mating support member 8. The two support tubes 8A, 8B are pivotably coupled to the upper end 11 and lower end 12 of the infant seat 7 so as to pivot relative to one another in direction P3. The two support tubes 8A, 8B may pivot from a first position 1000 (FIGS. 3A and 3B), where the two support tubes 8A, 8B are positioned together to form a mountable base (mountable to the infant support coupling 200), to a second position 1001 (FIGS. 3C and 3D). In the second position 1001, the two support tubes 8A, 8B are pivoted apart from one another so as to form, e.g., support legs which are configured to independently support at least the weight of the infant support 2 and an infant or baby placed therein, such as, on a floor surface. For example, support tube 8A may pivot about axis P1 in direction PD1 from the first position 1000 to the second position 1001. Support tube 8B may pivot about axis P2 in direction PD2 from the first position 1000 to the second position 1001. In one aspect, where the mating support member 8 has 2 arcuate portions, the center of gravity CG (FIG. 3E) of the infant is positioned over the two arcuate portions so that the infant seat 7 is stably supported on the arcuate portion so as to cradle and rock with a predetermined range of motion without unstable transition to the other arcuate portion. Any suitable clips, snaps, etc. may be provided to releasably couple the support tube 8A and support tube 8B together in the first position 1000.

Figure 2B:
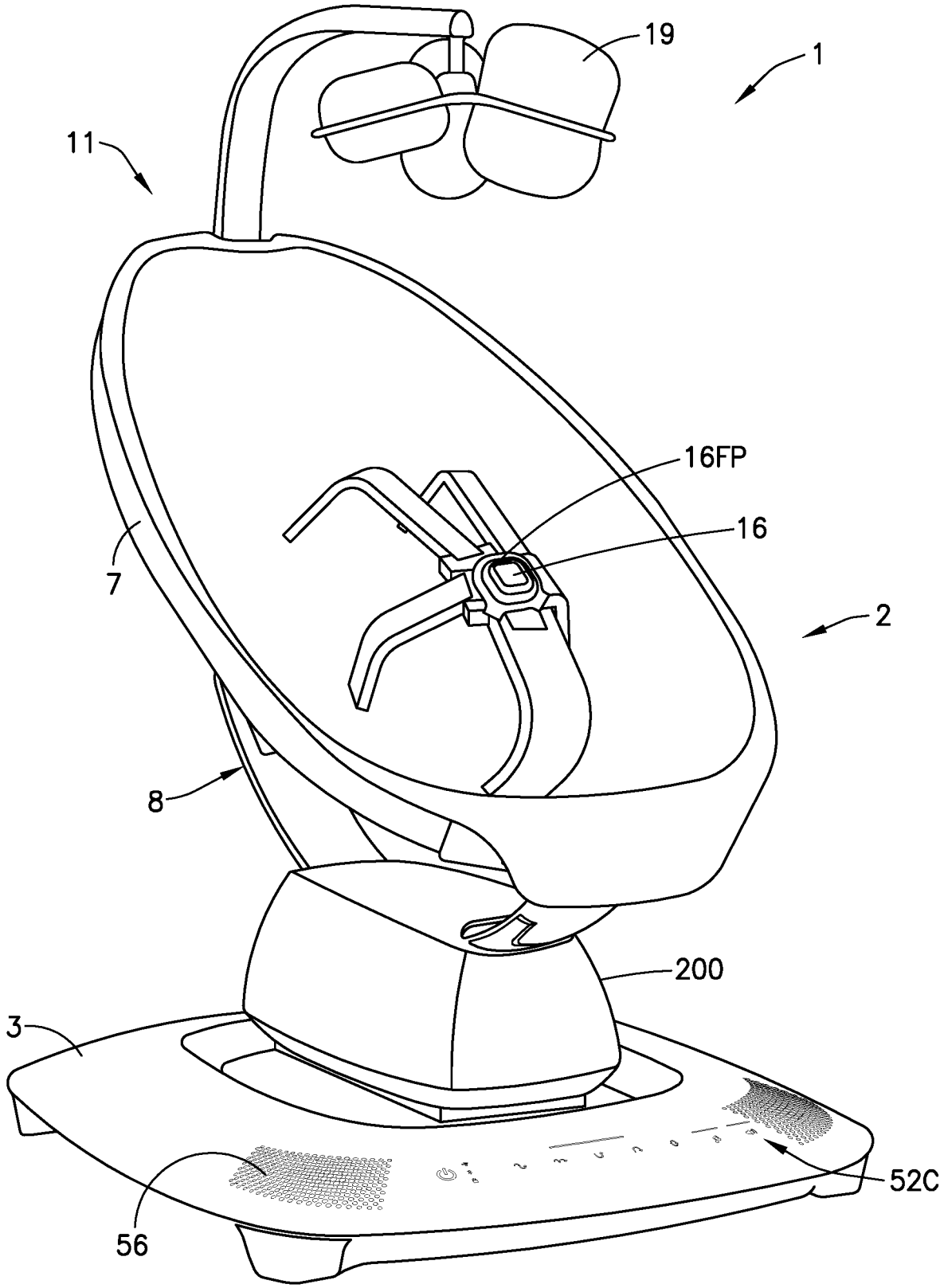
FIG. 2B is a perspective view of an infant care apparatus in accordance with aspects of the disclosed embodiment.
Figure 2C:
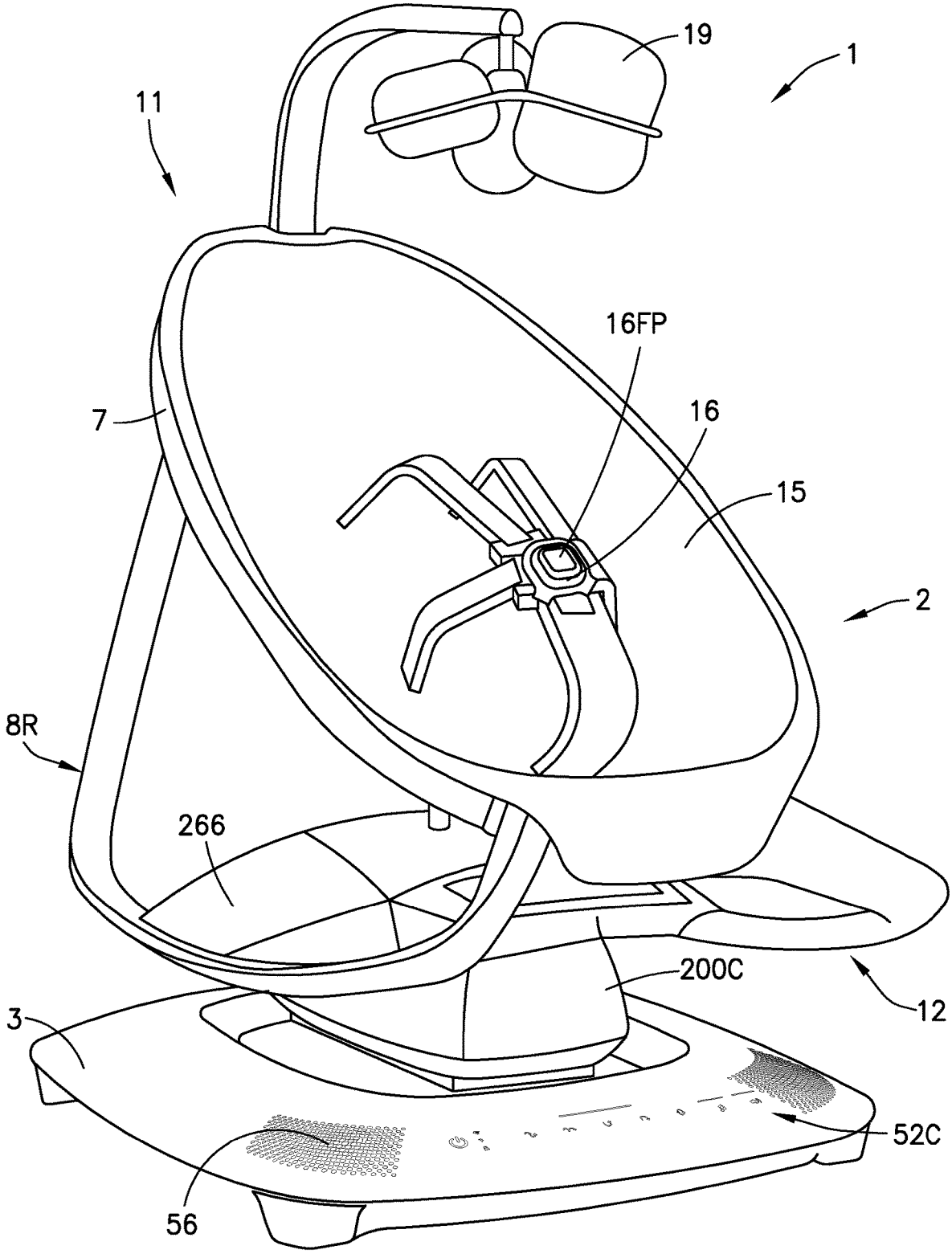
FIG. 2C is a perspective view of an infant care apparatus in accordance with aspects of the disclosed embodiment.
Figure 2D:
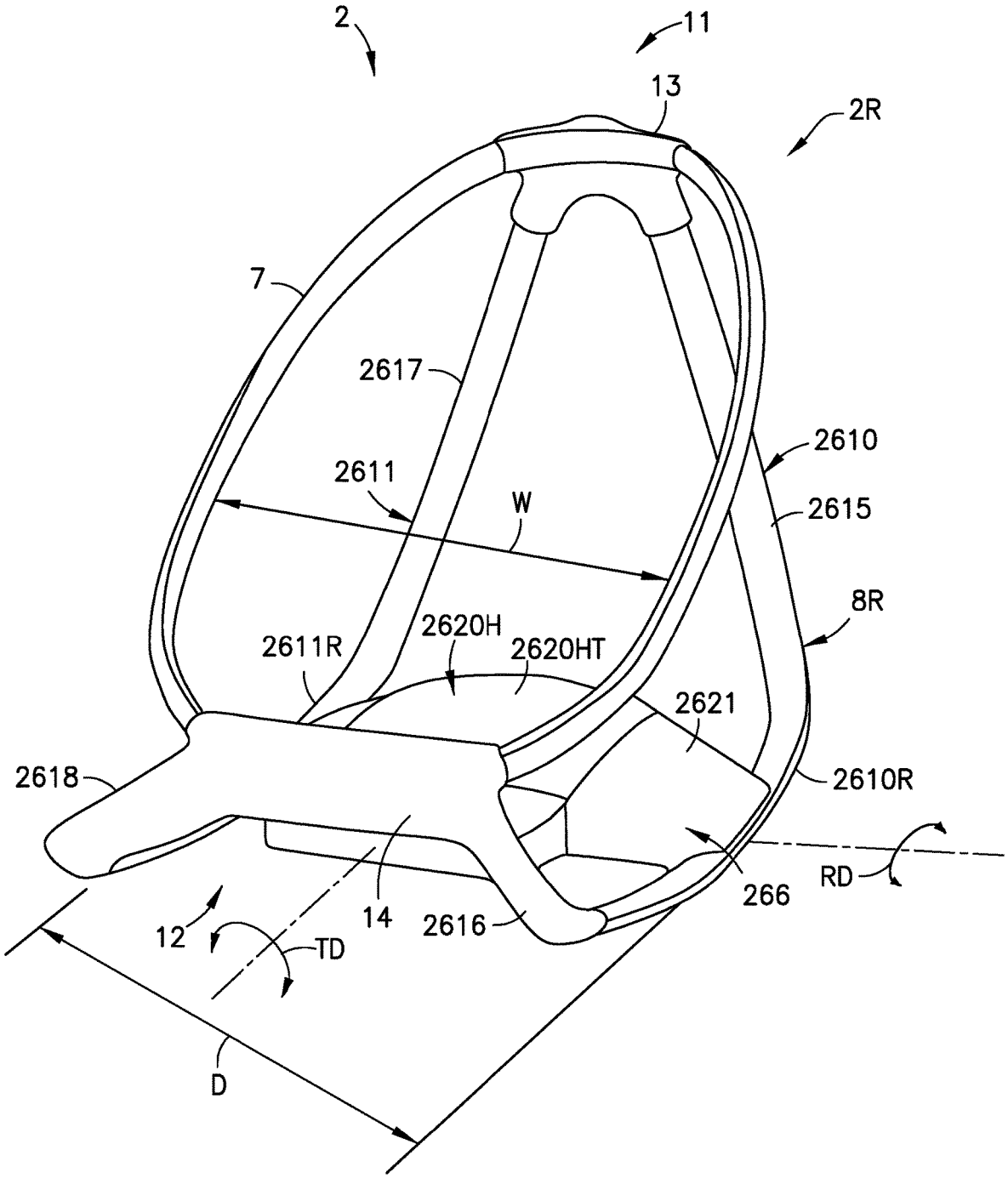
FIG. 2D is a perspective view of a portion of the infant care apparatus of FIG. 2C in accordance with aspects of the disclosed embodiment.
Figure 2E:
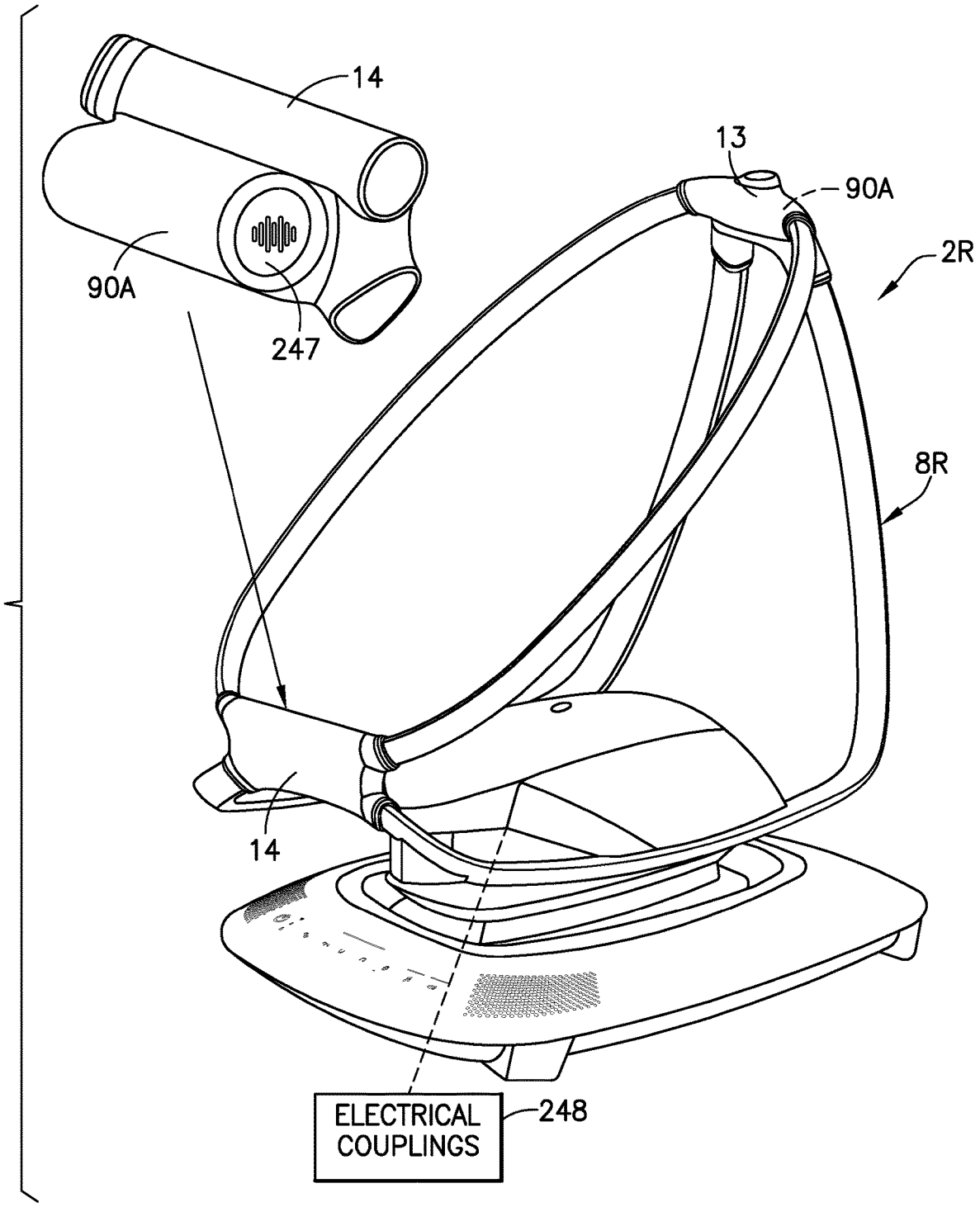
FIG. 2E is a perspective view of a portion of the infant care apparatus of FIG. 2C in accordance with aspects of the disclosed embodiment.

Referring to FIGS. 2C-2E, the mating support member 8R includes supports 2610, 2611. Each of the supports 2610, 2611 includes a rocker portion 2610R, 2611R (also referred to herein as rocker rails) and stretcher portions 2615-2618. Here the rocker portions 2610R, 2611R are coupled to the upper end 11 of the infant seat 7 at the upper connector 13 by a respective stretcher portion 2615, 2617. The rocker portions 2610R, 2611R are also coupled to the lower end 12 of the infant seat 7 at the lower connector 14 by respective stretcher portion 2616, 2618. The rocker portions 2610R, 2611R have an arcuate shape so as to form a cradle with the infant seat 7 that has a center of gravity CG (substantially similar to that shown in FIG. 3E) that is positioned over the rocker portions (or rocker rails) 2610R, 2611R so that the infant seat 7 is stably supported on the rocker portions 2610R, 2611R so as to cradle and rock with a predetermined range of motion without unstable transition to the stretcher portions 2615-2618. In this aspect, the supports 2610, 2611 extend upper end 11 and lower end 12 of the infant seat so that the rocker portions 2610R, 2611R are separated from each other by a predetermined distance D. The predetermined distance D is any suitable distance that provides for stable support of the infant seat 7 in a direction TD that is transverse to a rocking direction RD of the infant seat 7. For exemplary purposes only, the distance D may be substantially equal to or greater than a width W of the infant seat; while in other aspects the distance D may be less than the width W of the infant seat 7. The articulated span member 266, which will be described in greater detail below, is coupled to each of the rocker portions 2610R, 2611R and spans the distance D between the rocker portions 2610R, 2611R. The articulated span member 266 provides for coupling the infant seat 7 to the base 3 and for adjusting the angle θ of the infant seat 7 when the infant seat 7 is coupled to the base 3.

Figure 27A:
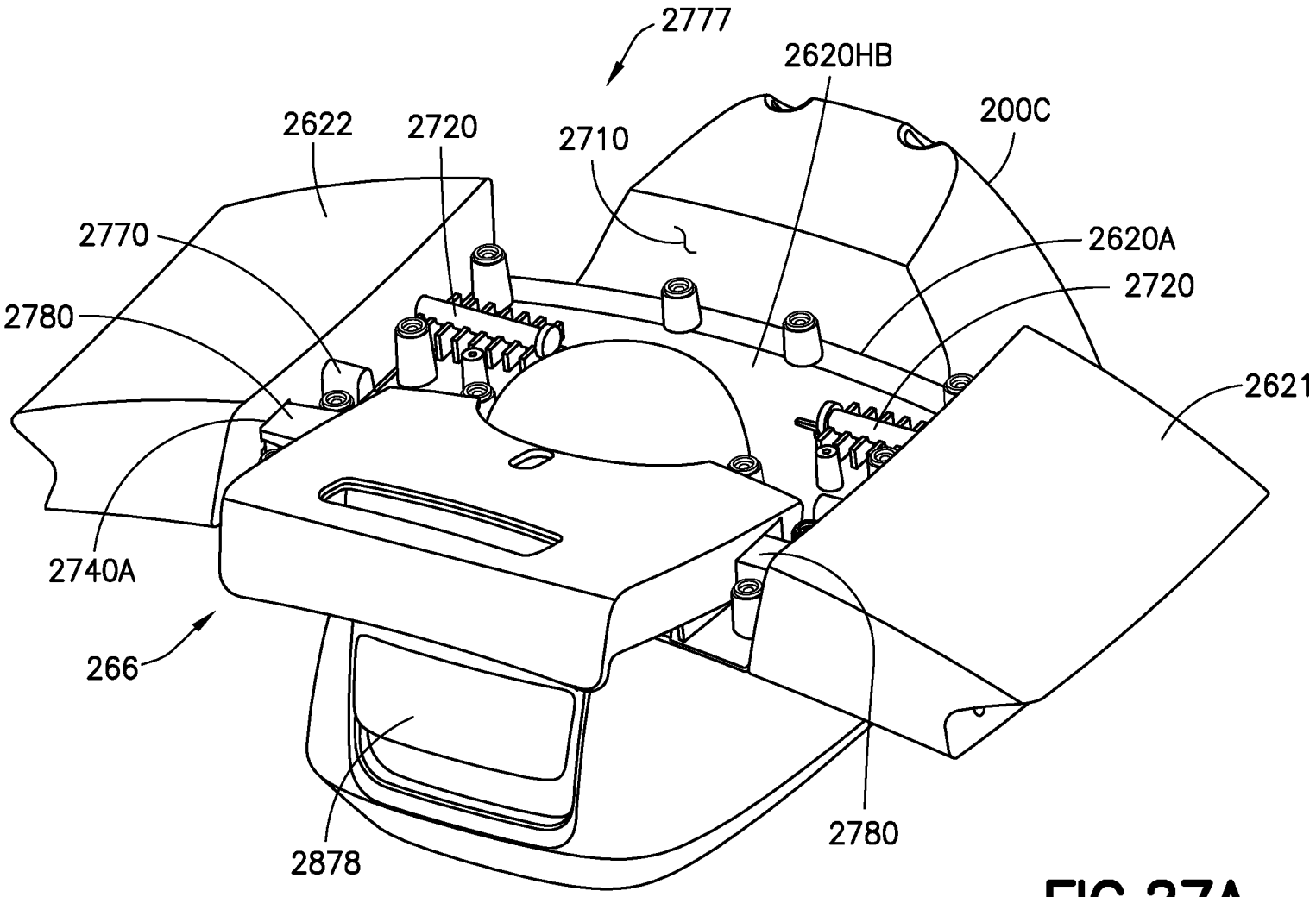
FIG. 27A is a perspective view of a portion of the infant care apparatus of FIG. 2C in the first orientation of FIG. 26A in accordance with aspects of the disclosed embodiment.
Figure 27B:
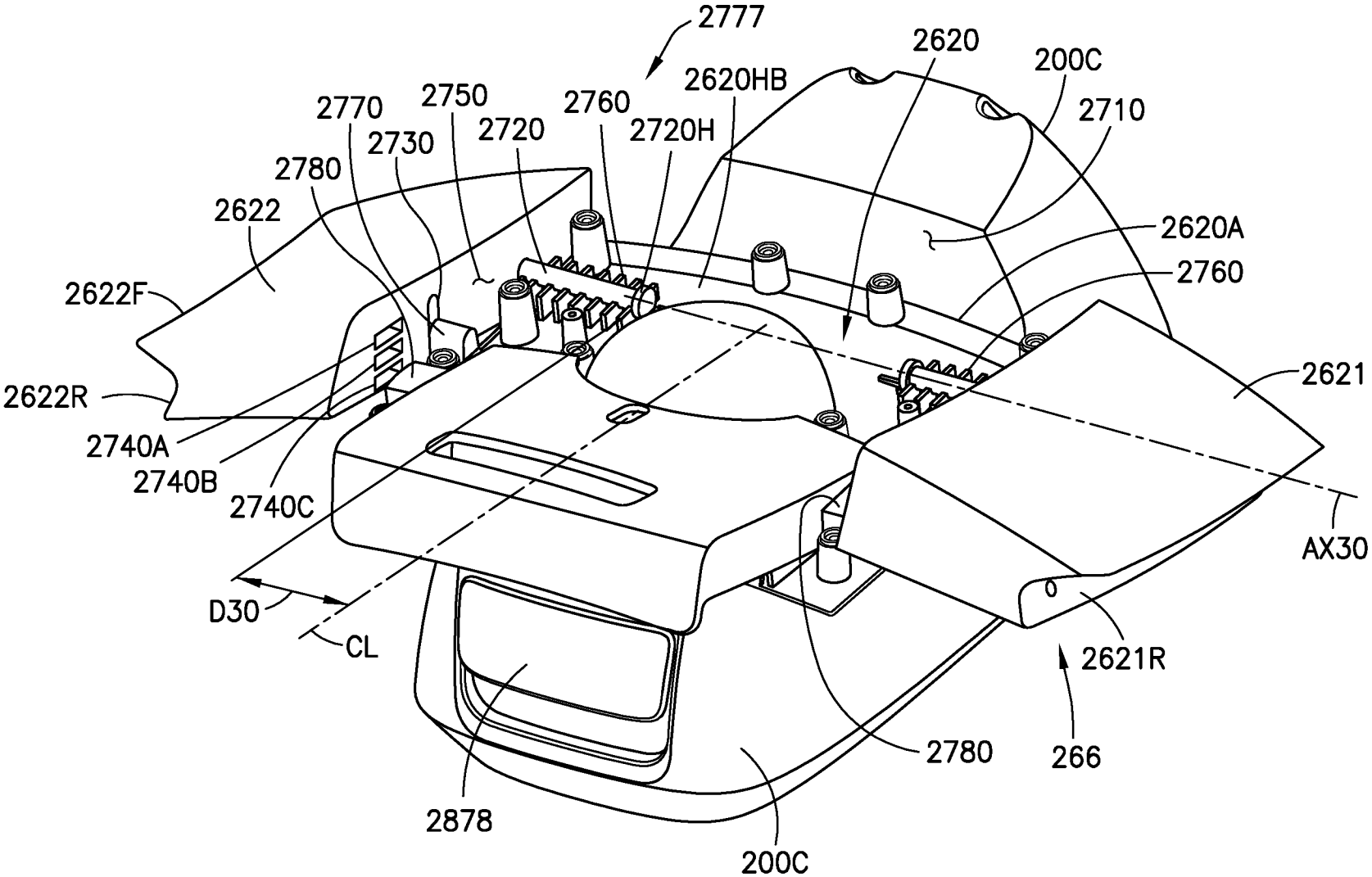
FIG. 27B is a perspective view of the portion of the infant care apparatus of FIG. 27A in the second orientation of FIG. 26B in accordance with aspects of the disclosed embodiment.
Figure 27C:
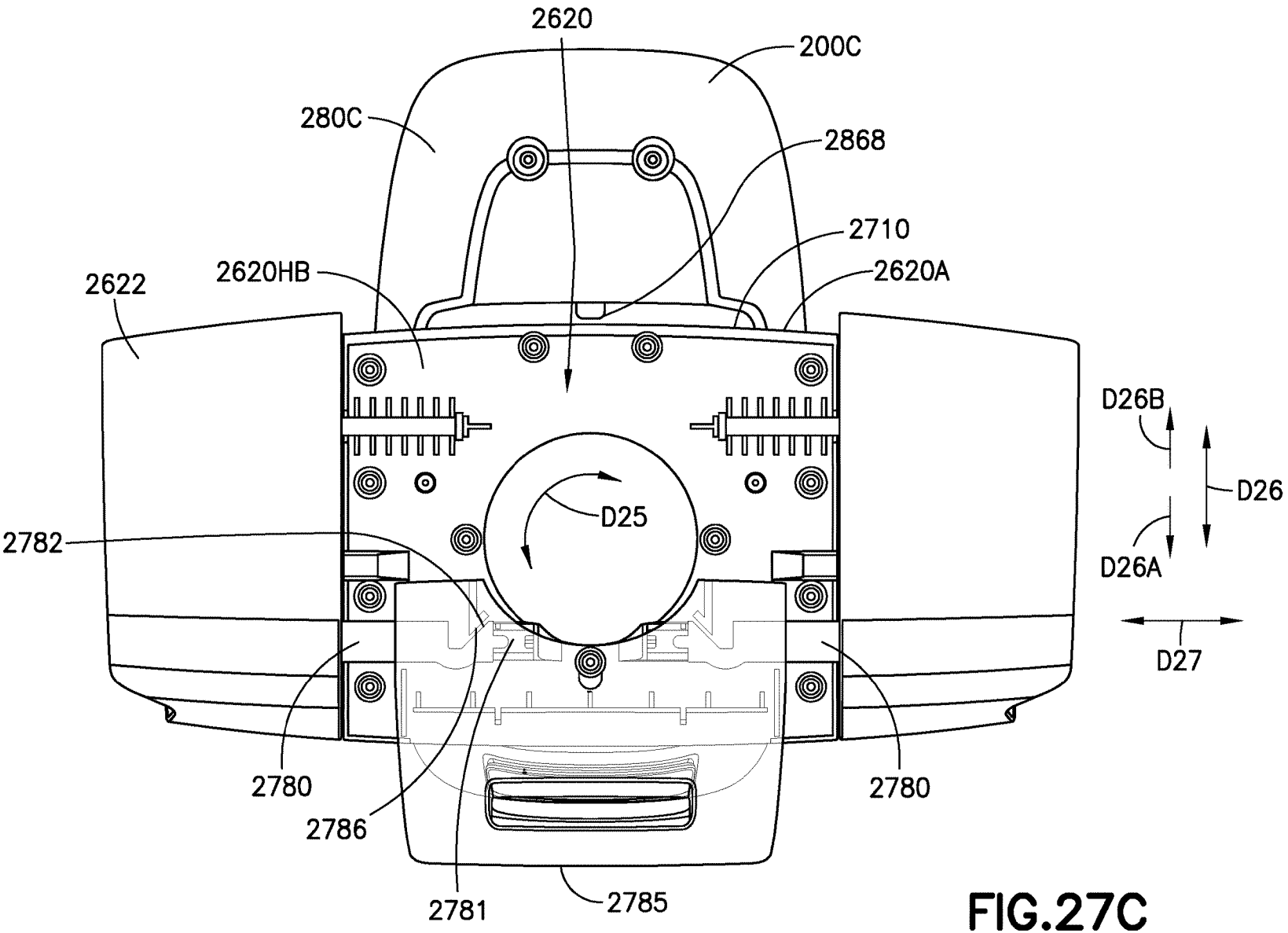
FIG. 27C is a schematic plan illustration of the portion of the infant care apparatus of FIG. 27A in accordance with aspects of the disclosed embodiment.

Referring to FIGS. 2C, 2D, 26A-27C, the articulated span member 266 (also referred to herein as an infant support coupling 266) includes a base 2620 (which only a portion of which is illustrated in FIGS. 27A-27C) and articulating supports 2621, 2622. The infant support coupling or span member 266 is arranged to releasable couple the infant support 2 and the base 3 so as to mount and dismount the infant support 2 to the base 3, wherein the infant support coupling 266 depends from the rocker rails (or rocker portion) 2610R, 2611R and has an integral recline adjustment mechanism 2777 of the rocker 2R. The base 2620 is configured to couple with the infant support receiver coupling 200C as described herein and has an actuable grip 2888 that engages the infant support coupling 266, the grip 2888 being configured to actuate between a closed position and an open position to capture and release the infant support 2 to the base 2620, wherein the grip actuation is separate and distinct from recline adjustment of the rocker 2R. The articulating supports 2621, 2622 form a part of the recline adjustment mechanism 2777 and each have a rocker coupling surface 2621R, 2622R that mates with a respective rocker portion 2610R, 2611R in any suitable manner (e.g., such as with any suitable fasteners) so that the infant seat 7 is suspended by the articulated span member 266 when the infant seat 7 (including the articulated span member 266) is coupled to the infant support receiver coupling 200C. Each of the articulating supports 2621, 2622 is rotatably coupled to the base 2620 so as to be indexable in rotation to adjust the angle θ of the infant seat 7 when the infant seat 7 is coupled to the base 3. Coupling of the articulating supports 2621, 2622 with the base 2620 of the articulated span member 266 will be described with respect to articulating support 2622; however, it should be understood that the coupling between articulating support 2621 and the base 2620 is substantially similar (but opposite in hand) and like reference numerals will be used with respect to the coupling of the articulating supports 2621, 2622 with the base 2620. It is also noted that the configuration of the base 2620 and articulating supports 2621, 2622 described herein are exemplary and that the base 2620 and articulating supports 2621, 2622 may have any suitable configurations that effect coupling of the articulated span member 266 to the rocker portions 2610R, 2611R and the infant support receiver coupling 200C.

In accordance with one or more aspects of the disclosed embodiment, the recline adjustment mechanism 2777 will be described. The recline adjustment mechanism 2777 is disposed to adjust at least one of rocker rail incline and seat incline with respect to the base 2620. The recline adjustment mechanism 2777 also has an adjustment handle 2785, separate and distinct from a grip actuation handle 2878 (also referred to as a cam lever) configured to actuate the actuable grip 2888. For exemplary purposes, the articulating support 2622 includes a frame 2622F that forms the rocker coupling surface 2622R. The frame 2622F has any suitable shape and size for coupling the respective rocker portion 2611R to the base 2620. The frame 2622F includes a base interface surface 2750 that faces the base 2620 when the articulating support 2622 is coupled to the base 2620. A pivot pin 2720 extends from the frame 2622F so as to protrude from the base interface surface 2750, where the pivot pin 2720 is coupled to the frame 2622F in any suitable manner (e.g., such as with any suitable fasteners or integrally formed therewith). The interface surface 2750 includes a guide slot 2730 and at least two pivot stop apertures 2740A-2740C (three are shown for exemplary purposes), where the pivot stop apertures 2740A-2740C are substantially radially arranged about a pivot axis AX30 at any suitable predetermined angular intervals formed at least in part by the pivot pin 2720.

The base 2620 includes a housing 2620H that includes a housing bottom 2620HB and a housing top 2620HT that are coupled to each other in any suitable manner, such as with any suitable fasteners. The housing 2620H forms a bearing 2760 (part of which is illustrated in FIGS. 27A-27C) that receives the pivot pin 2720 and locates the pivot pin 2720 (and the articulating support 2622) relative to the base 2620. For example, the bearing 2760 forms, with the pivot pin 2720, the pivot axis AX30 and sets a lateral distance D30 of the pivot pin from, for example, a centerline CL of the base 2620. For example, the pivot pin 2720 includes a head 2720H that is laterally held captive by the bearing 2760 so as to control the lateral distance D30 and provide a running clearance between the base interface surface 2750 and the housing 2620H. In the example shown the bearing 2760 is integrally formed with the housing bottom 2620HB and a housing top 2620HT; however, in other aspects, the bearing 2760 may have any suitable configuration and be coupled to the housing 2620H in any suitable manner.

The housing 2620H includes a pivot guide 2770 that extends from one or more of the housing bottom 2620HB and housing top 2620HT. The pivot guide 2770 extends through the guide slot 2730 and guides, through interface with the guide slot 2730, pivoting movement of the articulating support 2622 about the pivot axis AX30. It is noted that the guide slot 2730 has a length that limits the rotation of the articulating support 2622 about the pivot axis AX30 to any suitable angular range of rotation so as to prevent undesired tipping of the infant seat 7 beyond a predetermined rotation range when the infant seat is coupled to the base 3.

The base 2620 includes pivot-lock arms 2780 that are configured to extend into and retract from the pivot stop apertures 2740A-2740C for adjusting the angle θ of the infant seat 7 when the infant seat 7 is coupled to the base 3. Each pivot-lock arm 2780 is slidably mounted to the housing 2620H so as to reciprocate in direction D27. Any suitable resilient member 2781 (such as a coil spring, resilient foam, etc.) is provided within the housing 2620H and is configured to bias the respective pivot-lock arm 2780 to an extended position (i.e., towards the respective articulating support 2621, 2622) and into one of the pivot stop apertures 2740A-2740C. It is noted that while the pivot-lock arms 2780 and the pivot stop apertures 2740A-2740C are illustrated as having a rectangular cross section, in other aspects, the pivot-lock arms 2780 and the pivot stop apertures 2740A-2740C may have any suitable cross-section.

Actuation of the pivot-lock arm 2780 from the extended position (e.g., extending through one of the pivot stop apertures 2740A-2740C—shown in FIG. 27A) to a retracted position (shown in FIGS. 27B and 27C) for allowing pivoting movement of the infant seat 7 relative to the base 3 is provided by handle 2785. The handle 2785 is movable coupled to the base 2620 so as to move substantially in direction D26. Here each pivot-lock arm 2780 includes a cam surface 2782 and the handle 2785 includes a mating cam surface 2786 such that movement of the handle 2785 in direction D26A causes mating cam surface 2786 to engage cam surface 2782 thereby moving the pivot-lock arms 2780 in direction D27 towards the centerline CL of the base 2620 (against the bias provided by resilient member 2781) to retract the pivot-lock arms 2780 from the pivot stop aperture 2740A-2740C. Retracting the pivot-lock arms 2780 from the pivot stop aperture 2740A-2740C provides for rotational movement of the articulating supports 2621, 2622 about the pivot axis AX30 for adjusting the angle the angle θ of the infant seat 7 relative to the base 3. Movement of the handle 2785 in direction D26B disengages mating cam surface 2786 from cam surface 2782 such that the bias from the resilient members 2871 moves the pivot-lock arms 2780 away from the centerline CL of the base 2620 and extends the pivot-lock arms 2780 into a respective one of the pivot stop apertures 2740A-2740C. Extension of the pivot-lock arms 2780 into the respective pivot stop aperture 2740A-2740C arrests/prevents rotational movement of the articulating supports 2621, 2622 (and the infant seat 7) relative to the base 3 and sets/locks the angle θ to a predetermined infant seat recline angle that corresponds with a selected pivot stop aperture 2740A-2740C (e.g., a lockable recline position of the infant seat 7 is provided). In one or more aspects, the handle 2785 is biased in direction D26B through interface between cam surface 2782 and mating cam surface 2786 and the biasing force of the resilient members 2781. In other aspects, the handle 2785 is biased in direction D26B with any suitable biasing member (e.g., springs, resilient foam, etc.).

Referring to FIGS. 1, 1A, 2, 2A, and 2C, the base 3 of the infant care apparatus 1 includes a bottom support housing 4, a top enclosure 5 positioned over and at least partially covering the bottom support housing 4 a housing 280 including a cover 280C and a skirt 280S, and a housing base 281. In one aspect, the housing 280 is configured to house the infant support coupling 200. The infant support coupling 200 is disposed in the housing such that the housing cover 280C least partially encloses the infant support coupling 200 and the skirt 280S extends from the housing cover 280C so as to circumscribe or surround at least a portion of the movable stage 10 that extends through a surface 5A of the top enclosure 5. The housing base 281 is configured to couple the infant support coupling 200 to a movable stage 10 (FIG. 14) as will be further described herein. The top enclosure 5 includes the surface 5A which at least partially covers an opening through which the movable stage 10, supported on the bottom support housing 4, extends as will be further described herein. The surface 5A may be an articulated surface configured so that the opening formed therein moves with the movable stage 10.

In one aspect, the base 3 may have fixed or detachable legs 9. In one aspect, the legs 9 may be adjustable to raise or lower a height of the infant care apparatus 1 relative to, e.g., a floor surface or table on which the infant care apparatus 1 is placed. The legs 9 include feet 9A that are contoured or otherwise shaped and sized so that the legs 9 slide easily across a floor surface. For example, the feet 9A may have curved edges to substantially avoid snagging of the feet 9A on the flooring surface as the infant care apparatus 1 slides across the floor surface under the influence of an external motive force. In one aspect, the base 3 may further include a storage basket 18 provided to storage infant or baby gear, accessories, etc. The storage basket 18 may be mounted to the legs 9 or any other suitable portion of the infant care apparatus 1. In one aspect, the base 3 may include a portable music player dock 55, with speakers 56 and an input jack 57, for playing music or other pre-recorded sounds.

Referring now to FIGS. 2, 4, 5, 6A-6F, and 7 the mating support member 8 of the infant support 2 is configured so as to be releasably coupled to the base 3. Coupling of the infant support 2 is described herein with respect to the infant seat 7, however, it should be understood that in some aspects, the infant bed 6 may be coupled to the base 3 in a substantially similar manner using the mating support member 8 shown in FIGS. 2 and 2A. As noted above, the infant care apparatus 1 includes the infant support coupling 200 arranged so as to releasably couple the mating support member 8 of the infant support 2 to the base 3. The infant support coupling 200 includes a movable support 210 and automatically actuable grip members 220, 225 such as on placement of the infant seat 7 onto the infant support coupling 200.

Figure 4:
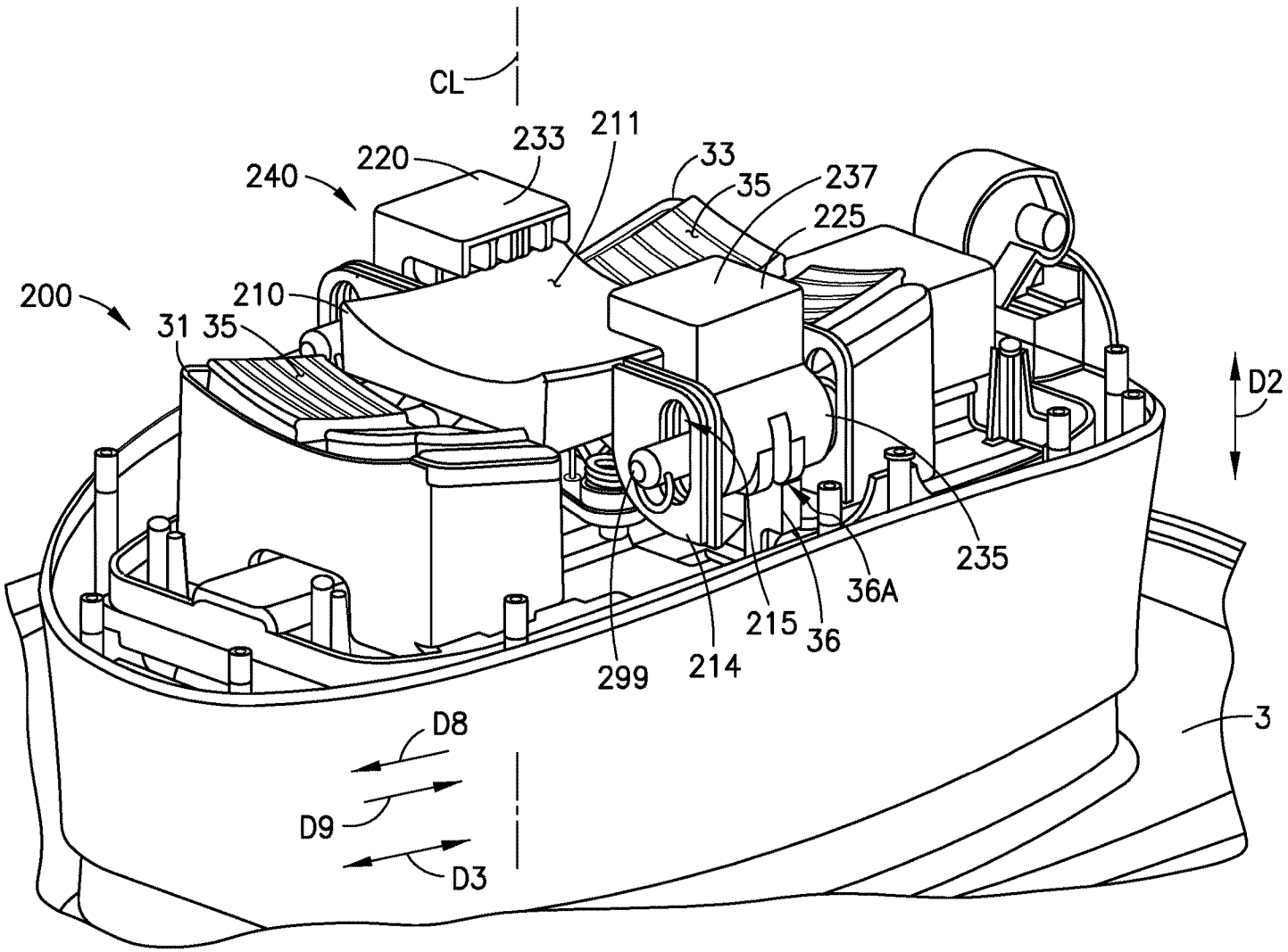
FIG. 4 is a perspective view of a portion of the infant care apparatus of FIG. 1 and/or FIG. 2 in accordance with aspects of the disclosed embodiment.
Figure 5:
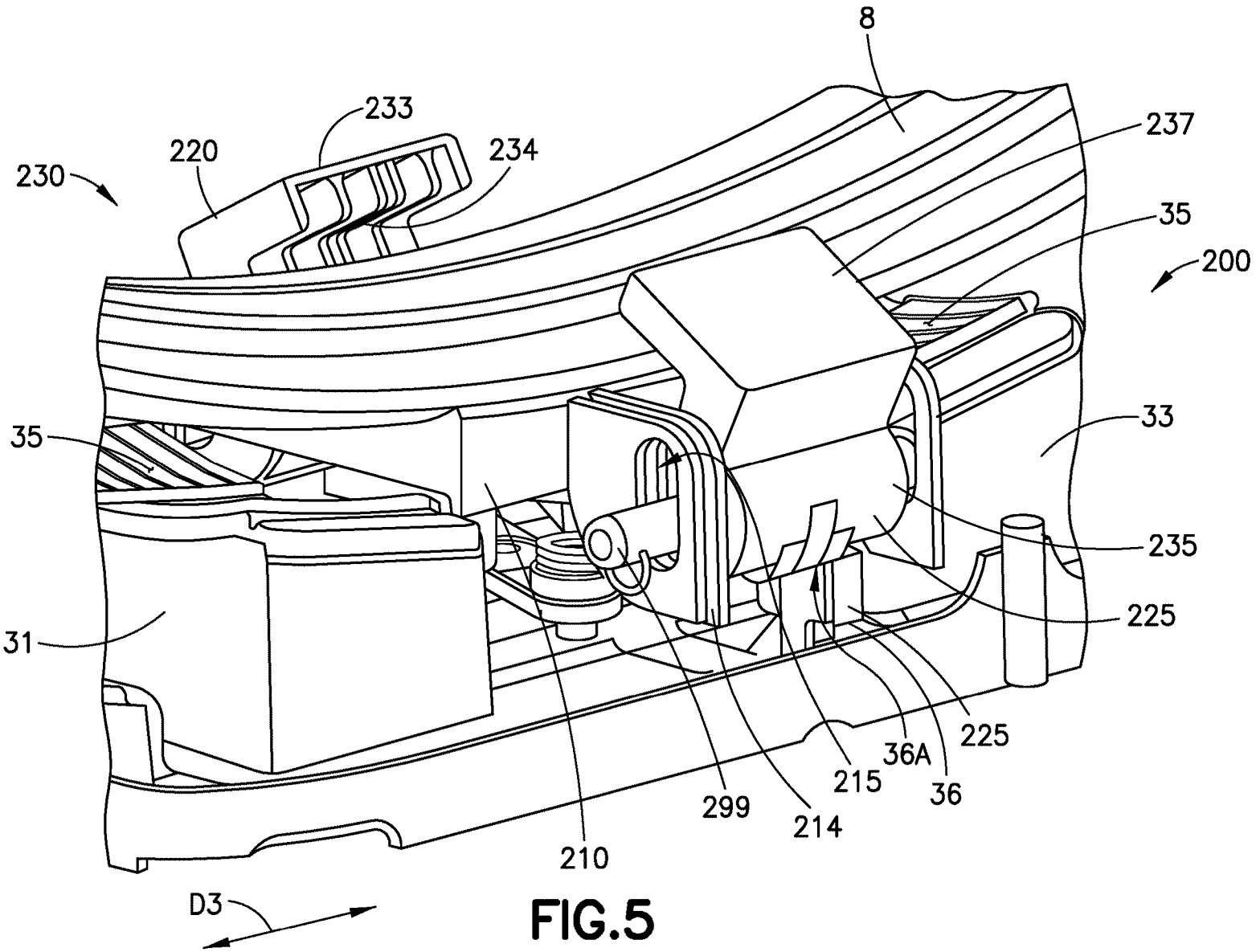
FIG. 5 is a perspective view of a portion of the infant care apparatus of FIG. 1 and/or FIG. 2 in accordance with aspects of the disclosed embodiment.
Figure 6A:
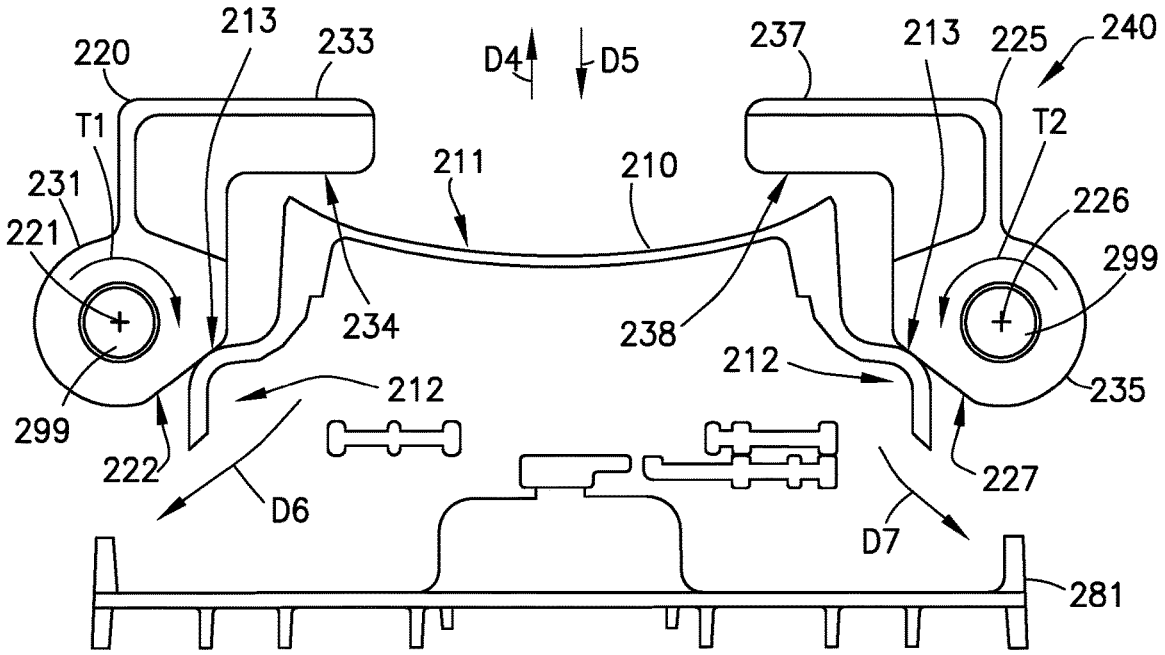
FIGS. 6A-6F are cross-sectional views of a portion of the infant care apparatus of FIG. 1 and/or FIG. 2 in accordance with aspects of the disclosed embodiment.
Figure 6B:
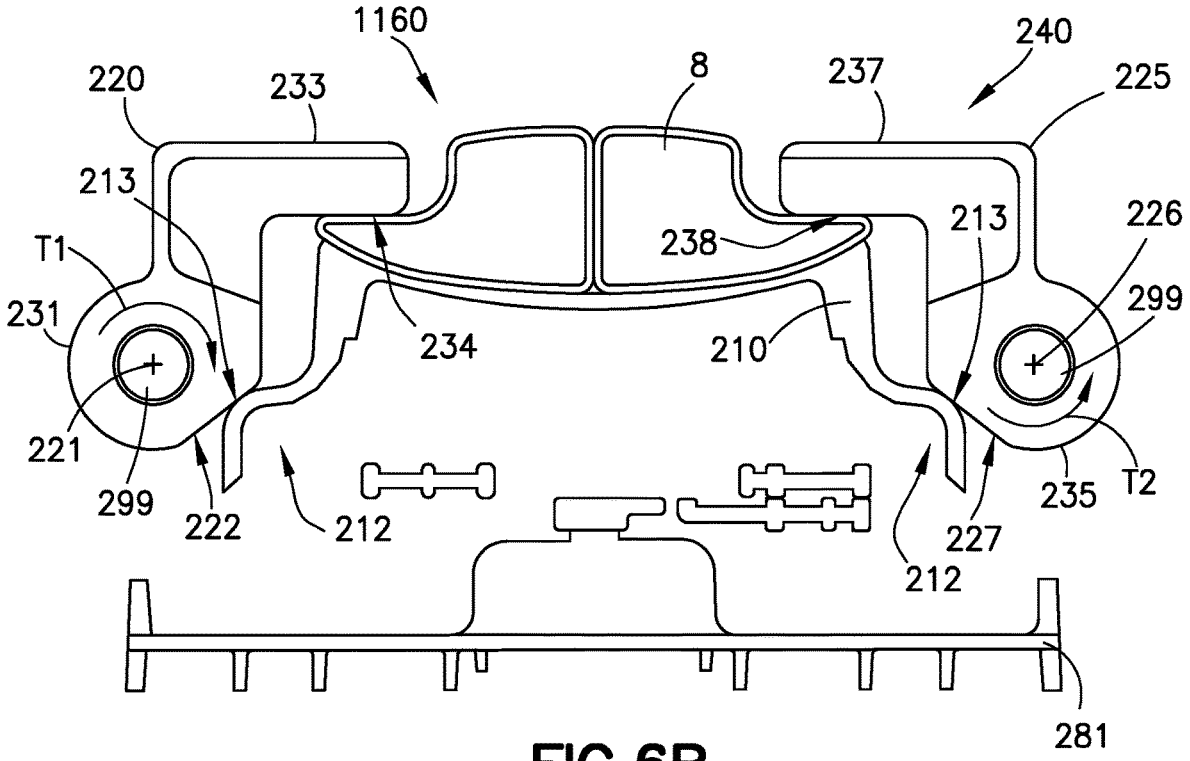
Figure 6C:
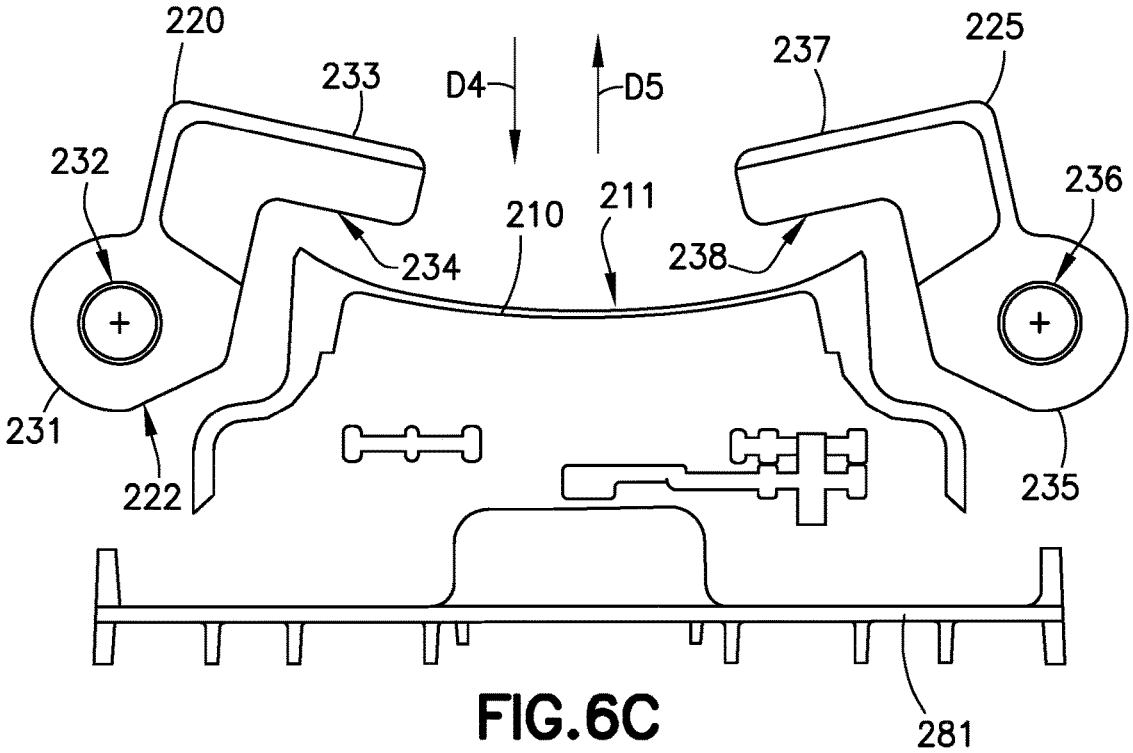
Figure 6D:
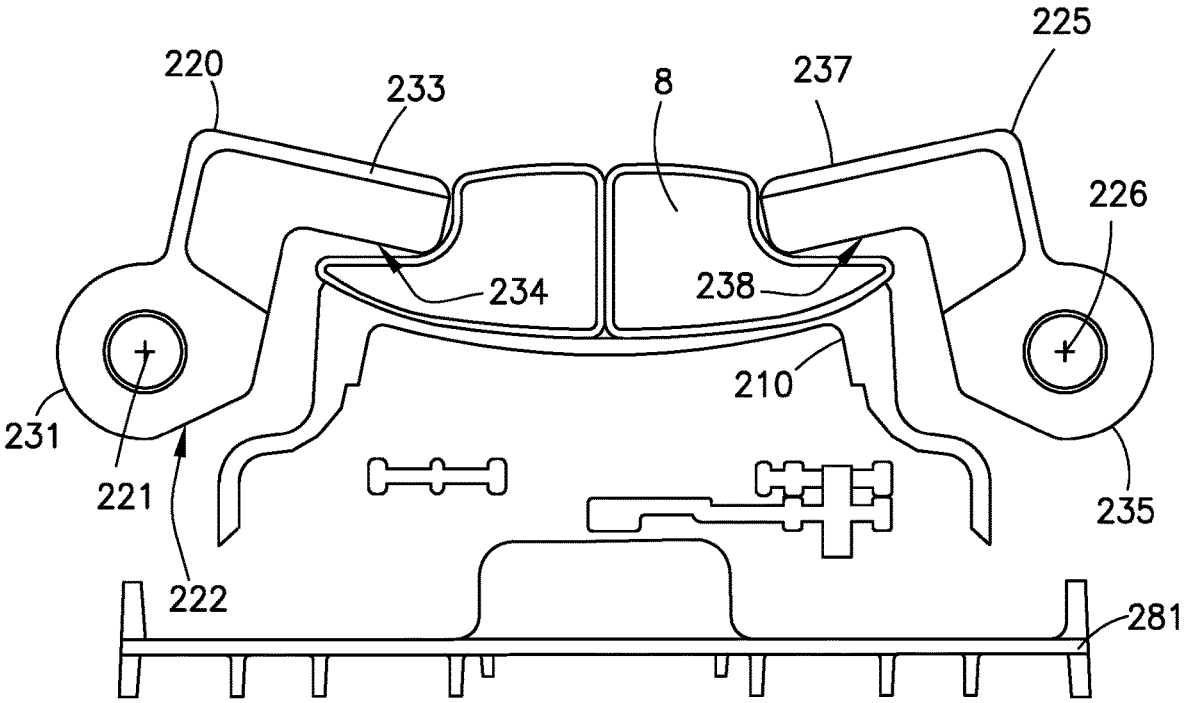
Figure 6E:
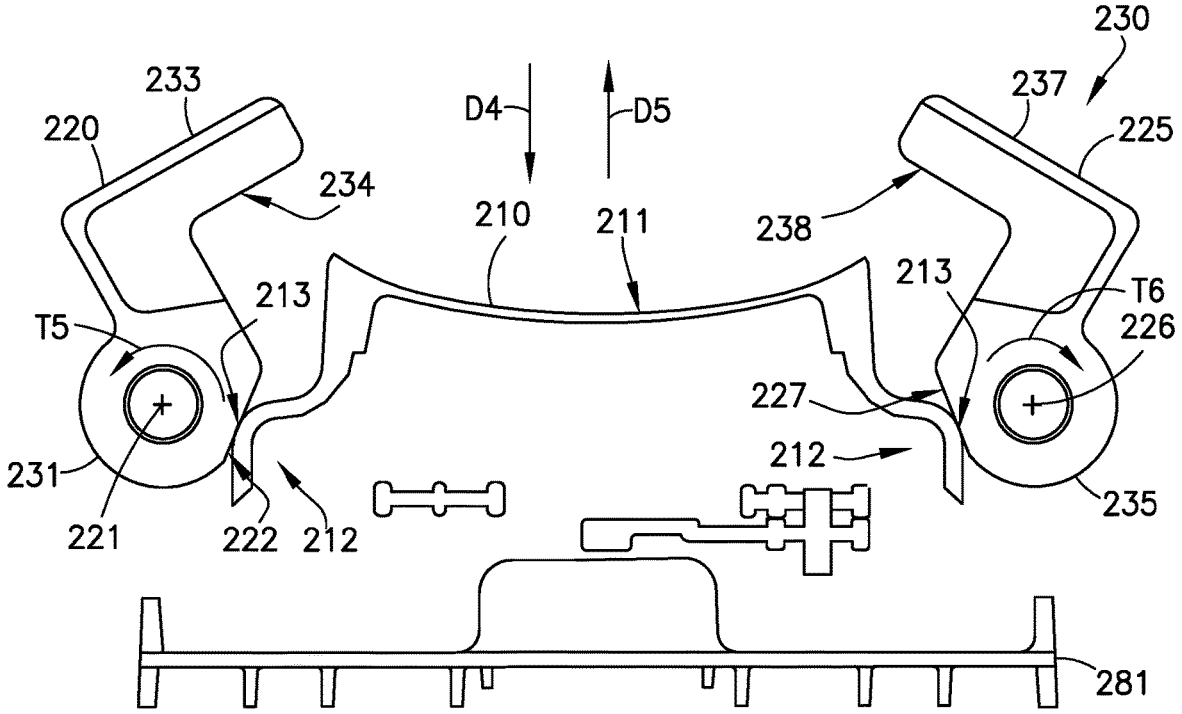
Figure 6F:
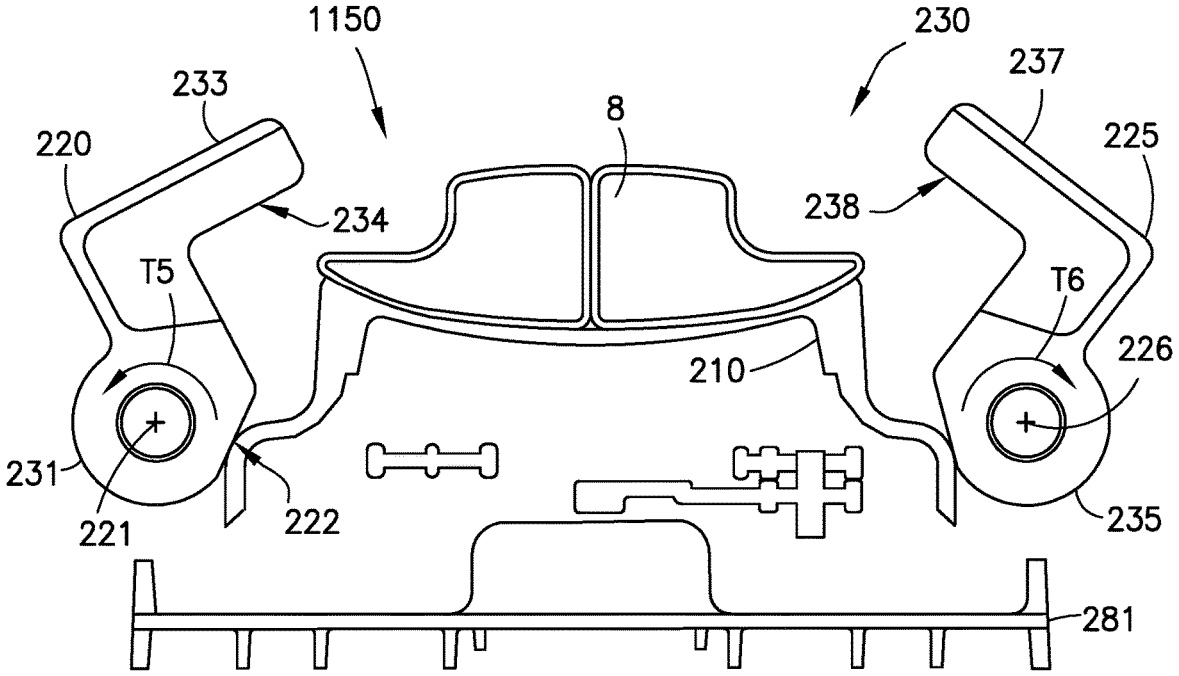
Figure 7:
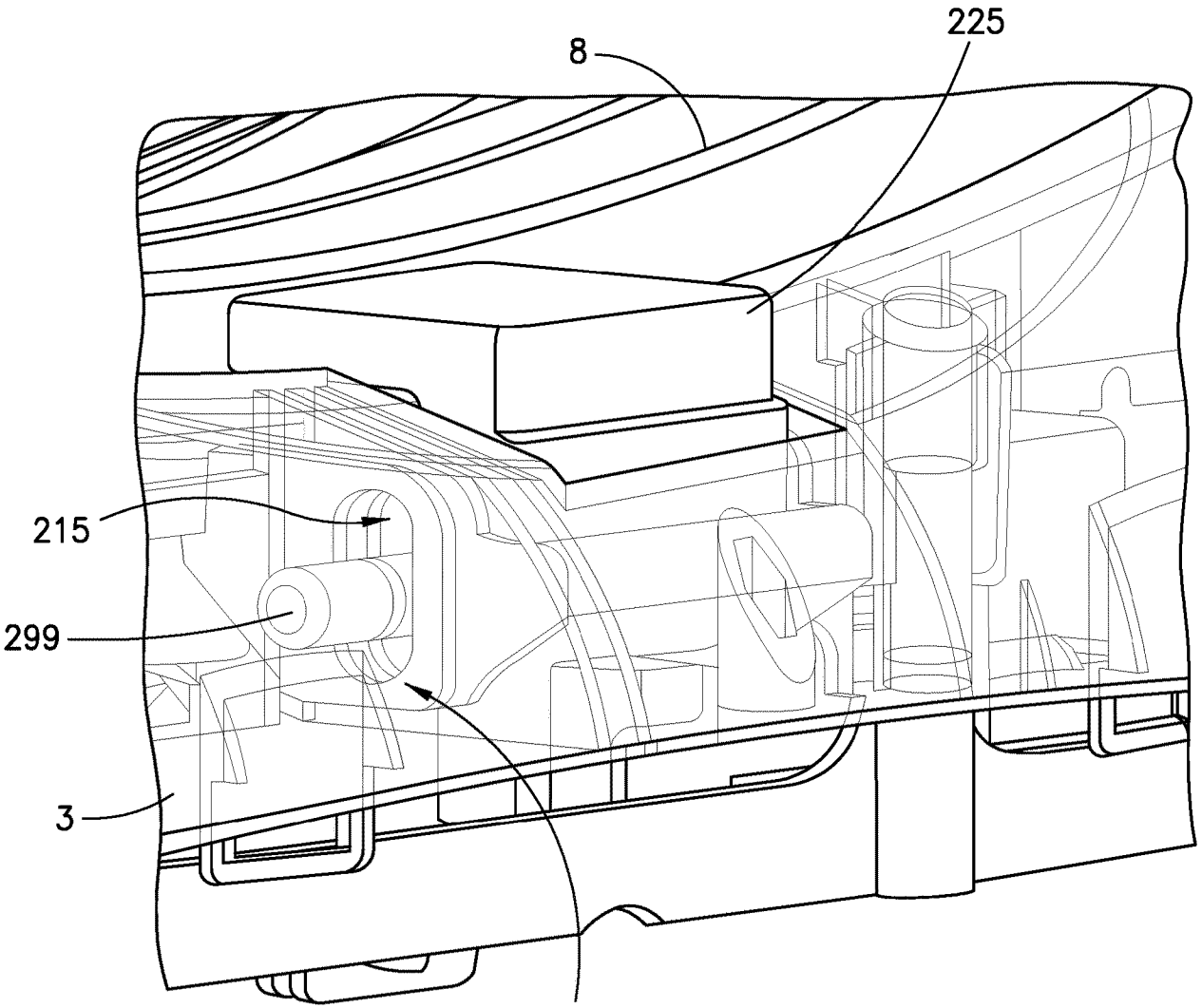
FIG. 7 is a perspective view of a portion of the infant care apparatus of FIG. 1 and/or FIG. 2 in accordance with aspects of the disclosed embodiment.
Figure 8B:
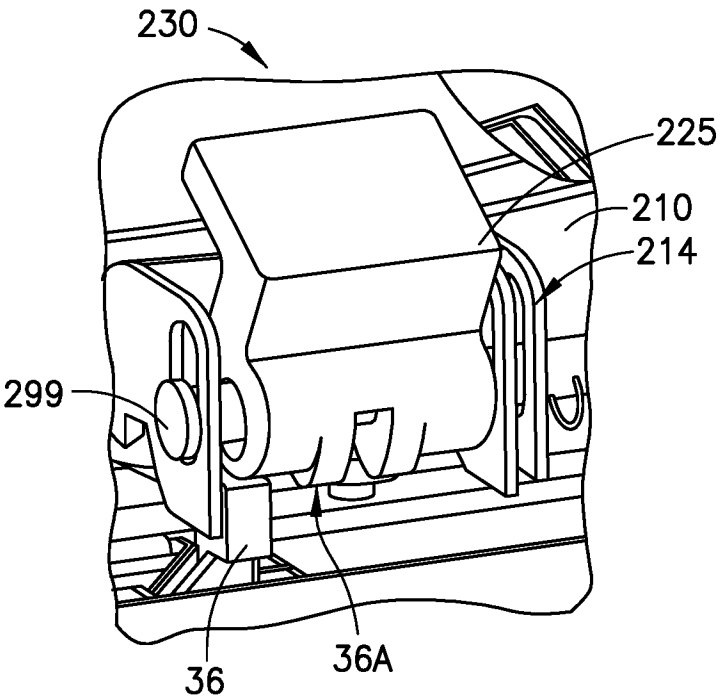
FIGS. 8A and 8B are perspective views of a portion of the infant care apparatus of FIG. 1 and/or FIG. 2 in accordance with aspects of the disclosed embodiment.
Figure 8A:
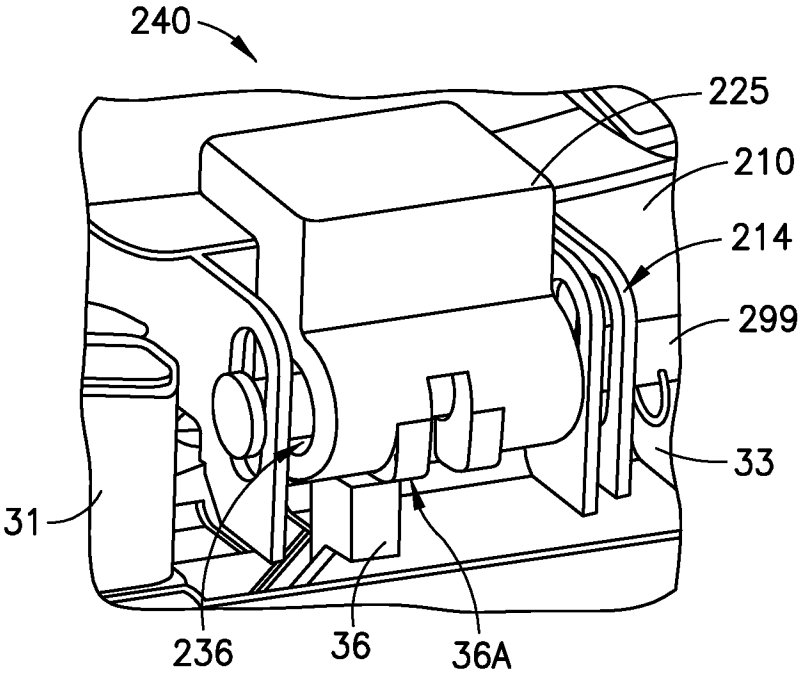

With particular reference to FIGS. 4 and 5, the movable support 210 is movably connected to the base 3 in any suitable manner so as to move in direction D2. The movable support 210 is disposed so as to form a support seat 211 that engages and supports the mating support member 8 of the infant support 2. The movable support 210 includes ribs 214 which couple to the base 3. The ribs 214 include a slotted hole 215 through which a pin 299 is inserted to constrain motion of the movable support 210 in direction D2. The slotted hole 215 has an elongated shape so that the movable support 210 may move between a first raised position 1150 (FIG. 6F) and a second lowered position 1160 (FIG. 6B) in direction D2 as will be described in greater detail below. The movable support 210 further includes a camming mechanism 212 (see, at least FIG. 6A) having camming surfaces 213 which are configured to interface with the automatically actuable grip members 220, 225 so as to automatically actuate the automatically actuable grip members 220, 225 between a clamped or closed position 240 (FIG. 6A) and an unclamped or open position 230 (FIG. 6F).

Figure 9B:
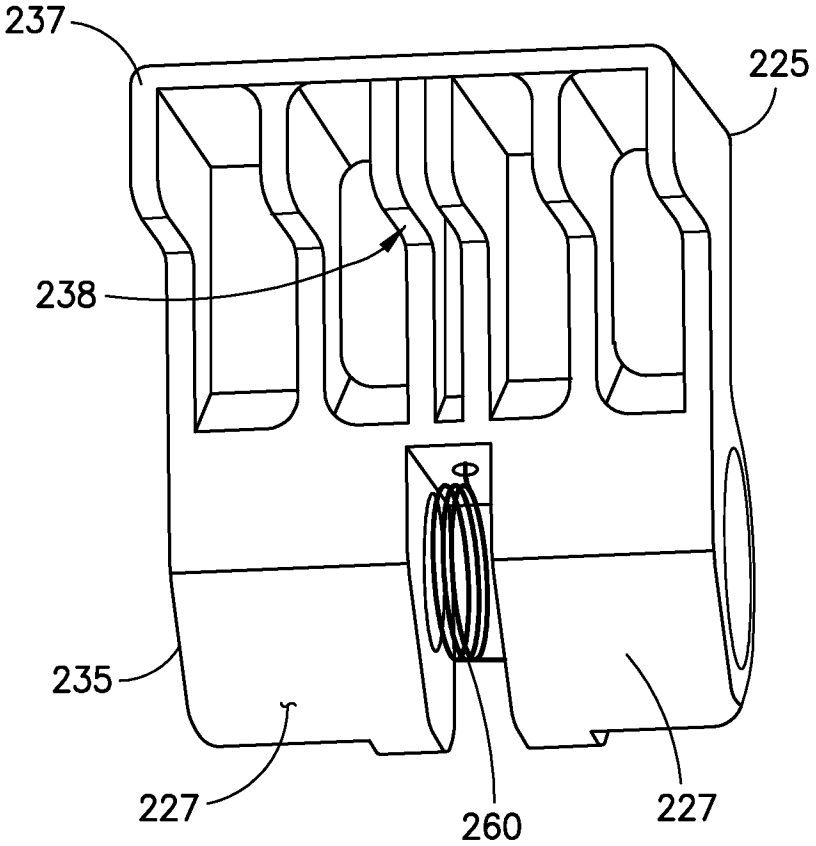
FIG. 9B is a front perspective view of a portion of the infant care apparatus of FIG. 1 and/or FIG. 2 in accordance with aspects of the disclosed embodiment.
Figure 9A:
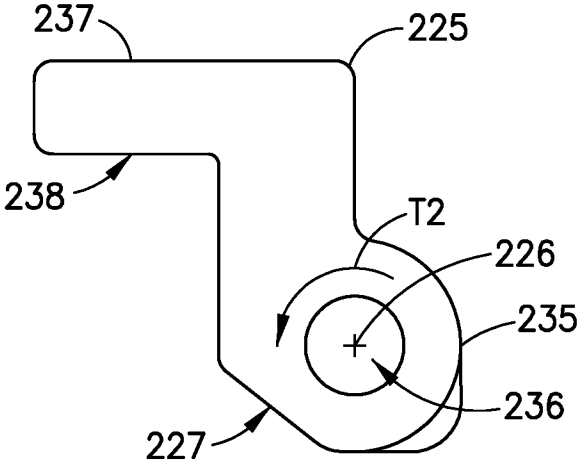
FIG. 9A is a side view of a portion of the infant care apparatus of FIG. 1 and/or FIG. 2 in accordance with aspects of the disclosed embodiment.
Figure 9C:
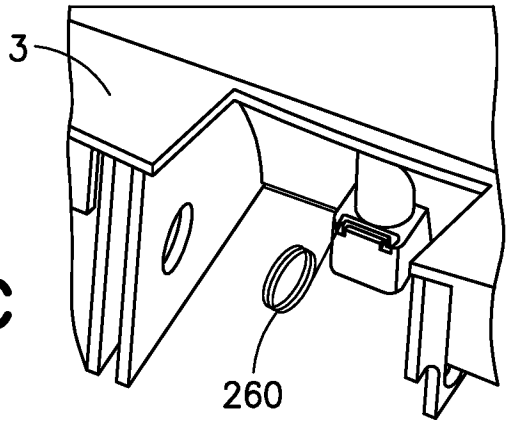
FIG. 9C is a perspective view of a portion of the infant care apparatus of FIG. 1 and/or FIG. 2 in accordance with aspects of the disclosed embodiment.

Referring to FIGS. 2, 4, 5, 6A-6F, 7, 8A-8B, and 9A-9C, the automatically actuable grip members 220, 225 each include a base 231, 235 with an aperture 232, 236, through which a respective pin 299 extends, and cam follow surfaces 222, 227. Clamp arms 233, 237 extend from the base 231, 235 and include gripping surfaces 234, 238. The automatically actuable grip members 220, 225 are coupled to a respective pin 299 so as to rotate relative to both the movable support 210, and the base 3 between the open position 230 and the closed position 240 (as seen best in FIGS. 6A-6F). In one aspect, the automatically actuable grip members 220, 225 are coupled to their respective pin 299 so as to freely rotate relative to the pin 299; while in other aspects, the automatically actuable grip members 220, 225 and the respective pin 299 may rotate as a unit relative to the slotted hole 215 and the movable support 210. The automatically actuable grip members 220, 225 are disposed with respect to the infant support 2 to effect gripping of the infant support 2 with gripping surfaces 234, 238 (FIG. 9B) when the infant support 2 is positioned on the support seat 211. The automatically actuable grip members 220, 225 actuating between the open position 230 and the closed position 240 captures and releases the mating support member 8 infant support 2. The automatically actuable grip members 220, 225 are automatically actuable between the open and closed positions 230, 240, by action of the movable support 210.

Figure 10B:
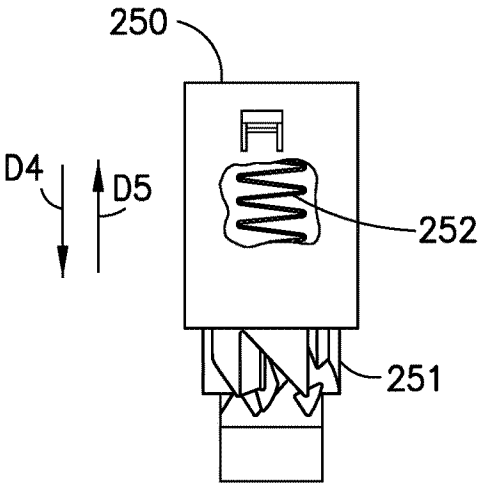
FIG. 10B is a side view of a portion of the infant care apparatus of FIG. 1 and/or FIG. 2 in accordance with aspects of the disclosed embodiment.
Figure 10C:
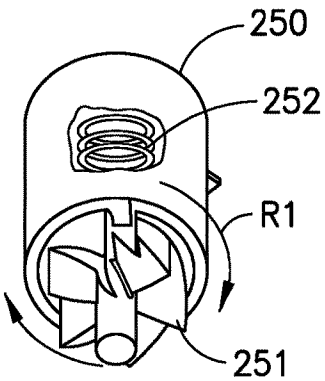
FIG. 10C is a bottom perspective view of a portion of the infant care apparatus of FIG. 1 and/or FIG. 2 in accordance with aspects of the disclosed embodiment.
Figure 10A:
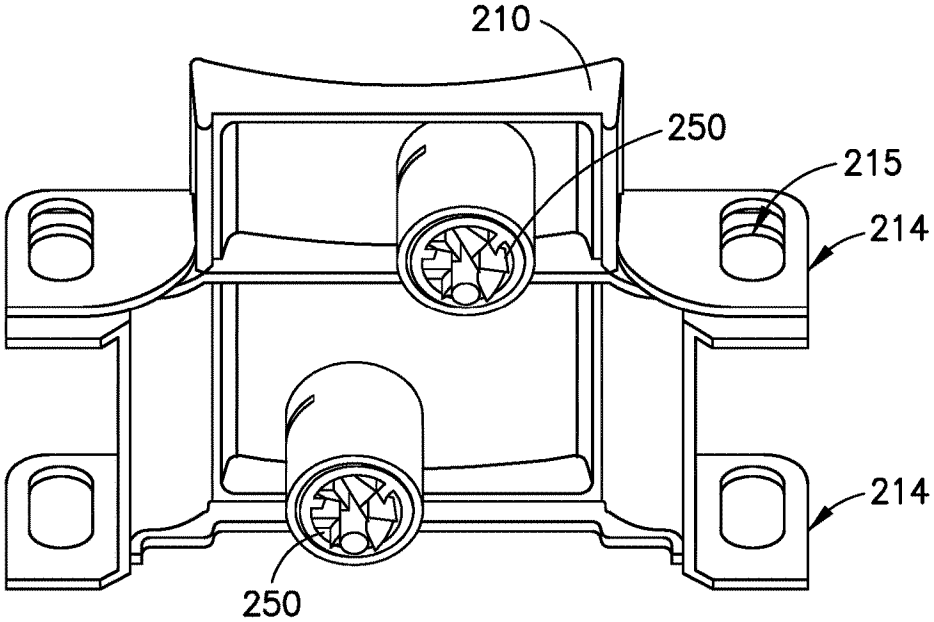
FIG. 10A is a bottom perspective view of a portion of the infant care apparatus of FIG. 1 and/or FIG. 2 in accordance with aspects of the disclosed embodiment.

For example, referring also to FIGS. 10A-10C, the infant care apparatus 1 may further include at least one toggle mechanism 250. In one aspect, the at least one toggle mechanism 250 may form an indicator to indicate the position of the movable support 210. For example, the at least one toggle mechanism 250 may emit an aural or tactile signal to indicate the position. In one aspect, the movable support 210 may be supported on at least one toggle mechanism 250 which is configured to toggle the movable support 210 between the first raised position 1150 and the second lowered position 1160. The at least one toggle mechanism 250 utilizes an angled tooth cam 251 and a spring 252 to toggle between first raised position 1150 and the second lowered position 1160. For example, when the movable support 210 is lowered in direction D4 (FIGS. 6A-6F and 10B) (such as when the infant support 2 is being coupled to the base 3), the at least one toggle mechanism 250 is compressed and the angled tooth cam 251 rotated in direction R1. In this position, the spring 252 within the at least one toggle mechanism 250 is loaded with the angled tooth cam 251 in a compressed and locked position. In this position both the at least one toggle mechanism 250 and the movable support 210 supported thereon are in the lowered state. When the movable support 210 is moved in direction D5 (FIGS. 6A-6F and 10B) again (such as when removing the infant support 2), the at least one toggle mechanism 250 is compressed which rotates the angled tooth cam 251 in direction R1 unlocking the at least one toggle mechanism 250 and allowing the spring 252 of the at least one toggle mechanism 250 to move the movable support 210 in direction D5 (FIGS. 6A-6F and 10B).

With the at least one toggle mechanism 250 (and thus the movable support 210) in the raised position 1150, the automatically actuable grip members 220, 225 are in and remain in the open position 230 through interaction between the camming mechanism 212 and the cam follower surfaces 222, 227 of the automatically actuable members 220, 225. With the grip automatically actuable grip members 220, 225 in the open position 230, the mating support member 8 of the infant support 2 is free to be removed or placed within the support seat 211 of the movable support 210 so as to mount the infant support 2 to the base 3. In order to bias the automatically actuable grip members 220, 225 in the open position 230, the cam follow surfaces 222, 227 of the automatically actuable grip members 220, 225 are configured to interface with the camming surfaces 213 of t camming mechanism 212. For example, without the infant support 2 present on the support seat 211, the movable support 210 is in the first raised position 1150 such that the camming surfaces 213 of the camming mechanism 212 are engaged with and biasing the cam follower surfaces 222, 227 of the automatically actuable grip members 220, 225 in direction T5 and direction T6, respectively, to the open position 230 against the biasing force of torsion springs 260. As the mating support member 8 of the infant support 2 is placed on the movable support 210 by a user and the movable support 210 is moved in direction D4 into the second lowered position 1160, the camming surfaces 213 of the camming mechanism 212 are disengaged from the cam follow surfaces 222, 227 (i.e., lowered such that the cam follow surfaces 222, 227 of the automatically actuable grip members 220, 225 follow or slide along the camming surfaces 213 of the camming mechanism 212 in respective direction D6 and direction D7). The torsion springs 260 of the respective automatically actuable grip members 220, 225 effects rotation of the respective automatically actuable grip members 220, 225 in respective direction T1 and direction T2. The respective torsion springs 260 biases the automatically actuable grip member 220 in direction T1 and the automatically actuable grip member 225 in direction T2 about respective pivot axes 221, 226 to place the automatically actuable grip members 220, 225 in the closed position 240.

Referring to FIGS. 4, 5, and 8A-8B in one aspect, the infant support coupling 200 includes a first recline locker 31 and a second recline locker 33 each including locking pads 35 which are configured to engage the mating support member 8 so as to lock a position of the mating support member 8 relative to the base 3 and setting the angle θ (FIG. 2). The first recline locker 31 and second recline locker 33 are substantially similar to the locking mechanism described in U.S. Pat. No. 10,231,555 previously incorporated herein by reference. The locking pads 35 may be manufactured from rubber or any other suitable material. The first recline locker 31 and the second recline locker 33 are configured to removably engage the locking pads 35 with the mating support member 8 positioned within the support seat 211 by movement of a Z-linkage (not shown). Movement of the Z-linkage causes movement of both the first recline locker 31 and the second recline locker 33 in direction D12 to lock and release the mating support member 8 relative to the base 3. For example, to lock the mating support member 8 relative to the base 3, the Z-linkage drives the first recline locker 31 in direction D9 and the second recline locker 33 in direction D8 such that the first recline locker 31 and the second recline locker 33 move toward a centerline CL of the infant support coupling 200. The mating support member 8 is released when the Z-linkage is actuated to drive the first recline locker 31 in direction D8 and the second recline locker 33 in direction D9 away from the centerline CL of the infant support coupling 200. The first recline locker 31 and the second recline locker 33 may include lock members 36 to lock the automatically actuable grip members 220, 225 in place. The lock members 36 are configured to move with the first recline locker 31 and the second recline locker 33 in direction D3. For example, when the second recline locker 33 is moved in direction D8 to lock the mating support member 8 relative to the base 3, the lock member 36 is also moved in direction D8 and positioned under the automatically actuable grip member 225. The automatically actuable grip member 225 includes a lock surface 36A (FIG. 8B) that interfaces with the lock member 36 and "locks" the automatically actuable grip member 225 (i.e., prevents rotation of the automatically actuable grip member 225). The lock members 36 are coupled to the movement linkage of the recline lockers 31, 33 so as to move between locked and unlocked positions coincident with the recline lockers 31, 33 being engaged and disengaged.

Figure 11:
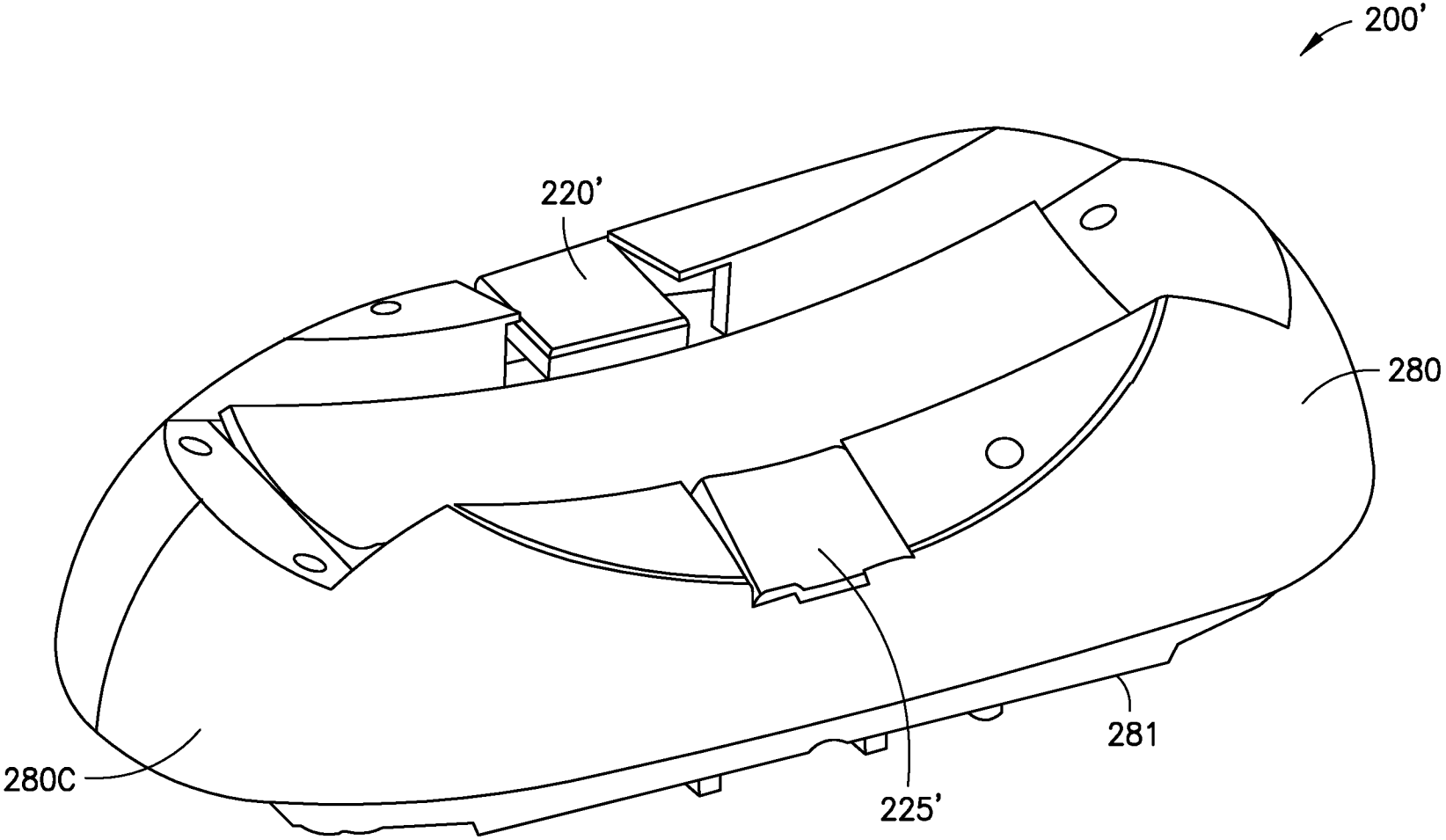
FIG. 11 is a perspective view of a portion of the infant care apparatus of FIG. 1 and/or FIG. 2 in accordance with aspects of the disclosed embodiment.
Figure 12:
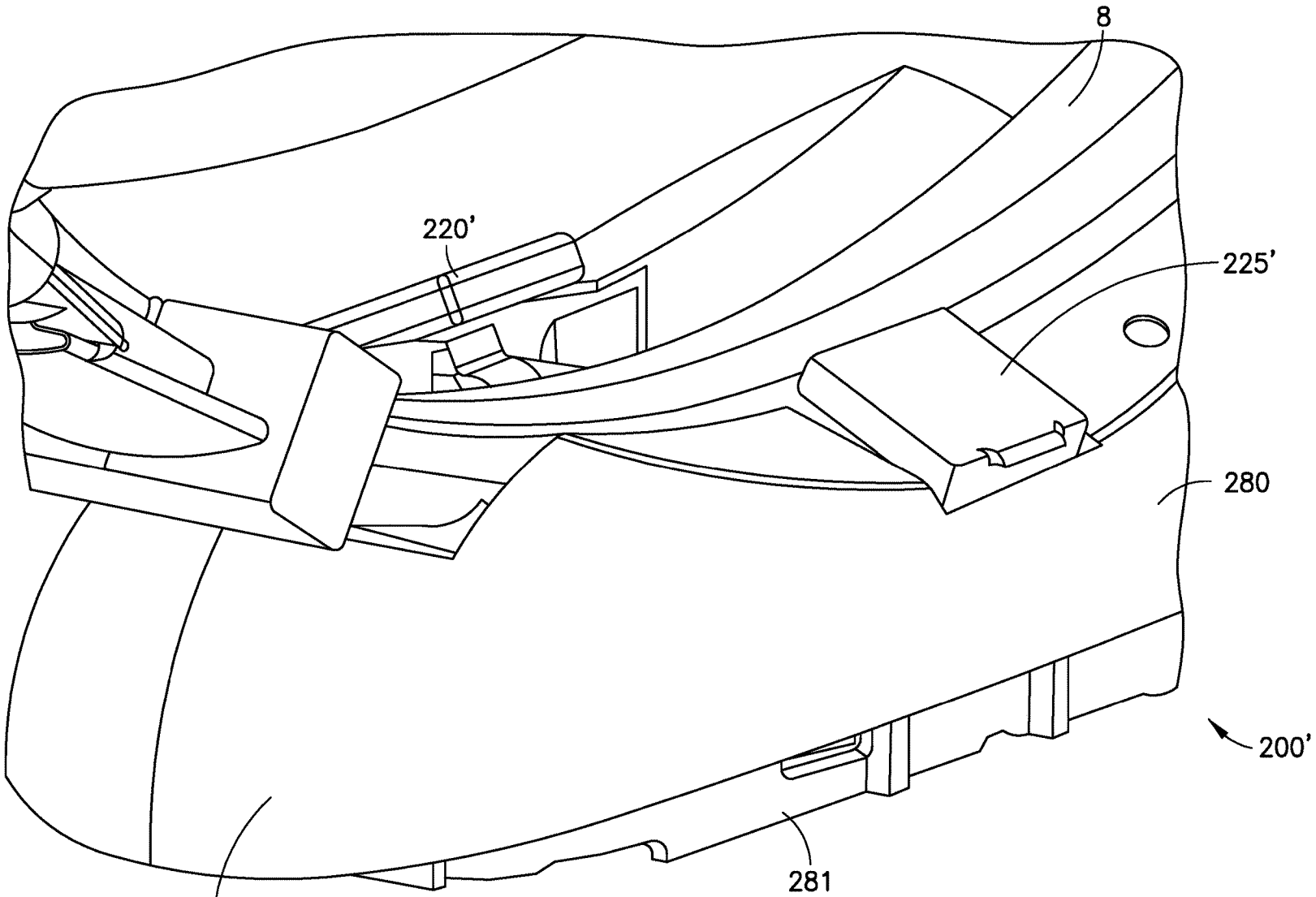
FIG. 12 is a perspective view of the portion of the infant care apparatus of FIG. 12 in accordance with aspects of the disclosed embodiment.
Figure 13:
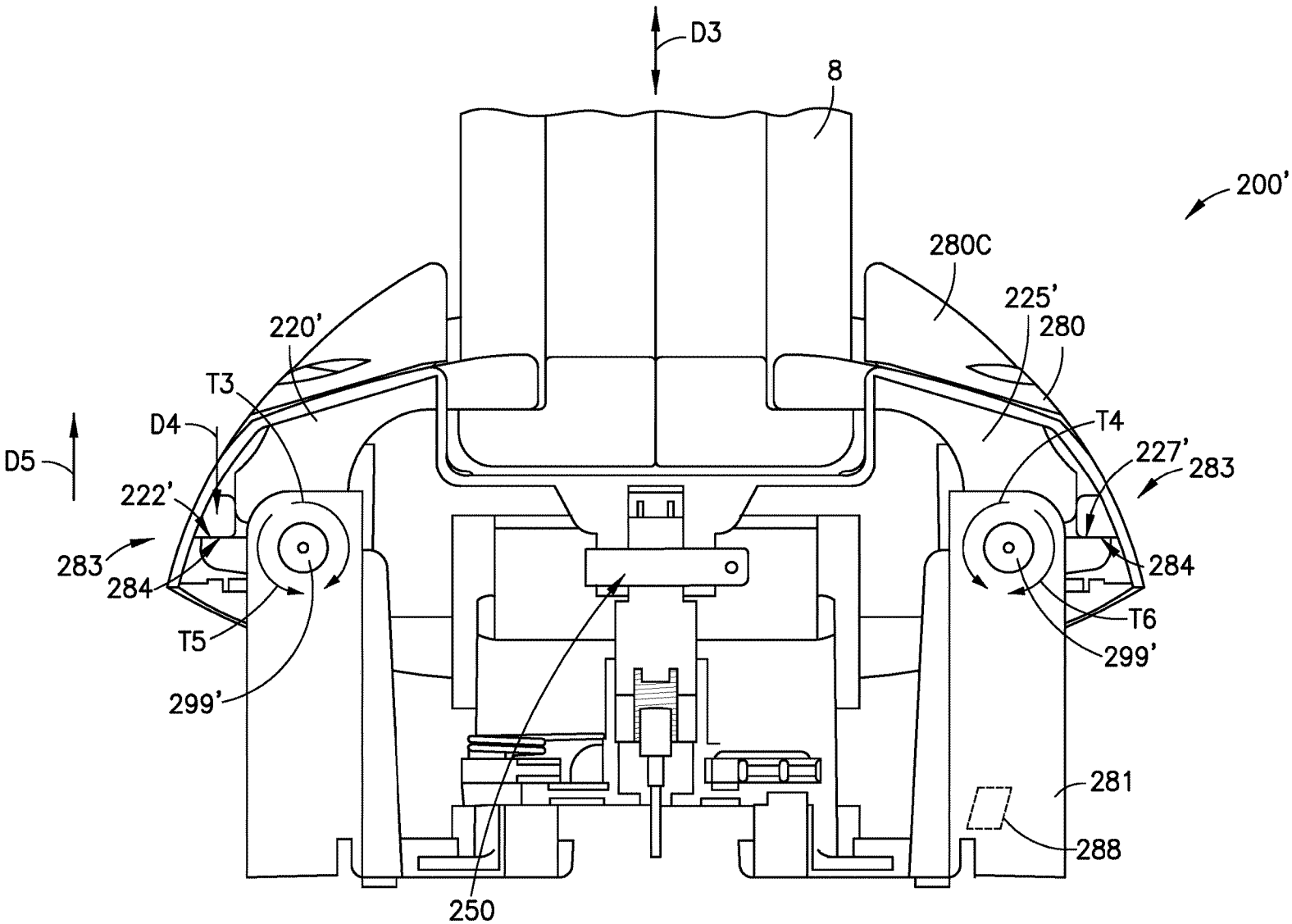
FIG. 13 is a cross-sectional view of the portion of the infant care apparatus of FIG. 12 in accordance with aspects of the disclosed embodiment.
Figure 13A:
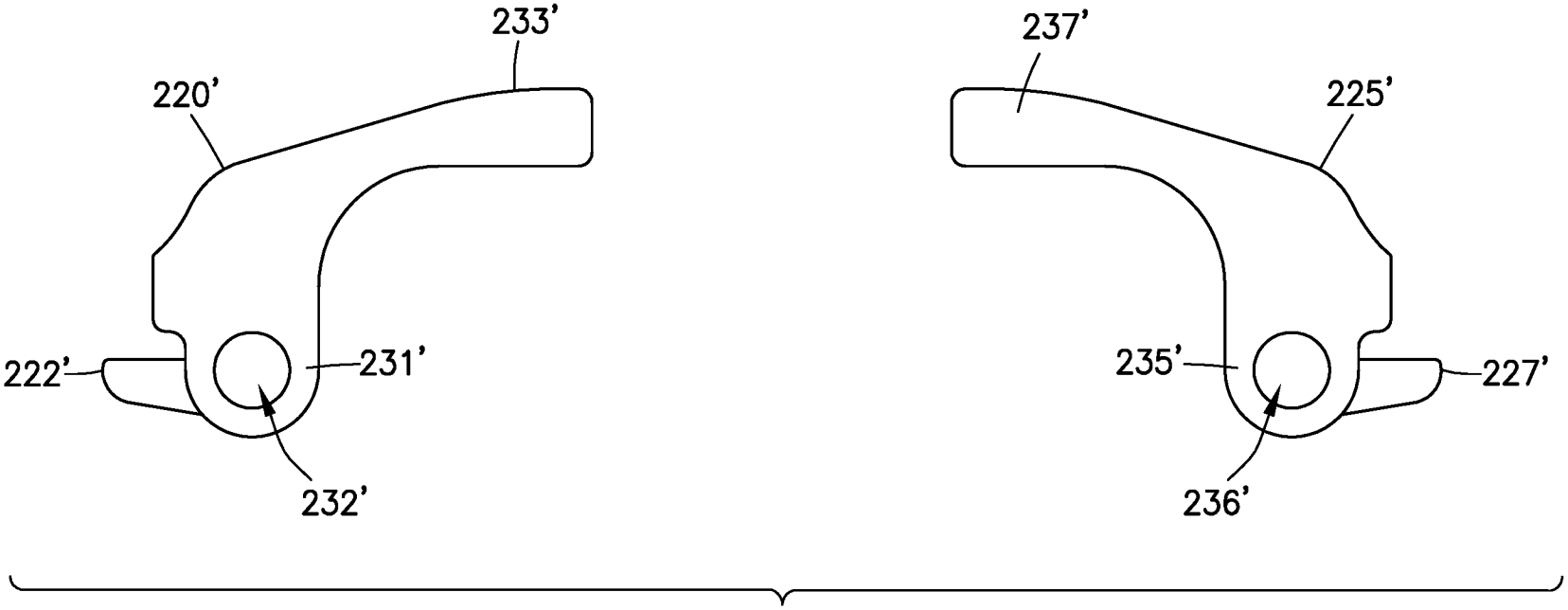
FIG. 13A is a front view of a portion of the portion of the infant care apparatus of FIG. 12 in accordance with aspects of the disclosed embodiment.

Referring now to FIGS. 11-13, infant support coupling 200' is illustrated in accordance with another aspect of the disclosed embodiment. The infant support coupling 200' is substantially similar to infant support coupling 200 unless where noted below. In this aspect, the infant support coupling 200' includes automatically actuable grip members 220', 225', and the housing cover 280C of the housing 280 acts as the movable support 210 described above. Here, the housing cover 280C is movably coupled to the base 3 in any suitable manner, such as, by the housing base 281 such that the housing cover 280C moves in direction D2 relative to the housing base 281 fixedly mounted to the base 3. It is noted that the skirt 280S is coupled to the housing base 281 independent of the housing cover 280C so that the housing cover 280C moves in direction D2 relative to the skirt 280S. The skirt 280S extends from the housing base 281 (or with respect to the infant support coupling 200') so as to circumscribe or surround at least a portion of the movable stage 10 that extends through the surface 5A. The housing cover 280C includes camming mechanism 283 with camming surfaces 284 to effect automatic actuation of the automatically actuable grip members 220', 225' as will be described below.

The automatically actuable grip members 220', 225' each include a base 231', 235' with an aperture 232', 236', through which a respective pin 299' extends, and cam followers 222', 227' extending from the base 231', 235'. Clamp arms 233', 237' extend from the base 231', 235' and include gripping surfaces 234', 238'. The automatically actuable grip members 220', 225' are coupled to the respective pins 299' so as to rotate relative to the housing cover 280C (and the base 3) between the open position 230 and the closed position 240. Here, the camming surfaces 284 of the camming mechanism 283 are engaged with and biasing the cam followers 222', 227' of the automatically actuable grip members 220', 225' in the open position 230 when the housing cover 280C is lowered in direction D4. As the mating support member 8 of the infant support 2 is placed on the movable support 210 by a user and the movable support 210 is lowered in direction D4 into the second position, the camming surfaces 284 of the camming mechanism 283 are lowered in direction D4 such that the cam followers 222', 227' of the automatically actuable grip members 220', 225' are rotated in respective directions T5 and direction T6 which forces the automatically actuable grip members 220', 225' into the open position 230. A torsion spring integrated into the automatically actuable grip members 220', 225' effects rotation of the automatically actuable grip members 220', 225' in respective direction T3 and direction T4 on the automatically actuable grip members 220', 225' to force them into the closed position 240 when the camming mechanism 283 is disengaged (i.e., the housing cover 280C is toggled into the raised position). The infant support coupling 200' may further include shock towers 288 to absorb any impacts and retain stability of the infant support coupling 200'.

Referring to FIGS. 2C, 2D, and 26A-28C, in one or more aspects as described herein, the infant seat 7 includes the articulated span member or infant support coupling 266 that is configured to couple with the infant support receiver coupling 200C. The infant support receiver coupling 200C is substantially similar to infant support coupling 200 unless noted otherwise and is configured to receive the infant support coupling 266 as described herein. Here, the infant support receiver coupling 200C includes a seating surface 2710 (FIG. 27) that is configured to receive the articulated span member 266. For example, as noted above, articulated span member 266 includes the base 2620 (which only a portion of which is illustrated in FIGS. 27A-27C) and articulating supports 2621, 2622 rotatably coupled to the base 2620. The base 2620 has a mating surface 2620B and the infant support receiver coupling 200C has a complimentary mating surface 200CS upon which the mating surface 2620B seats. Here, the complimentary mating surface 200CS is configured to locate the base 2620 in a predetermined location on the infant support receiver coupling 200C. For example, with specific reference to FIG. 28A, the complimentary mating surface 200CS includes a protrusion 2801 and the mating surface 2620B of the base 2620 includes a recess 2800, where the recess 2800 is placed over and mates with the protrusion 2801 to at least partially locate the base 2620 (and the infant seat 7) on the infant support receiver coupling 200C.

The base 2620 includes a locking post 2810 that extends from the mating surface 2620B. The complimentary mating surface 200CS of the infant support receiver coupling 200C includes an aperture 2820 that receives the locking post 2810 to at least partially locate the base 2620 (and the infant seat 7) on the infant support receiver coupling 200C. The locking post 2810 extends through the aperture 2820 to an interior of the infant support coupling where the locking post 2810 engages and disengages a movable locking arm 2830 of the infant support receiver coupling 200C. In one or more aspects, the locking post 2810 includes a groove 2840 and the locking arm 2830 includes a fork 2841 that extends into the groove 2840 when the locking arm is engaged with the locking post 2810. The fork 2841 within the groove 2840 substantially locks the base 2620 to the infant support receiver coupling 200C in the direction D28 while engagement of the locking post 2810 with the aperture 2820 substantially locks the base 2620 to the infant support receiver coupling 200C in the directions D26, D27 (see also FIG. 27C). In other aspects, the locking arm 2830, locking post 2810, and mating surfaces 2620B, 200CS may have any suitable configuration for locating and locking the base 2620 (and the infant seat 7) to the infant support receiver coupling 200C. The infant support receiver coupling 200C includes an anti-rotation surface 2710 (see FIGS. 27A-27C) that engages a side 2620A of the base 2620 so as to substantially prevent rotation of the base 2620 (and the infant seat 7) relative to the infant support receiver coupling 200C in direction D25; while in other aspects, the base 2620 and the infant support receiver coupling 200C include any suitable anti-rotation features (e.g., pins/recesses, mating grooves/protrusions, etc.) to substantially prevent rotation of the base 2620 (and the infant seat 7) relative to the infant support receiver coupling 200C in direction D25.

Figure 28A:
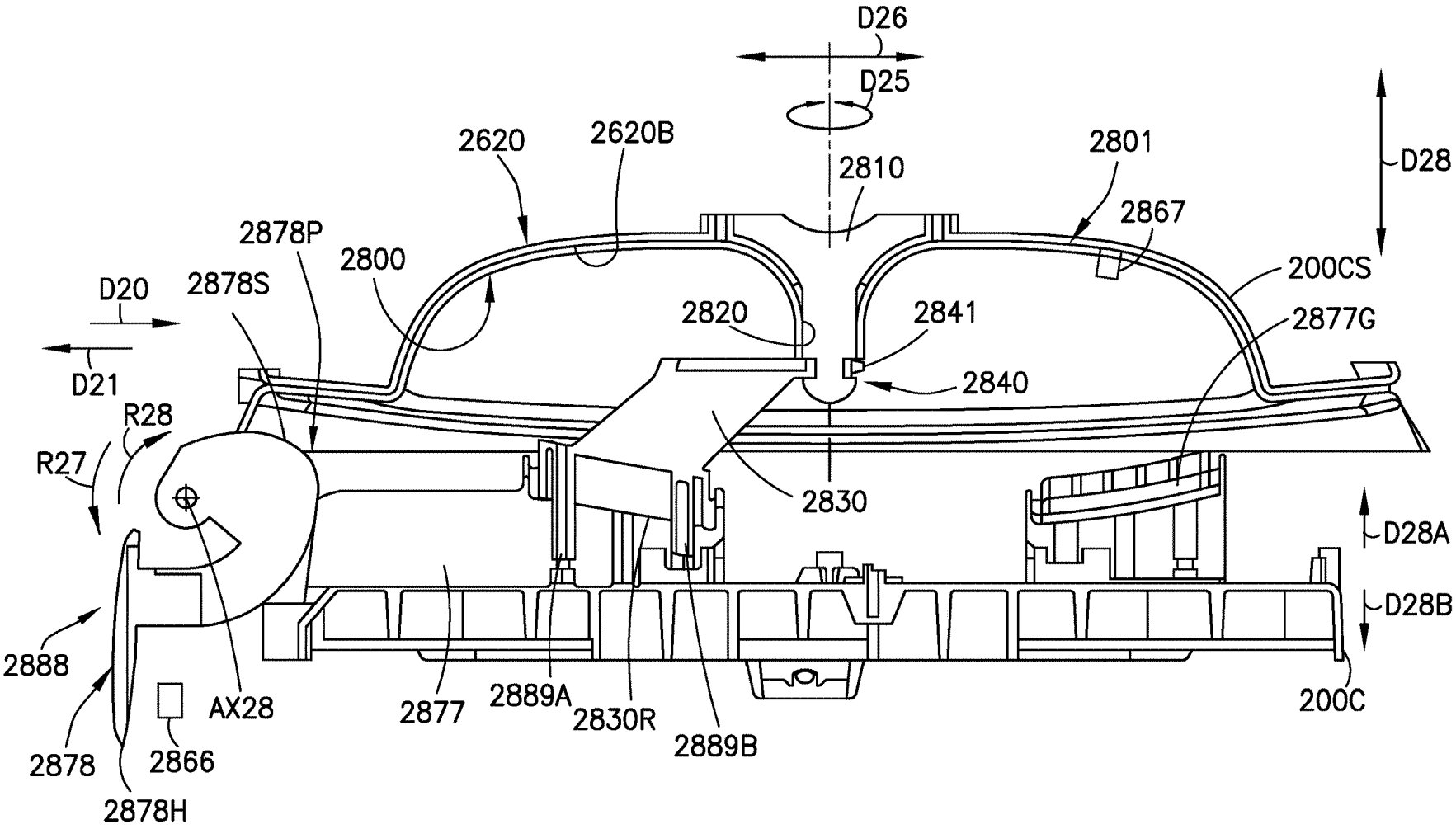
FIG. 28A is a schematic cross-sectional illustration of a portion of the infant care apparatus of FIG. 2C in accordance with aspects of the disclosed embodiment.
Figure 28B:
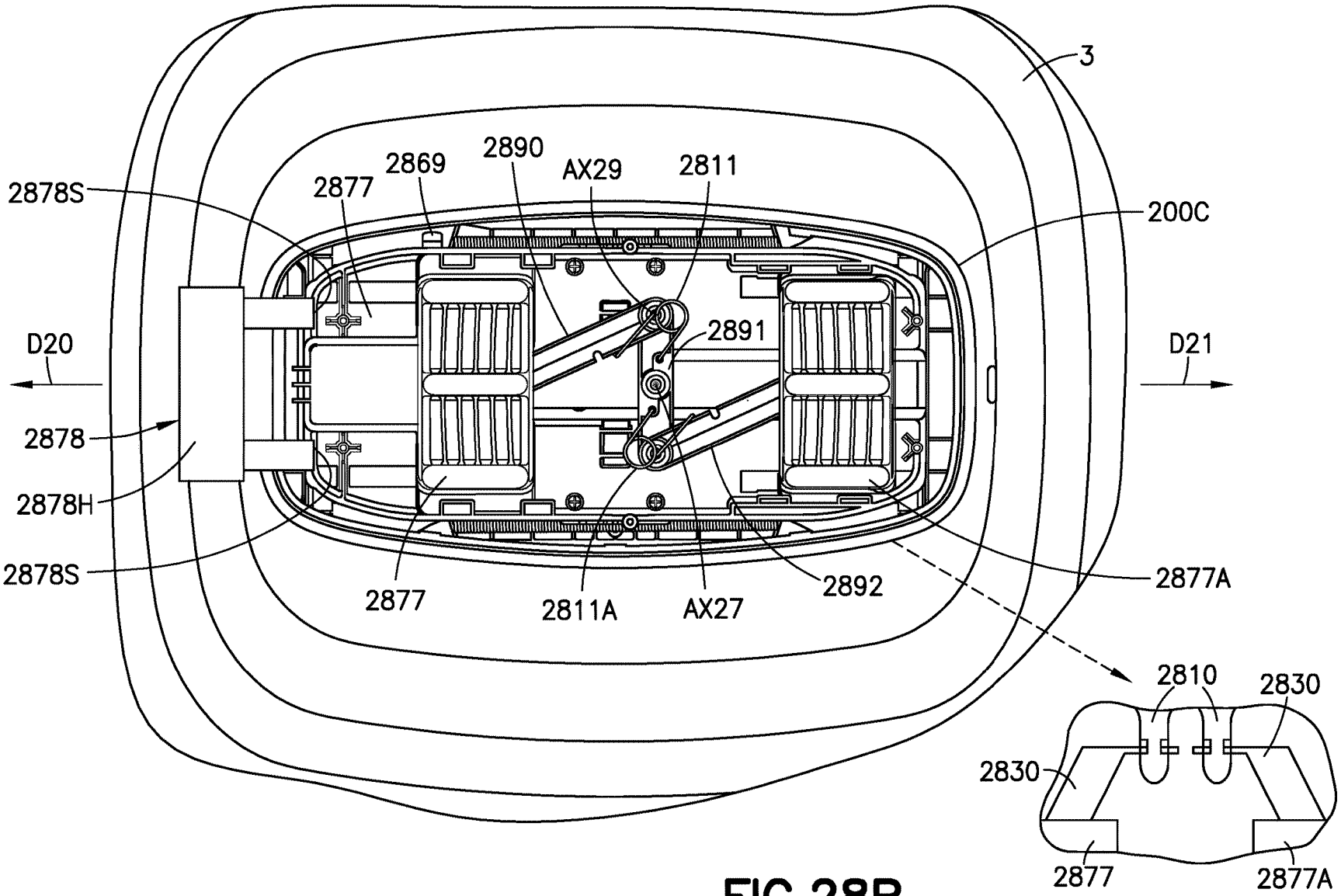
FIG. 28B is a schematic plan view of the portion of the infant care apparatus of FIG. 28A in a first orientation in accordance with aspects of the disclosed embodiment.
Figure 28C:
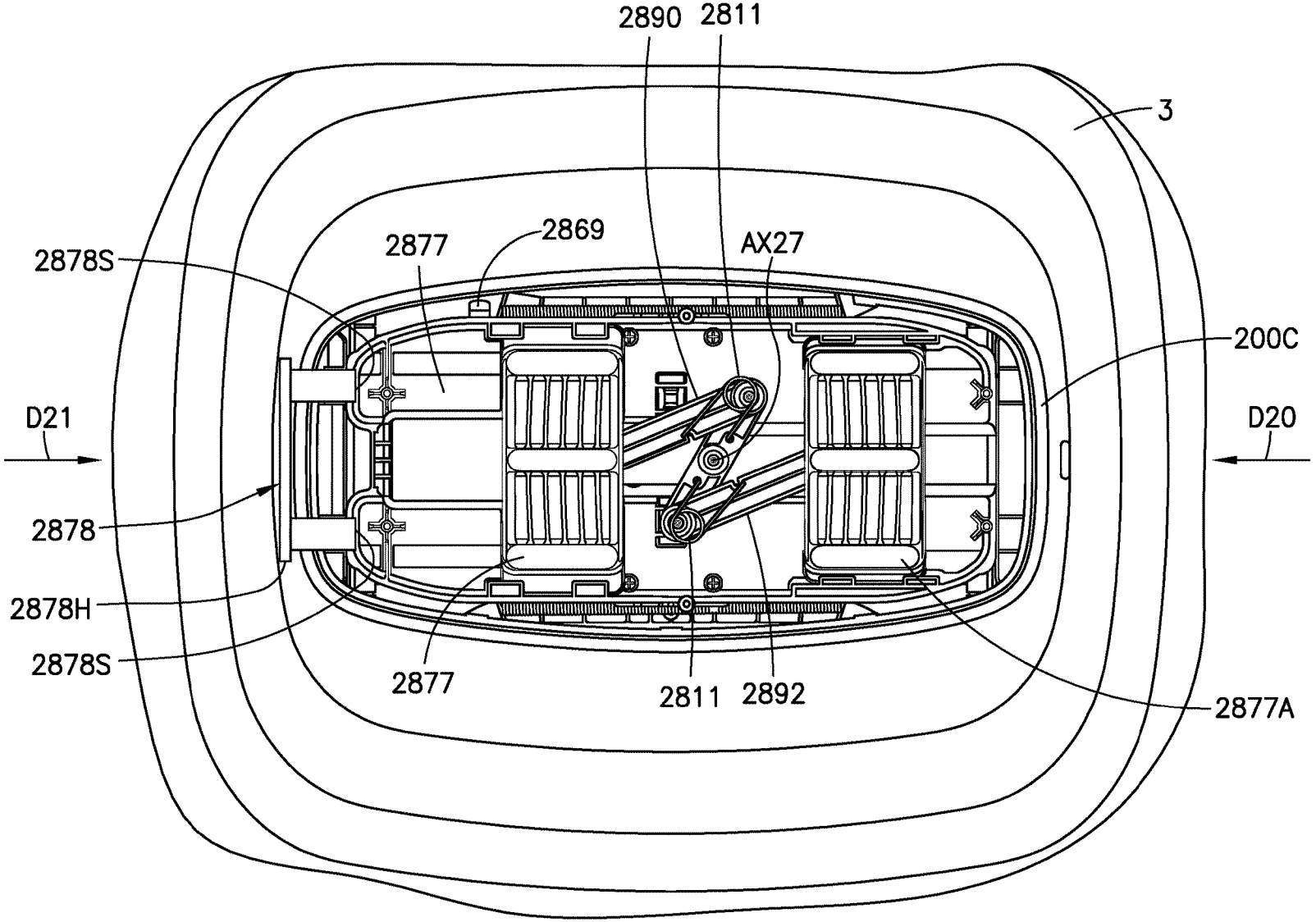
FIG. 28C is a schematic plan view of the portion of the infant care apparatus of FIG. 28A in a second orientation in accordance with aspects of the disclosed embodiment.

Still referring to FIGS. 28A-28C, as noted above the locking arm 2830 is movable so as to engage and disengage the locking post 2810. In one or more aspects the locking arm 2830 moves linearly in direction D20 to engage the locking post 2810 and linearly in direction D21 to disengage the locking post 2810; however, in other aspects the locking arm may be provided with a pivoting motion so that the fork 2841 travels along an arcuate path to engage and disengage the groove 2840 in the locking post 2810. In the example, shown in FIGS. 28A-28C, the locking arm 2830 forms part of a cam lock mechanism that includes cam lever 2878, locking arm 2830, and slide 2877. The locking arm 2830 is mounted to the slide 2877 in any suitable manner. For example, in one aspect, the locking arm 2830 is mounted to the slide 2877 so as to be slidable relative to the slide 2877. Here the slide 2877 includes a ramp surface 2877R and the locking arm 2830 includes a mating ramp surface 2830R. The coupling between the slide 2877 and the locking arm 2830 is arranged so that the locking arm 2830 is able to move relative to the slide in directions D20, D21 where the engagement between the ramped surfaces 2877R, 2830R (as the locking arm 2830 is moved in directions D20, D21 relative to the slide 2877) causes the locking arm 2830 to move in direction D28. As an example, the slide includes a guide 2877G (e.g., a rail, protrusion, or any other suitable linear guide) to which the locking arm 2830 is coupled and slides along, e.g., slides in a plane defined by the engagement between the ramp surfaces 2877R, 2830R. Here the guide 2877G provides for movement of the locking arm 2830 in directions D20, D21 relative to the slide 2877 while maintaining coupling engagement between the locking arm 2830 and the slide 2877 (i.e., the movement of the locking arm 2830 in direction D28 is a result of the ramp surfaces 2877R, 2830R and not any lifting of the locking arm 2830 from the slide 2877). Any other suitable fasteners or guide pins 2889A, 2889B may be provided for guiding movement of the locking arm 2830 relative to the slider 2877 and/or for movably coupling the locking arm 2830 to the slider 2877.

The slide 2877 is biased (such as by any suitable resilient members 2811 as such springs) in direction D21. Movement of the slide 2877 (and the locking arm 2830) is controlled by the cam lever 2878 that is pivotally coupled, about pivot axis AX28, to one or more of the housing cover 280C, skirt 280S, or any other suitable frame member of the infant support receiver coupling 200C. The cam lever 2878 includes a cam surface 2878S that is configured, in combination with the bias exerted on the slide 2877, to effect movement of the slide 2877 (and the locking arm 2830) in directions D2, D21. For example, as the cam lever 2878 is rotated about pivot axis AX28 in direction R28 (e.g., a handle 2878H of the cam lever is moved away from the housing cover 280C and/or skirt 280S) the cam surface 2878S is a lobed surface having a lobe peak 2878P (i.e., the distance between the axis AX28 and the cam surface 2878S is greatest at the peak 2878P), where the cam surface 2878S is configured to effect movement of the slide 2877, in combination with the biasing of the slide 2877, in direction D21 so that the fork 2841 disengages the groove 2840 so as to release the infant seat 7 from the base 3. For example, as the cam lever 2878 is rotated in direction R28 the lobe peak 2878P causes an initial movement of the slider 2877 in direction D20, where when engagement between the cam surface 2878S and the slider 2877 is past the lobe peak 2878P, the cam surface 2878S causes a subsequent movement of the slider in direction D21 so that the fork 2841 disengages the groove 2840. The initial movement of the slider 2877 in direction D20 causes locking arm 2830 to ride up on the ramped surface 2877R which raises the locking arm 2830 in direction D28A to assist in the release of the seat 7 through vertical disengagement of mating surfaces of the fork 2841 and groove 2840. As the cam lever 2878 is rotated about pivot axis AX28 in direction R27 (e.g., the handle 2878H of the cam lever is moved towards the housing cover 280C and/or skirt 280S) the cam surface 2878S is configured to effect movement of the slide 2877, in combination with the biasing of the slide 2877, in direction D20 so that the fork 2841 engages the groove 2840 so as to lock the infant seat 7 to the base 3. Here, as the cam lever 2878 is rotated in direction R27 the initial movement of the slider 2877 is in direction D20, where when engagement between the cam surface 2878S and the slider 2877 is past the lobe peak 2878P, the cam surface 2878S causes subsequent movement of the slider in direction D21 so that the fork 2841 engages the groove 2840. The subsequent movement of the slider 2877 in direction D21 causes locking arm 2830 to ride down on the ramped surface 2877R which lowers the locking arm 2830 in direction D28B to assist in the locking of the seat 7 through vertical engagement of mating surfaces of the fork 2841 and groove 2840. In other aspects, the locking arm 2830 may not move in the direction D28.

As described above, the bias on the slide 2878 is provided by resilient member 2811 illustrated in FIGS. 28B and 28C. In the example illustrated in FIGS. 28B and 28C the resilient member 2811 is a torsion spring that is configured so that the bias of the torsion spring tends to straighten torsion links 2890, 2891 relative to one another (i.e., resist bending of torsion links relative to each other about pivot axis AX29). Here, one end of the torsion link 2890 is pivotally coupled to the slide 2877 while the other end of the torsion link 2890 is pivotally coupled to one end of torsion link 2891 about pivot axis AX29. The other end of torsion link 2891 is pivotally coupled to the housing cover 280C, skirt 280S, or any other suitable frame member of the infant support receiver coupling 200C about axis AX27. As the cam lever is rotated in direction R28, the bias of the resilient member 2811 on the torsion links 2890, 2891 pushes the slide 2877 in direction D20 against the cam surface 2878S (causing the torsion links 2890, 2891 to unfold relative to each other) so that the locking arm 2830 disengages the locking post 2810. As the cam lever is rotated in direction R27, the cam surface 2878 pushes the slide 2877 in direction D21 against the bias of the resilient member 2811 on the torsion links 2890, 2891 (causing the torsion links 2890, 2891 to fold relative to each other) so that the locking arm 2830 engages the locking post 2810.

It is noted that while a single locking arm 2830 and locking post 2810 are illustrated in FIG. 28A, in other aspects, any suitable number of locking arms and locking posts may be provided. For example, as illustrated in FIGS. 28B and 28C, the infant support receiver coupling 200C can include more than one slider 2877, 2877A where more than one locking arm (substantially similar to locking arm 2830) can be mounted to each slider 2877, 2877A. Here, another torsion member 2892 is pivotally coupled at one end to torsion member 2891 and pivotally coupled at the other end to slider 2877A. Another resilient member 2811A (substantially similar to resilient member 2811) is provided to bias torsion member 2892 relative to torsion member 2891 in a manner substantially similar to that described above. In this aspect, as the cam lever 2878 is rotated in direction R28, slider 2877 moves in direction D20 while slider 2877A moves in direction D21 so that the sliders move in opposite directions away from each other to provide an opposing release movement of the respective locking arms from the respective locking posts (e.g., locking arms on slider 2877A oppose the locking arms on slider 2877—see FIG. 28B). As the cam lever 2878 is rotated in direction R27, slider 2877 moves in direction D21 while slider 2877A moves in direction D20 so that the sliders move in opposite directions towards each other to provide an opposing locking movement of the respective locking arms to the respective locking posts.

Referring now to FIGS. 2E and 14-19, in one aspect, the infant care apparatus 1 may include a drive mechanism 60 coupled to the base 3, a vibratory mechanism 90, 90A, a movable stage 10 movably mounted to the base 3, and a control system 50 (including controller 51) communicably coupled to each of the drive mechanism 60 and the vibratory mechanism 90, 90A. In one aspect, the movable stage 10 includes a first (here rigid) platform 70 and a support platform 99. A lifting motion assembly 65, here, e.g., a double scissor mechanism 94 having a first scissor mechanism 95 operatively coupled to a second scissor mechanism 97 though any other lifting motion assembly may be provided (see FIG. 15), movably joins the support platform 99 and the first platform 70. The support platform 99 is configured for coupling with the housing base 281 and/or substantially directly to the infant support coupling 200 in any suitable manner, such as, with mechanical fasteners, chemical fasteners, or a combination thereof. A suitable example of the double scissor mechanism 94 can be found in U.S. Pat. No. 10,231,555 previously incorporated herein by reference. The first platform 70 includes at least one wheel 76 suitably disposed thereon such that the first platform 70 is rollingly supported by the at least one wheel 76. Rails 78 are fixably attached to the bottom support housing 4 of the base 3. The rails 78 are configured to receive and support the at least one wheel 76 of the first platform 70 so that the movable stage 10 is configured to reciprocate along the rails 78 in a first direction D1 (such as a horizontal direction). In one aspect, the at least one wheel 76 may be a flanged wheel 77, the flange of which rides along the respective rail 78 within a corresponding groove of the rail 78 so as to linearly guide the movable stage 10 along the rails 78. In one aspect, the movable stage 10 may reciprocate along the rails 78 about three inches, while in other aspects, the movable stage 10 may reciprocate along the rails 78 any suitable distance such as more or less than about 3 inches.

Figure 18:
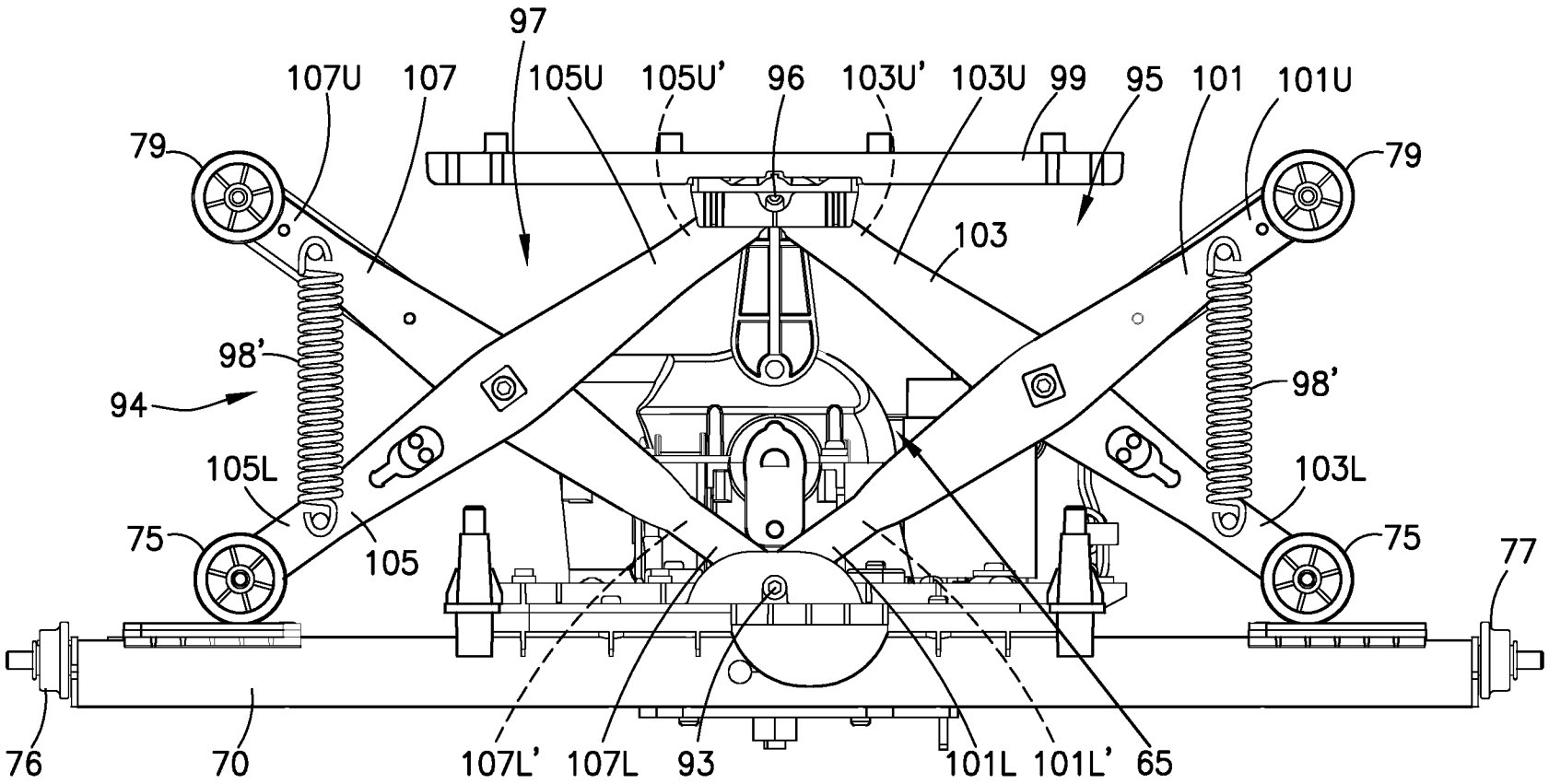
FIG. 18 is a front view of the portion of the infant care apparatus of FIG. 15 in accordance with aspects of the disclosed embodiment.
Figure 19:
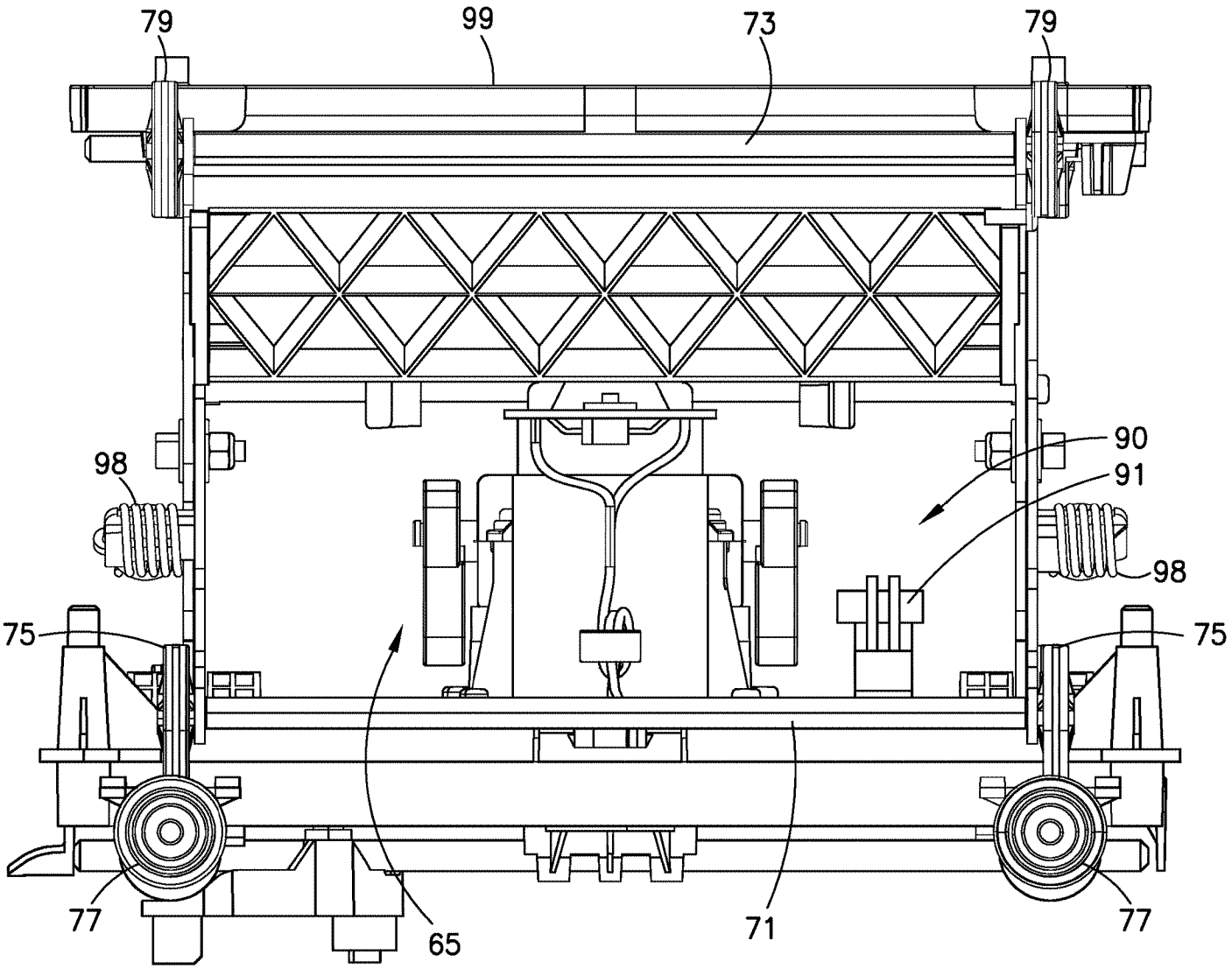
FIG. 19 is a side view of the portion of the infant care apparatus of FIG. 15 in accordance with aspects of the disclosed embodiment.

The lifting motion assembly 65 (here the first scissor mechanism 95 and the second scissor mechanism 97) is attached between the first platform 70 and the support platform 99 so as to couple the first platform 70 to the support platform 99. Here, the first scissor mechanism 95 includes a first pair of spaced-apart parallel members 101, 101' and a second pair of spaced-apart parallel members 103, 103'. The second scissor mechanism 97 includes a third pair of spaced-apart parallel members 105, 105' and a fourth pair of spaced-apart parallel members 107, 107'. Lower ends 101L, 101L' of the first pair of spaced-apart parallel members 101, 101' and lower ends 107L, 107L' of the fourth pair of spaced-apart parallel members 107, 107' are rotatably pinned to each other and to the first platform 70 about axis 93 (FIG. 18). Likewise, upper ends 103U, 103U' of the second pair of spaced-apart parallel members 103, 103', and upper ends 105U, 105U' of the third pair of spaced-apart parallel members 105, 105' are rotatably pinned to each other and to the support platform 99 about axis 96 (FIG. 18).

The first pair of spaced-apart parallel members 101, 101' are pivotally secured at a central portion thereof to the second pair of spaced-apart parallel members 103, 103' via horizontal pivot pins, or the like. Correspondingly, the third pair of spaced-apart parallel members 105, 105' are pivotally secured at a respective central portion to the fourth pair of spaced-apart parallel members 107, 107' via horizontal pivot pins, or the like. When the support platform 99 is displaced, e.g., in a second direction D2 (such as a vertical direction), as will be described in greater detail hereinafter, the first scissor mechanism 95 and the second scissor mechanism 97 move in a crossed fashion relative to the pivot pins such that the double scissor mechanism 94 extends between the first platform 70 and the upwardly displaced support platform 99. While the lifting motion assembly 65 connected to the movable stage 10 has been illustrated and described herein as including a double scissor mechanism 94, the movable stage 10, in other aspects, may have any suitable configuration for providing a reciprocating movement in the second direction D2.

Still referring to FIGS. 14-19, in one aspect, another motion assembly 61 (lateral) is operably connected to the movable stage 10. A suitable example includes first and second horizontal bars 71, 72 are provided, where the first horizontal bar 71 extends transversely between the lower ends 103L, 103L' of the second pair of spaced-apart parallel members 103, 103', and the second horizontal bar 72 extends between the lower ends 105L, 105L' of the third pair of spaced-apart parallel members 105, 105' to provide structural stability. In addition, the first and second horizontal bars 71, 72 may further include bearing wheels 75 at their ends that interface with travel surfaces 87 of the first platform 70 of the movable stage 10 for supporting the double scissor mechanism 94 and the support platform 99. Third and fourth horizontal bars 73, 74 are provided, where the third horizontal bar 73 extends transversely between the upper ends 101U, 101U' of the first pair of spaced-apart parallel members 101, 101', and the fourth horizontal bar 74 extends between the upper ends 107U, 107U' of the fourth pair of spaced-apart parallel members 107, 107'. The third and fourth horizontal bars 73, 74 may include bearing wheels 79 at their ends for engaging and supporting the infant support 2 coupled to the infant support coupling 200 (described above). In another aspect, the support platform 99 may be extended so that the bearing wheels 79 engage and support on the support platform 99 as illustrated in phantom in FIG. 18.

In one aspect, the movable stage 10 may be provided with at least one resilient element 98, such as a tension spring, fixably attached between two or more of the pair of spaced-apart parallel members 101, 101' 103, 103' 105, 105' 107, 107'. The resistive mechanical element (s) 98 may be provided and configured so as to assist a lifting motion assembly 65 (described below) in extending or retracting the double scissor mechanism 94 in the second direction D2. For example, the resistive mechanical element (s) 98 may be coupled to the lower end 103L, 103L' of second pair of spaced-apart parallel members 103, 103' and the lower end 105L, 105L' of the third pair of spaced-apart parallel members 105, 105' (FIGS. 14-16. In this configuration, the resilient element 98 applies a tension force to the second pair of spaced-apart parallel members 103, 103' and the third pair of spaced-apart parallel members 105, 105' and pulls the relevant portions toward each other, assisting, e.g., upward vertical motion of the lifting motion assembly 65. In another example, resilient element 98' (FIG. 18) may be a compression spring positioned so as to apply an expansion force to the double scissor mechanism 94 pushing the relevant portions apart, assisting, e.g., upward vertical motion of the lifting motion assembly 65. The positions of the resilient element 98, 98' described above are not to be construed as limiting as the exact location of the attachment of the resilient element 98, 98' to the double scissor mechanism 94 and can be varied with similar results. The resilient element 98, 98' also has the benefit of counteracting or increasing the effects of gravity by acting to reduce or increase downward movement, respectively.

Referring to 20-22, FIGS. and with continuing reference to FIGS. 14-19, as noted above, the infant care apparatus 1 includes the drive mechanism 60 coupled to and supported by the bottom support housing 4 of the base 3. The drive mechanism 60 includes the lateral motion assembly 61 imparting a first cyclic motion in a first direction D1 to the movable stage 10 (e.g., providing lateral motion) and the lifting motion assembly 65 imparting a second cyclic motion in a second direction D2 to the movable stage 10 (e.g., providing lifting motion) as noted. As may be realized, the respective first and second cyclic motions imparted by the corresponding motion assemblies 61, 65 are directed in orthogonal directions and are thus kinematically independent relative to each other.

The lateral motion assembly 61 includes a driving portion with a first motor 62 having a drive shaft 63 and being dependent from the base 3, and a slide crank assembly 80 mounted to the bottom support housing 4 of the base 3. The first motor 62 is configured to impart the first cyclic motion in the first direction D1 to the movable stage 10. The slide crank assembly 80 includes a gearing assembly 86 having a set of first gears 81 operatively coupled to the drive shaft 63 of the first motor 62 and a second gear 82 operatively coupled to the set of first gears 81. A crank member 83, having a first end 84 and a second end 85, couples the second gear 82 to the first platform 70 to impart the first cyclic motion provided by the first motor 62 on the first platform 70 of the movable stage 10. For example, the first end 84 of the crank member 83 may be rotationally coupled to a point on the outer circumference of the second gear 82, and the second end 85 of the crank member 83 may be rotationally coupled to the first platform 70.

In operation, actuation of the first motor 62 causes rotation of the first gears 81 which in turn causes rotation of the second gear 82. The rotation of the second gear 82 drives the crank member 83 coupled to the outer circumference of the second gear 82. As the first end 84 of the crank member 83 rotates about the second gear 82, the first platform 70 is pushed and pulled by the second end 85 of the crank member 83 in the first direction D1. This operation effects reciprocation of the driven portion of the motion assembly 61 joined to and thus imparting lateral motion to the movable stage 10 in the first direction along, e.g., the rails 78. Accordingly, the lateral motion assembly 61 is configured such that a single motor (i.e., the first motor 62) moves the first platform 70 in the first direction (e.g., horizontally) with the first motor 62 only running in a single direction, thereby eliminating backlash in the system. The system for controlling the lateral motion assembly 61 to achieve the desired motion profile will be discussed in greater detail hereinafter.

Still referring to FIGS. 14-22, the lifting motion assembly 65 is disposed on the first platform 70 of the movable stage 10 and is configured to impart the second cyclic motion to at least part of the movable stage 10 in the second direction D2 independent of the first cyclic motion in the first direction imparted by the lateral motion assembly 61. The lifting motion assembly 65 includes a second motor 66 separate and distinct from the first motor 62, disposed on the first platform 70. The second motor 66 includes a drive shaft 67 operatively coupled to a worm gear drive assembly 120. The worm gear drive assembly 120 converts rotation of the drive shaft 67 to rotational movement of an output member 121 that is perpendicular to the rotation of the drive shaft 67. A vertical yoke 122 is rotatably attached at a first end 123 thereof to the output member 121 in a manner such that the vertical yoke 122 vertically reciprocates an attachment member 125 attached to a second end 124 of the vertical yoke 122 along direction D2 shown in FIG. 21. The attachment member 125 is configured to couple to and drive/support the support platform 99 (along with the wheels 79). Accordingly, the lifting motion assembly 65 is configured such that a single motor (i.e., the second motor 66) moves the support platform 99 in the second direction D2 (e.g., vertically) with the second motor 66 only running in a single direction, thereby eliminating backlash in the system. The system for controlling the lifting motion assembly 65 to achieve the desired motion profile will be discussed in greater detail hereinafter. It is noted that motion assist provided by the resilient element 98, 98' may provide for the employment of smaller torque motors compared to when the resilient element 98, 98' is omitted.

Since the lateral motion assembly 61 and the lifting motion assembly 65 each respectively include the first motor 62 and the second motor 66, separate and distinct from one another, the lateral motion assembly 61 can be controlled independently of the lifting motion assembly 65. Independently controlling the first motor 62 and the second motor 66 allows for a variety of variable motion profiles to be selected that include cyclic motion in the first direction, the second direction, or both.

Referring also to FIG. 23A-23E, the control system 50 is configured so as to effect movement of the drive mechanism 60 in at least one motion profile, such as, pre-programmed selectably variable motion profiles Car Ride 201, Kangaroo 202, Ocean Wave 204, Tree Swing 206, and Rock-A-Bye 208, as examples. These selectably variable motion profiles are obtained by independently controlling the horizontal movement provided by the lateral motion assembly 61 and the vertical movement provided by the lifting motion assembly 65 and then coordinating the horizontal and vertical movements to obtain visually distinctive motion profiles. However, these motion profiles are for exemplary purposes only and are not to be construed as limiting as any motion profile including horizontal and/or vertical motions may be utilized. In one aspect, the different selectably variable motion profiles are deterministically defined by a selectably variable velocity characteristic of at least one of the first and second cyclic motions respectively of the first and second motion assemblies 61, 65, and a selectably variable velocity characteristic of at least one of the first and second cyclic motions respectively of the first and second motion assemblies 61, 65. In one aspect, the selectably variable velocity characteristic of at least one of the first and second cyclic motions respectively of the first and second motion assemblies 61, 65, and the selectably variable velocity characteristic of at least one of the first and second cyclic motions respectively of the first and second motion assemblies 61, 65 are selected with the controller 51 from a common selection input to the control system 50.

Referring again to FIGS. 2E and 14-22, in one aspect, the vibratory mechanism 90 is connected to the base 3 and arranged so as to cooperate with the drive mechanism 60. In another aspect, the vibratory mechanism 90, 90A is coupled to the movable stage 10 or any other suitable portion of the infant care apparatus 1, such as to the infant seat 7 as shown in FIG. 2E. In FIG. 2E the vibratory mechanism 90A is integral to one or more of the lower connector 14 and the upper connector 13. The vibratory mechanism 90A is substantially similar to vibratory mechanism 90; however, the vibratory mechanism 90A is coupled to the infant seat 7. In one aspect, the vibratory mechanism 90A includes controls that are separate and distinct from the controller 51. For example, the vibratory mechanism 90A includes any suitable switch 247 (e.g., similar to those switches described herein) that turns the vibratory mechanism 90A on and off. The switch 247, upon repeated presses/touches is also configured to cycle through different modes/patterns of vibration. In other aspects, the vibratory mechanism 90A (with or without the switch 247) is remotely coupled to the controller 51 through suitable wired or wireless connections so that the vibratory mechanism 90A is controlled through, for example, the control panel 52. Where a wired coupling is employed to couple the vibratory mechanism 90A to the controller 51, any suitable electrical couplings 248 are provided on the articulated span member 266 and base 3 that couple to each other (e.g., to provide communication between the vibratory mechanism 90A and the controller 51) when the infant seat 7 is coupled to the base 3 and decouple from each other when the infant seat 7 is decoupled from the base 3.

In the aspects shown in FIGS. 14-22 the vibratory mechanism is mounted to the first platform 70 and positioned to reduce vibratory impulse imparted to the motors 62, 66 of the motion assemblies 61, 65. The vibratory mechanism 90 includes a vibration motor 91 separate and distinct from the first and second motors of the drive mechanism 60. The vibration motor 91 is configured so as to vibrate the movable stage 10. The vibration motor may be any suitable vibration mechanism, such as, a motor with an eccentric weight on the output shaft that rotates about the output shaft to effect vibration. In other aspects, the vibration motor may be any suitable oscillating linear motor or rotary motor. The vibration motor 91 effects vibration in different patterns and intensity so as to form vibration modes which may be selectably imparted on the movable stage 10 as will be discussed in greater detail hereinafter. In one aspect, the vibration profile is superposed over the cyclic motion of the first and/or second motion assembly 61, 65. The vibration profile may be superposed over the lateral motion assembly 61 independent of the lifting motion assembly 65. The vibration profile may be superposed over the lifting motion assembly 65 independent of the lateral motion assembly 61. For example, the vibratory mechanism 90 may be mounted to any stage of the movable stage 10, e.g., to the first platform 70 and/or the support platform 99, to effect a desired vibration superposition. Alternatively, the vibratory mechanism 90 may be mounted to any of the respective driven portions of the lateral motion assembly and/or lifting motion assembly. The stage of the motion assembly to which the vibratory mechanism 90 is attached may be selected freely from concern regarding coupling effecting respective reciprocal motions generated by the corresponding motion assemblies 61, 65.

With reference to FIGS. 1, 14-22, and 24, the control system 50 may be mounted in the base 3 and provided to effect the different selectably variable motion profiles imparted, by the drive mechanism 60, on the movable stage 10 and to effect, via the vibratory mechanism 90, the various vibration modes for each of the different variable motion profiles. The control system 50 may include any suitable controller 51, such as a microprocessor, a rheostat, a potentiometer, or any other suitable control mechanism to control movement of the drive mechanism 60. As noted above, the controller 51 is communicably coupled to the drive mechanism 60 and the vibratory mechanism 90 (and in one or more aspects coupled to vibratory mechanism 90A). The controller 51 is configured so as to effect movement of the infant support 2 in the selectably variable motion profiles with selectable vibration modes selected, with the controller, from different selectably variable motion profiles and selectably different vibration modes for each of the different selectable variable motion profiles.

The control system 50 may further include a control panel 52 for viewing and controlling speed and motion of the drive mechanism 60, one or more control switches or knobs 54 for causing actuation of the drive mechanism 60, and a variety of inputs and outputs operatively coupled to the controller 51. For example, the control system 50 may include a horizontal encoder 130 (FIG. 20) coupled to an output shaft 131 of the first motor 62. The horizontal encoder 130 may include an infrared (IR) sensor 132 and a disk 133 with a single hole or slot 134 positioned thereon (see FIG. 20). The horizontal encoder 130 is configured so that the controller 51 may determine the speed and number of revolutions of the first motor 62. A vertical encoder 135 (FIG. 22) may be provided and coupled to a back shaft 136 of the second motor 66. The vertical encoder 135 may include an IR sensor 137 and a disk 138 with a single hole or slot 139 positioned thereon (see FIG. 22). The vertical encoder 135 is configured so that the controller 51 may determine the speed and number of revolutions of the second motor 66. Position of the vibratory mechanism 90 may be selected as previously described so as to avoid generating noise to the position signal of the encoders 130, 135

In addition, while the horizontal encoder 130 and the vertical encoder 135 were described hereinabove, this is not to be construed as limiting as magnetic encoders, as other types of encoders well known in the art may also be used. It may also be desirable to provide an arrangement in which two or more control switches associated with respective motors are required to both be actuated to effect speed control in the desired direction. Furthermore, while it was described that the horizontal encoder 130 and the vertical encoder 135 only include a single slot, this is not to be construed as limiting as encoders with a plurality of slots may be utilized.

In one aspect, the control system 50 may further include horizontal and vertical limit switches 165, 167 (FIG. 14) to provide inputs to the controller 51. For example, the horizontal and vertical limit switches 165, 167 may be configured to indicate to the controller 51 that the first platform 70 or the support platform 99 has reached an end point of travel. The vertical limit switch 167 may be configured to indicate when the support platform 99 is at a lowest and/or highest vertical position relative to the base 3. The horizontal limit switch 165 may be configured to indicate when the first platform 70 is at a point farthest from a center position, relative to the base 3, to the right and/or left. The horizontal and vertical limit switches 165, 167 are configured so that the control system 50 may determine an initial position of the lateral motion assembly 61 the lifting motion assembly 65 and to adjust the drive mechanism 60 accordingly. In one aspect, the limit switches 165, 167 may be optical switches or any other suitable switches. Position of the vibratory mechanism may be selected as previously described so as to avoid generating noise to the position signal of the limit switches 165, 167 (prevents errors overdriving motors).

Figure 2F:
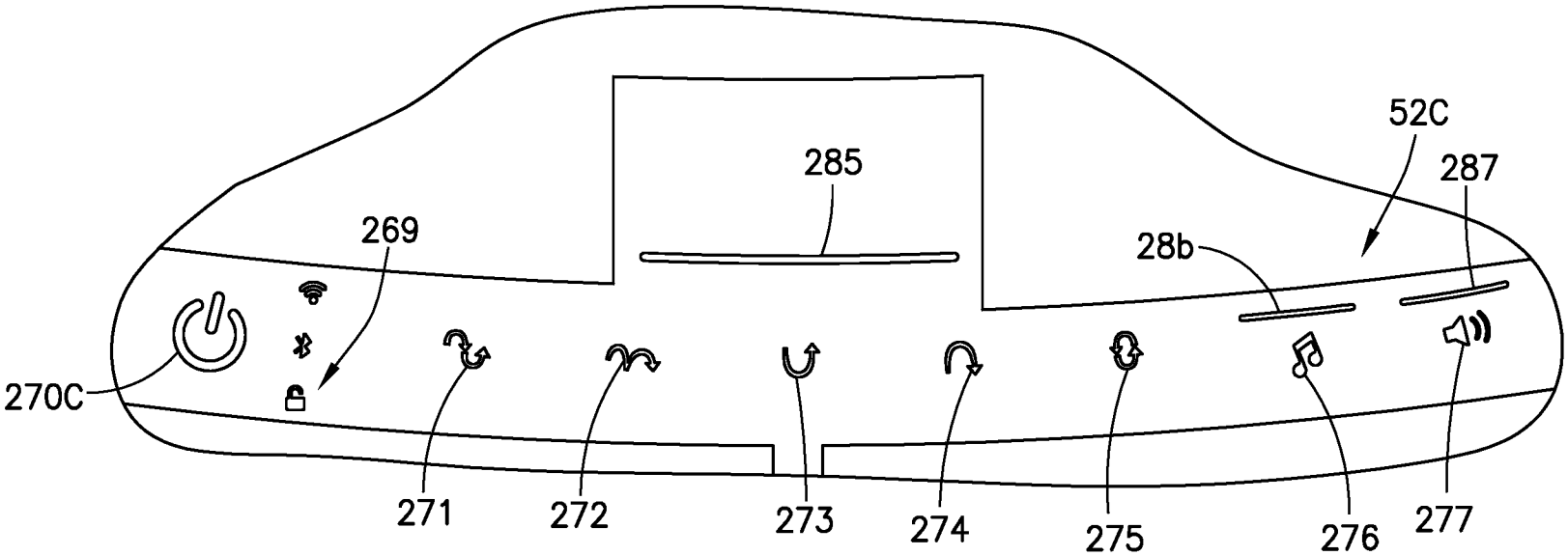
FIG. 2F is a schematic illustration of a portion of the infant care apparatus of FIGS. 2B and 2C in accordance with aspects of the disclosed embodiment.

The control panel 52 may also have display 53 to provide information to the user, such as, for example, motion profiles, volume of music being played through speakers 56, and speed of the reciprocation motion, etc. In one aspect, the control panel 52 may be a touch screen control panel, a capacitive control panel 52C (see FIG. 2F), or any suitable user interface configured to receive the common selection input from a user for selecting the different selectably variable motion profiles. Control switches 54 (which may be capacitive switches 270-277, areas of a touch screen, toggle switches, buttons, etc.) may include user input switches such as a main power, a start/stop button 270, a motion increment button 278U, a motion decrement button 278D, a speed increment button 2790, a speed decrement button 279D, and the like. FIGS. 2B, 2C, and 2F illustrate aspects of the infant care apparatus 1 including an exemplary capacitive control panel 52C that includes a power switch 270C, motion switches 271-275 (which correspond to the exemplary motion profiles described below), a sound on/off switch 276, and a volume switch 277; however, it should be realized that in other aspects the capacitive control panel 52C may include any suitable function switches such as those noted above. The control panel 52, 52C can also include any suitable status lights/indicia 285-287 that are configured to indicate a status of the child care apparatus 1. For example, light 285 is configured to indicate a power status (i.e., on/off) of the child care apparatus 1. The light 286 is configured to indicate whether the sound is on or off and the light 287 is configured to indicate a volume level of the sound. The control panel 52, 52C can also include any other suitable lights indicia as noted herein. The controller 51 of the control system 50 may also include a variety of outputs. These outputs include, but are not limited to a Pulse Width Modulation (PWM) for the first motor 62, a PWM for the second motor 66, a display backlight.

The following explanation provides an understanding of an exemplary control system 50 of the infant care apparatus 1. Based on the physical limitations of the first motor 62 and the second motor 66 of the lateral motion assembly 61 and the lifting motion assembly 65, the maximum speed of the first motor 62 may be about a four second period and the maximum speed of the second motor 66 may be about a two second period. Based on these constraints, the following relationships may be established:

TABLE 1

| | Car Ride | Kangaroo | Tree Swing | Rock-a-Bye | Ocean Wave |
|---|---|---|---|---|---|
| Number of Vertical Cycles per Horizontal Cycle (n) | 2 | 4 | 2 | 2 | 1 |
| Phase offset (Φ) | 90 degrees | 0 degrees | 180 degrees | 0 degrees | 90 degrees |
| Horizontal period at min speed | 8 seconds | 12 seconds | 8 seconds | 8 seconds | 8 seconds |
| Horizontal speed at max speed | 4 seconds | 8 seconds | 4 seconds | 4 seconds | 4 seconds |

The speed of the first motor 62 is independently set to a period and a feedback control loop is used to ensure that the first motor 62 remains at a constant speed despite the dynamics of the components of the infant care apparatus 1. As mentioned above, the output of the control system 50 is a PWM signal for the first motor 62. One possible input for the control system is velocity of the first motor 62, which can be observed from the speed of the first motor 62 as observed by the horizontal encoder 130. However, in order to avoid computationally expensive calculations, it is possible to operate in the frequency domain and use the number of processor ticks between ticks of the horizontal encoder 130 as the input variable. This allows the calculations of the controller 51 to be limited to integers rather than manipulating floats. The vibratory mechanism 90 generates vibrations in different modes which are superposed over each variable selectable motion profile controlled as noted.

The physical drive mechanism of the lateral motion assembly 61 is the slide crank assembly 80 which is configured so that the first motor 62 reciprocates the first platform 70 back and forth without the need to change directions. Since the first motor 62 is only required to run in one direction, the effect of backlash is eliminated in the system, thereby removing problems with the horizontal encoder 130 on the back shaft 131 of the first motor 62.

It is known that the natural soothing motions a person uses to calm a baby are a combination of at least two motions that each move in a reciprocating motion that has a smooth acceleration and deceleration such that the extremes of the motion slow to a stop before reversing the motion and are fastest in the middle of the motion. This motion is the same as that generated from a sinusoidal motion generated from the combination of the slide crank assembly 80 and the worm gear drive assembly 120. The slide crank assembly 80 and the worm gear drive assembly 120 are configured so that the driving motors run at a constant rotational speed while the output motion provided to the infant seat 7 slows and speeds up, mimicking the motion of a person soothing a child. These assemblies also configured such that the driving motors run in one direction.

Figure 14:
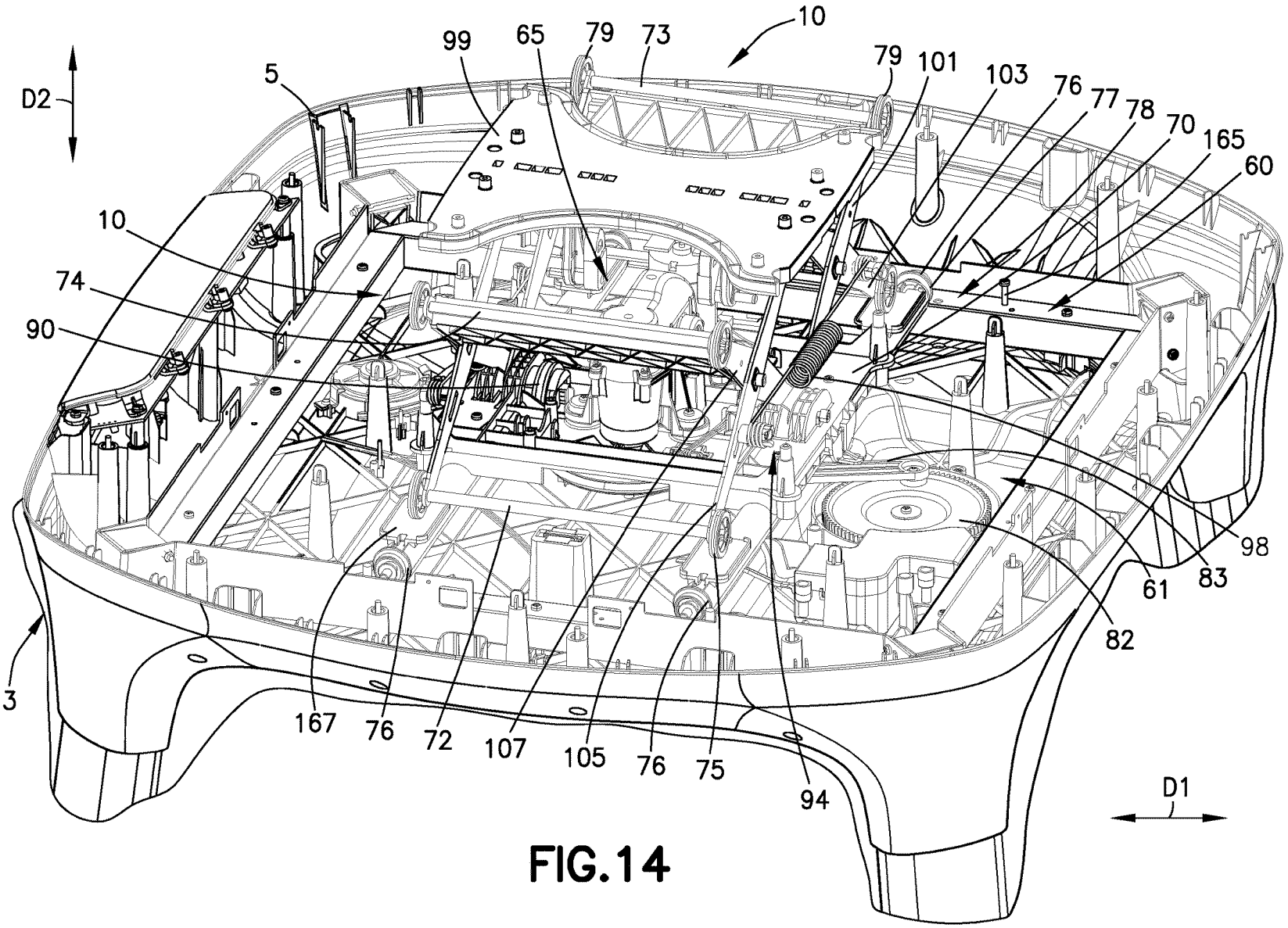
FIG. 14 is a perspective view of a portion of the infant care apparatus of FIG. 1 and/or FIG. 2 in accordance with aspects of the disclosed embodiment.
Figure 15:
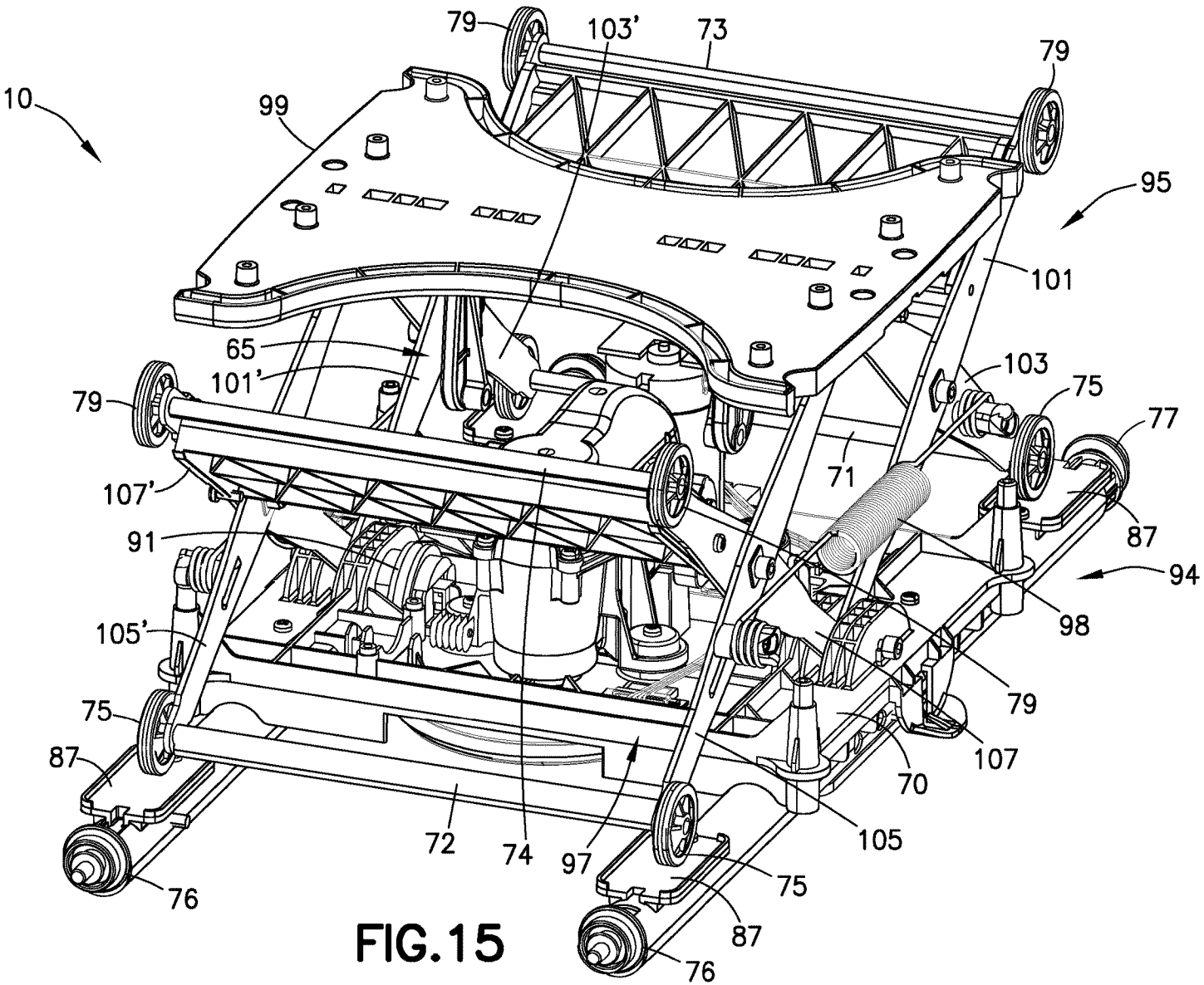
FIG. 15 is a perspective view of a portion of the portion of the infant care apparatus of FIG. 14 in accordance with aspects of the disclosed embodiment.
Figure 16:
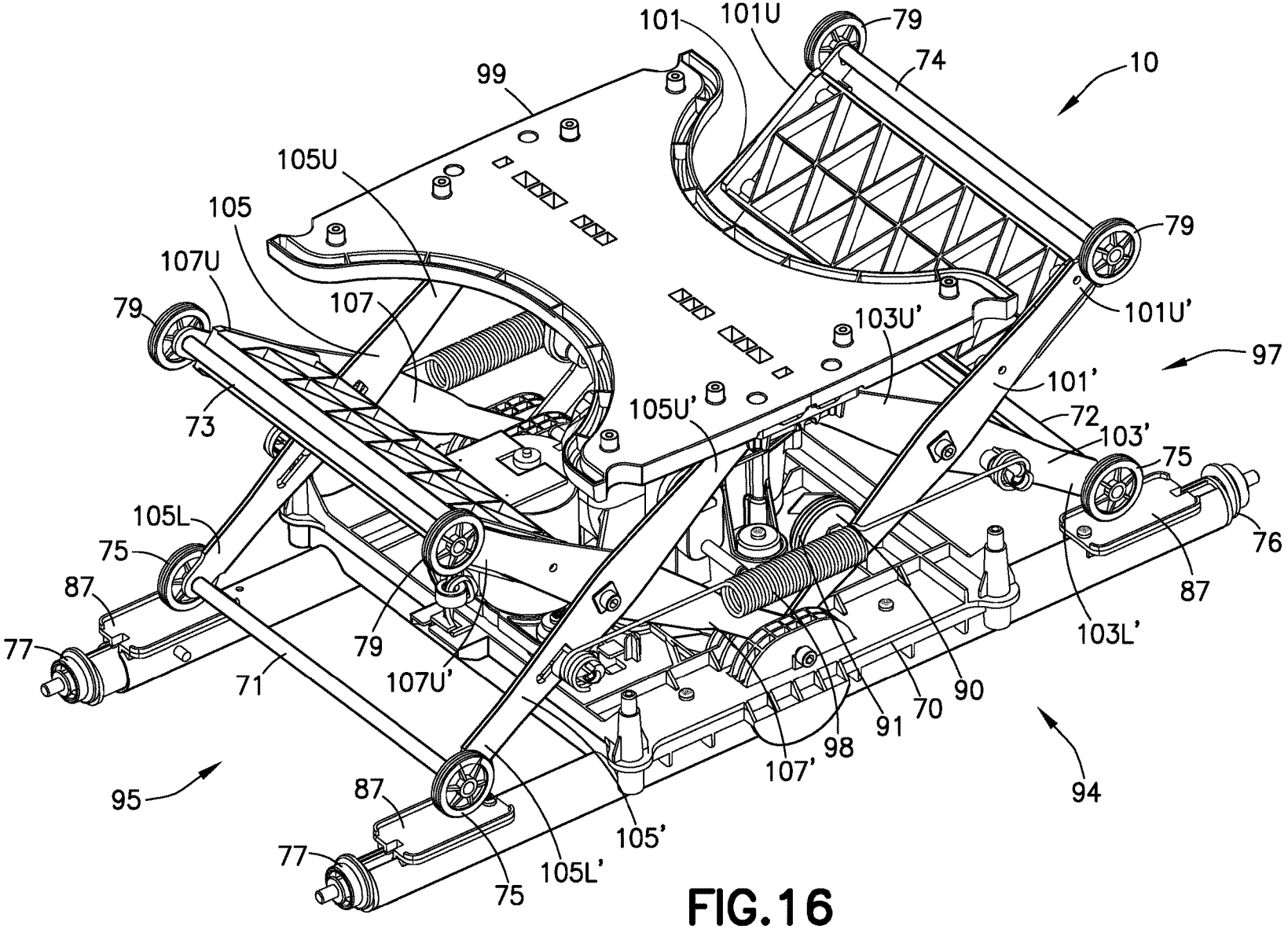
FIG. 16 is a perspective view of the portion of the infant care apparatus of FIG. 15 in accordance with aspects of the disclosed embodiment.
Figure 17:
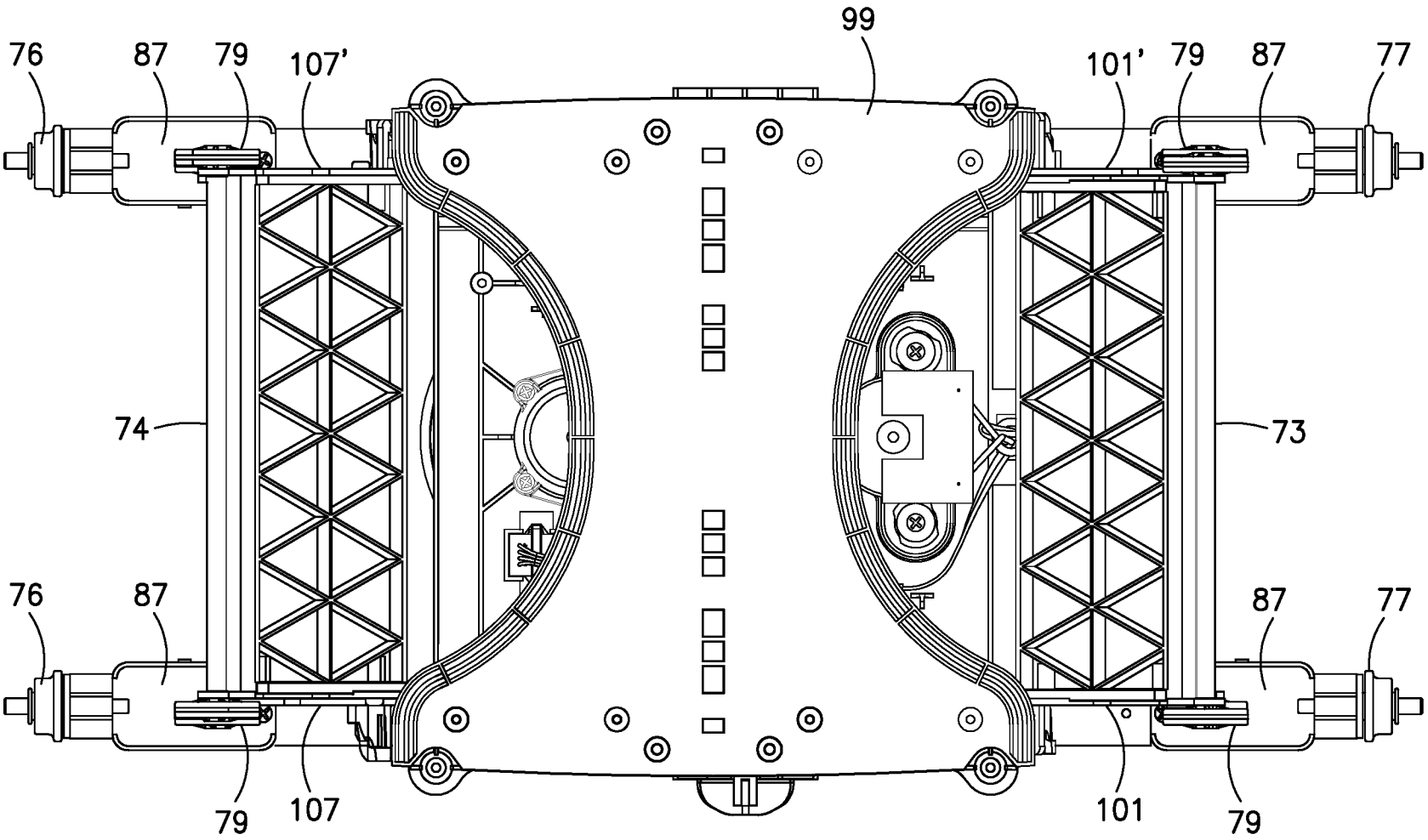
FIG. 17 is a top view of the portion of the infant care apparatus of FIG. 15 in accordance with aspects of the disclosed embodiment.
Figure 20:
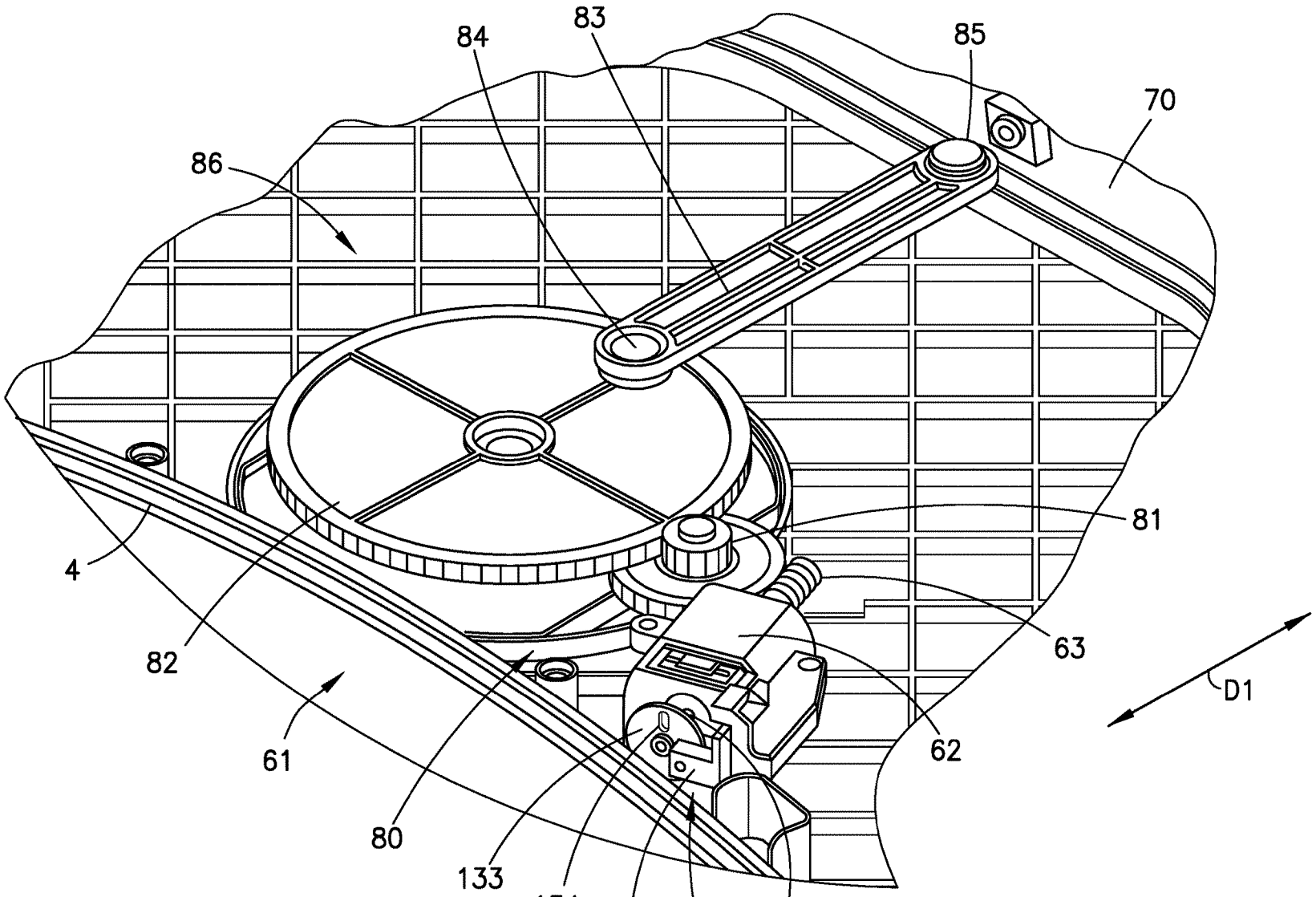
FIG. 20 is a partial perspective view of the portion of the infant care apparatus of FIG. 14 in accordance with aspects of the disclosed embodiment.
Figure 21:
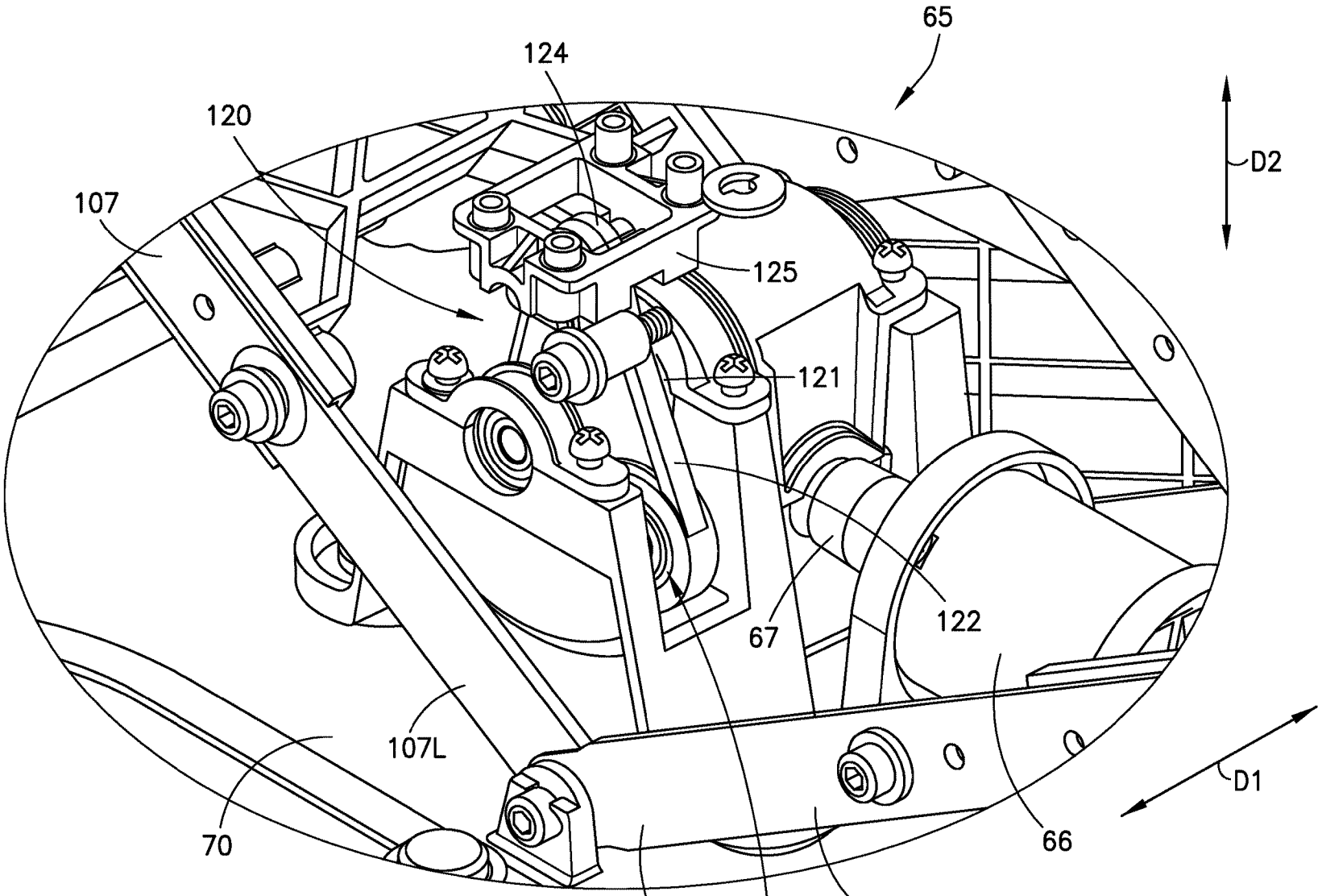
FIG. 21 is a partial perspective view of the portion of the infant care apparatus of FIG. 14 in accordance with aspects of the disclosed embodiment.
Figure 22:
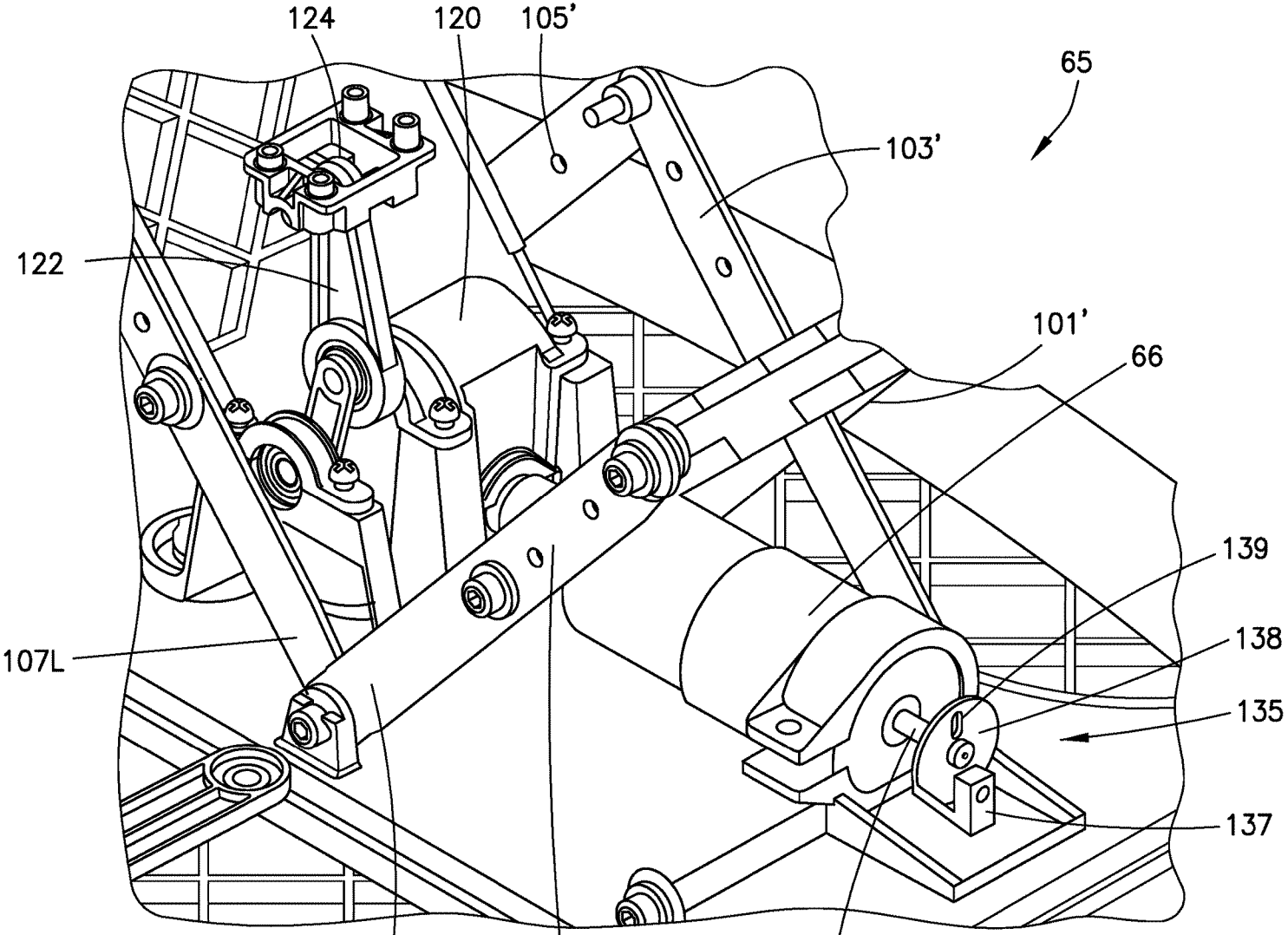
FIG. 22 is a partial perspective view of the portion of the infant care apparatus of FIG. 14 in accordance with aspects of the disclosed embodiment.
Figure 23A:
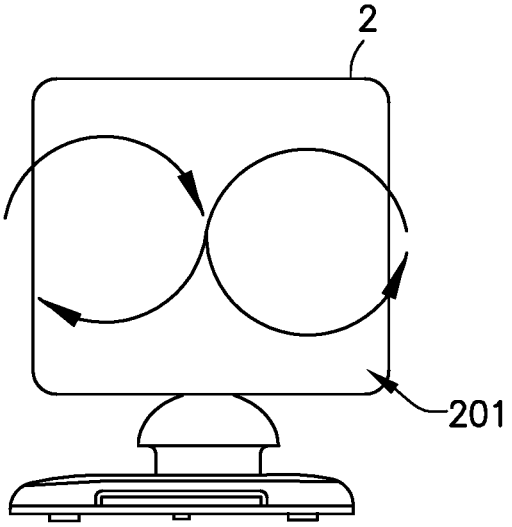
FIGS. 23A-23E are illustrative diagrams of representative motion profiles in accordance with aspects of the disclosed embodiment.
Figure 23B:
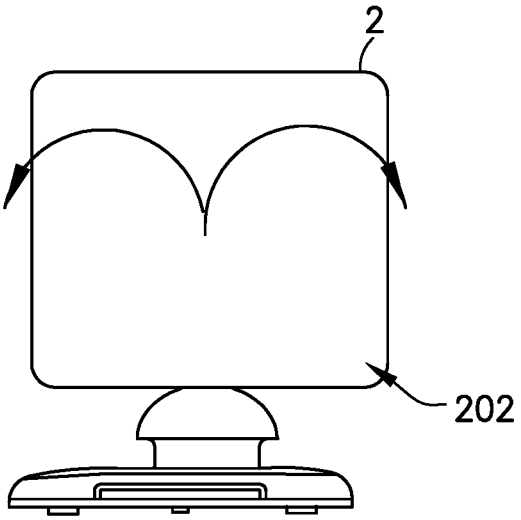
Figure 23C:
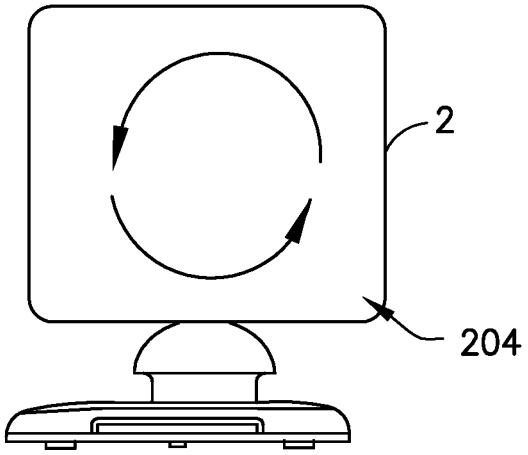
Figure 23D:
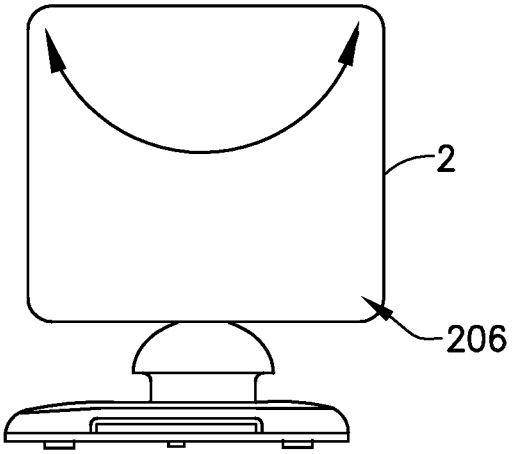
Figure 23E:
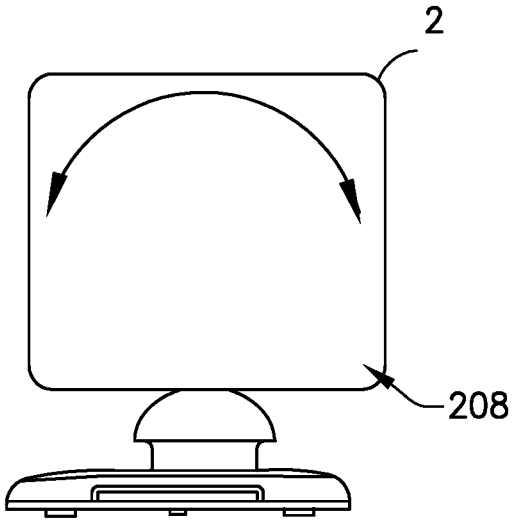
Figure 24:
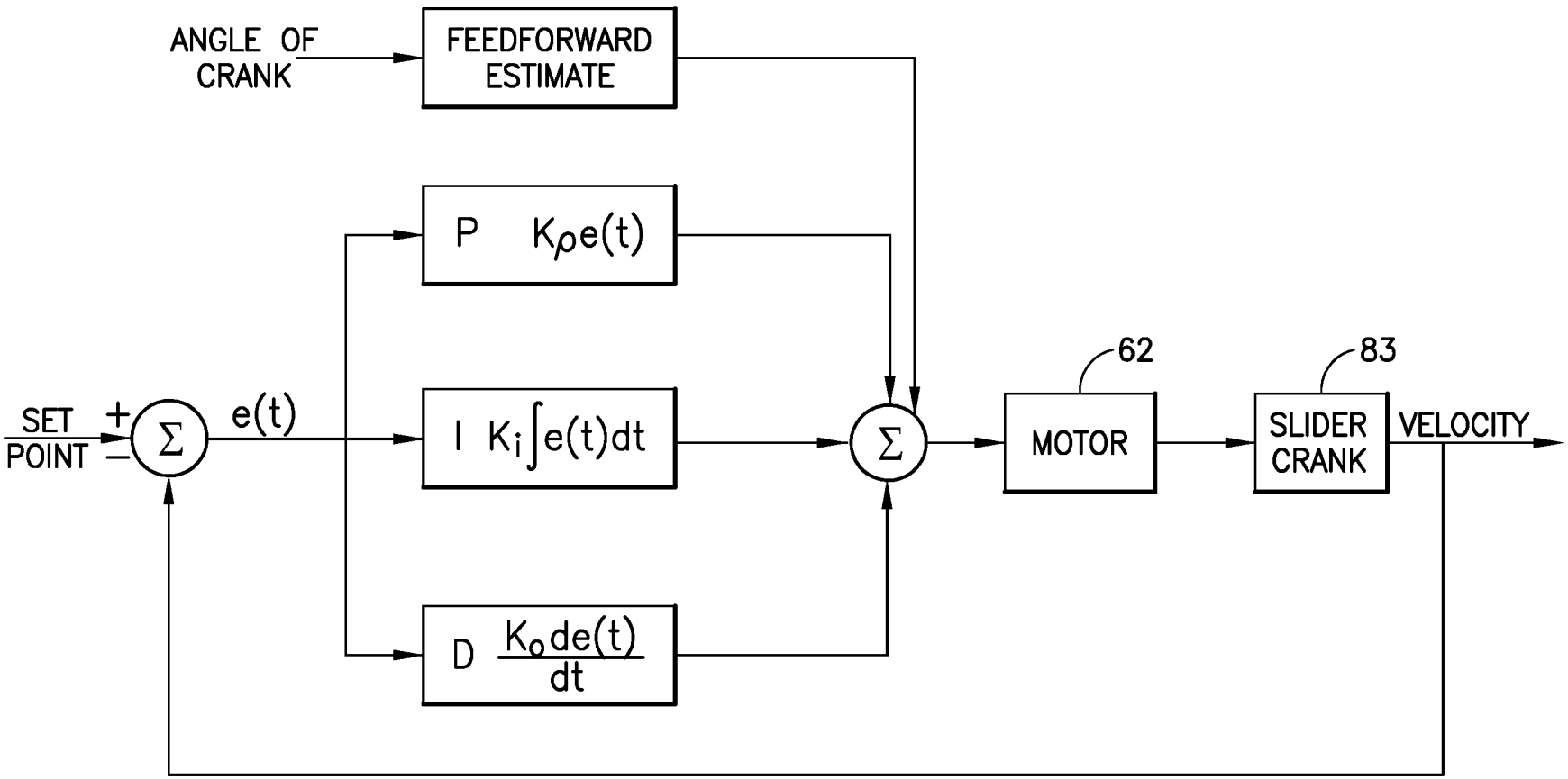
FIG. 24 is a block diagram of an exemplary control system of the infant care apparatus of FIG. 1 and/or FIG. 2 in accordance with aspects of the disclosed embodiment.

With reference to FIGS. 14 and 20, the torque on the first motor 62 depends on the friction of the entire system (which is dependent on weight) and the angle of the crank member 83. The torque of the first motor 62 is controlled by setting the PWM to a predetermined value based on the desired velocity set by the user. Controller 51 may include feed forward compensation to control the velocity of the first motor 62.

Any of the components shown in FIGS. 14-22 may be set to zero. For example, reasonable accuracy is achieved using only proportional and integral terms where the constants $K_p$ and $K_i$ are dependent on the input speed, ignoring the feed forward and derivative terms.

Based on the feedback from the horizontal encoder 130 and the horizontal limit switch 165, the exact position of the first platform 70 (denoted "hPos") can be determined at any point in its range of motion. Similarly, based on feedback from the vertical encoder 135 and the vertical limit switch 167, the exact position of the support platform 99 (denoted "vPos") can be determined at any point in its range of motion.

While the control of the first platform 70 is based entirely on velocity, the control of the support platform 99 is based upon both position and velocity. For a given horizontal position (hPos) and a given motion, which dictates the number of vertical cycles per horizontal cycles (n) and phase offset (Φ) as shown in Table 1, the desired vPos can be calculated as follows:

$$\text{Desired_vPos} = hPos \times v2\text{h_ratio} \times n + \Phi \quad \text{(Equation 1)}$$

where v2h_ratio is a constant defined as the number of vertical encoder ticks per cycle divided by the number of horizontal encoder ticks per cycle. Based on the actual vertical position, the amount of error can be calculated as follows:

$$posErr = vPos - \text{Desired_vPos} \quad \text{(Equation 2)}$$

This error term must be correctly scaled to +/−verticalEncoderTicksPerCycle/2.

As an aside, if the direction of motion in Ocean Wave 204 and Car Ride 201 is irrelevant, there are two possibilities for Desired vPos for each value of hPos and we can base the vertical error term, posErr, on the closer of the two.

The positional error term, posErr, must then be incorporated into a velocity based feedback control loop. Logically, if the vertical axis is behind (posErr<0), velocity should be increased while if the vertical axis is ahead (posErr>0), velocity should be decreased in proportion to the error as follows:

$$vSP = posErr \times K_{VP} + vBase \quad \text{(Equation 3)}$$

$$\text{where } vBasw = hSP/n \times \text{h2v_ratio} \quad \text{(Equation 4)}$$

and h2v_ratio is defined as the horizontal ticks per cycle/vertical ticks per cycle.

The above description is for exemplary purposes only as any suitable control scheme may be utilized. As noted previously, different modes of vibrations generated by the vibratory mechanism 90 are superposed over each variable selectable motion profile controlled as noted.

In an exemplary embodiment, the infant care apparatus 1 is configured to reciprocate the seat with a vertical displacement of about 1.5 inches and a horizontal displacement of about 3.0 inches with a vertical displacement frequency range of between about 10 and 40 cycles per minute and a horizontal displacement frequency range of between about 10 and 40 cycles per minute. In another example, the infant care apparatus 1 is configured to reciprocate the seat with a vertical displacement more or less than about 1.5 inches and a horizontal displacement more or less than about 3.0 inches with a vertical displacement frequency range of more or less than about 10 to 40 cycles per minute and a horizontal displacement frequency range of more or less than about 10 to 40 cycles per minute.

In another aspect, at least a third reciprocation means (not shown) may be added to enable reciprocation of the seat in another direction different than the first and second directions imparted by the first and second motion assemblies 61, 65 referenced herein.

In one or more aspects, the control system 50 is configured with any suitable "smart" connectivity features that provide for remote control of the infant care apparatus with smart home accessories/devices. For example, the control system 50 includes Wi-Fi connectivity and is configured with, for example, Alexa connectivity (available from Amazon.com, Inc.) and/or Google Assistant™ connectivity (available from Google LLC) so that the functions of the infant care apparatus 1 described herein are remotely operable through the Wi-Fi connectivity. The control system 50 includes any suitable short distance wireless communication, such as Bluetooth®, that enables audio streaming from a remote fungible device (e.g., cell phone, tablet, laptop computer, etc.) to the infant care device 1 for broadcast through the speakers 56. It is noted that the control system 50 is configured for, through the short distance wireless communication, remote control of the infant care apparatus 1 through the remote fungible device so that the functions of the infant care apparatus 1 described herein are remotely operable through remote fungible device.

The control system 50 is also configured with operational interlocks that prevent movement of the infant seat 7 such as when the cam lever 2878 is not locked (i.e., rotated fully to a predetermined stopping location in direction R27) and/or when the infant seat 7 is not seated on the base 3. For example, referring to FIGS. 27C, 28A and 28B at least one sensor (e.g., seat lock sensor (s)) 2866, 2869 is provided on the infant support receiver coupling 200C (or any suitable location on the base 3) to detect/sense a position of the cam lever 2878 and/or slider 2877, 2877A. For example, a sensor 2866 can be positioned on the housing cover 280C and/or skirt 280S so as to detect a position of the handle 2878H relative to the sensor 2866. For example, the sensor 2866 can be a proximity sensor, optical sensor, or other suitable sensor that detects the handle 2878H when in the locked position (e.g., rotated fully to a predetermined stopping location in direction R27). A sensor 2869 (similar to sensor 2866) can be located within the infant support receiver coupling 200C so as to detect the slider 2877 (and/or slider 2877A) when in the locked position (see FIG. 28C) or when in the unlocked position (see FIG. 28B). A sensor 2867 (similar to sensor 2866) can be located on the complimentary mating surface 200CS so as to detect the presence of the mating surface 2620B (i.e., detect the presence of the infant seat 7 on the base 3). A sensor 2868 (similar to sensor 2866) can be located on the housing cover 280C to detect the presence of the side 2620A of the base 2620. The sensors 2866, 2867, 2868, 2869 are configured to send signals, embodying information regarding the presence or absence of the infant seat on the base 3 and/or whether the cam lever 2878 (or sliders 2877, 2877A) are in the locked position, to the controller 51 where the controller 51 effects operation of the infant care apparatus 1 based on the sensor signals or prevents operation of the infant case apparatus based on the sensor signals.

The sensors (at least one sensor for detecting the state of the cam lever 2878 and at least one sensor for detecting the state of the infant seat 7 on the base 3) provide for detection of the following usage states: (1) infant seat 7 on the base 3 but unlocked, (2) the infant seat 7 on the base 3 and locked, (3) the infant seat 7 off the base 3 and unlocked, and (4) the infant seat 7 off the base and locked. For example, where the controller 51 determines the sensor signals indicate usage states 1, 3, and 4, the controller 51 prevents operation of the infant care apparatus 1 and causes an error or locked indicia/message to be presented on the control panel 52 (see the illumination of a lock indicia 269 on the control panel 52 in FIG. 2F). Where the controller 51 determines the sensor signals indicate usage state 2, the controller provides for operation of the infant care apparatus 1. In one or more aspects, where the infant seat 7 is not detected on the base 3 but the cam lever 2878 (and sliders) are detected in the locked position the lock indicia 269 may not be illuminated.

Figure 25:
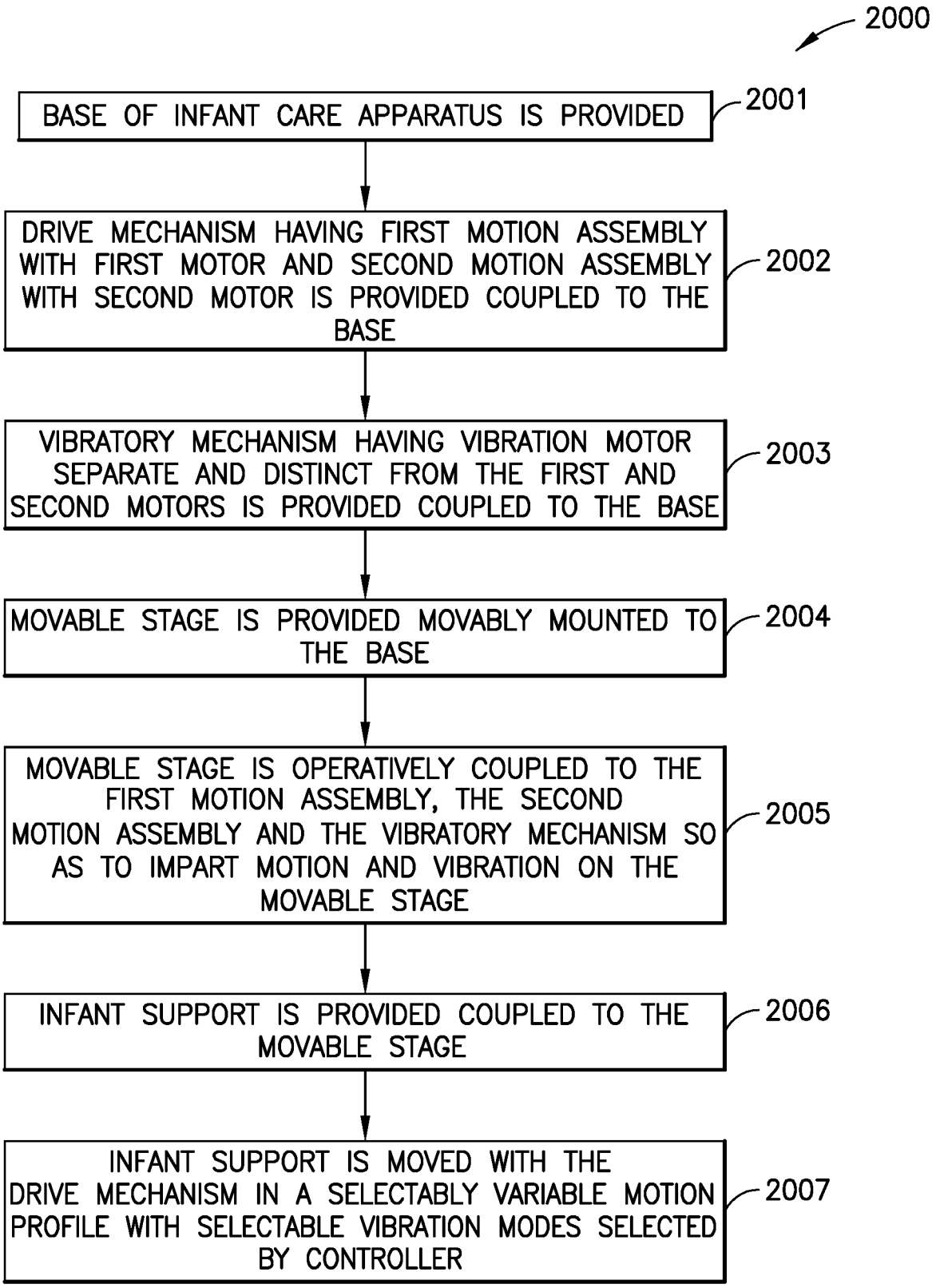
FIG. 25 is a method for imparting motion on the infant care apparatus of FIG. 1 and/or FIG. 2 in accordance with aspects of the disclosed embodiment.

Referring to FIGS. 1, 2, 14-22, and 25, a method 2000 for imparting motion on an infant support 2 is illustrated. The method includes providing base 3 of infant care apparatus 1 (FIG. 25, Block 2001). Drive mechanism 60 having lateral motion assembly 61 and lifting motion assembly 65 is provided coupled to the base 3 (FIG. 25, Block 2002), wherein the lateral motion assembly 61 has first motor 62 dependent from the base 3 and the lifting motion assembly 65 has second motor 66 separate and distinct from the first motor 62. Vibratory mechanism 90 having vibration motor 91 separate and distinct from the first and second motors 62, 66 of the drive mechanism 60 is provided a coupled to the base 3 (FIG. 25, Block 2003). Movable stage 10 is provided movably mounted to the base 3 (FIG. 25, Block 2004). The movable stage 10 is operatively coupled to the lateral motion assembly 61 so that the first motor 62 imparts, via the lateral motion assembly 61, a first cyclic motion in a first direction D1 to the movable stage 10, and to the lifting motion assembly 65 so that the second motor 66 imparts, via the lifting motion assembly 65, a second cyclic motion to at least part of the movable stage 10 in a second direction D2 independent of the first cyclic motion in the first direction D1 imparted by the lateral motion assembly 61 and to the vibratory mechanism 90 so that the vibration motor 91 vibrates the movable stage 10 (FIG. 25, Block 2005). Infant support 2 is provided coupled to the movable stage 10 (FIG. 25, Block 2006) so that the second cyclic motion and first cyclic motion is imparted to the infant support 2, and the infant support is configured to move cyclically in both the first direction D1 and the second direction D2 relative to the base 3. Controller 51 communicably coupled to the drive mechanism 60, moves the infant support 2 in a selectably variable motion with profile selectable vibration modes selected, with the controller 51, from different selectably variable motion profiles and selectably different vibration modes for each of the different selectable variable motion profiles (FIG. 25, Block 2007).

Figure 29:
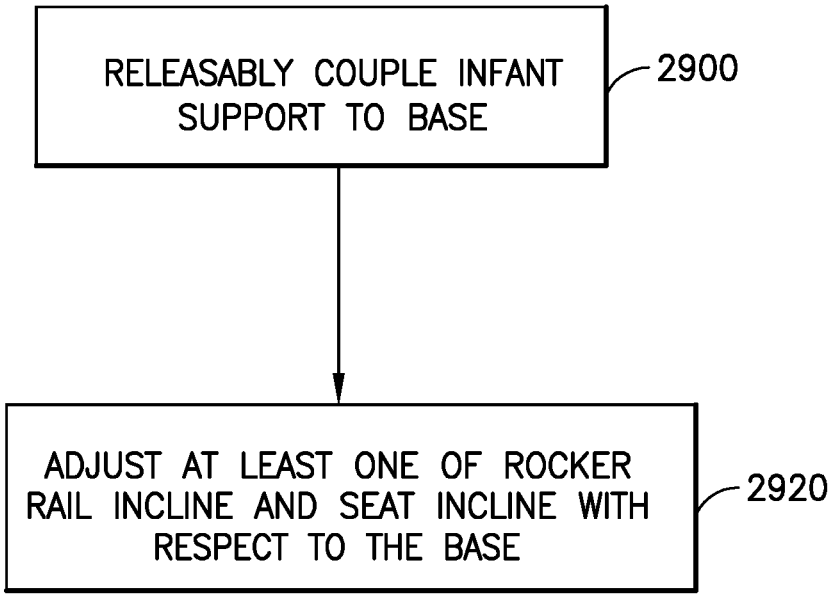
FIG. 29 is a method for an infant care apparatus in accordance with aspects of the disclosed embodiment.

Referring to FIG. 29 an exemplary method for an infant care apparatus 1 will be described. In accordance with the method, the infant care apparatus 1 has a base 3 and an infant support 2 having a frame 8, 8R with a seat 7 configured for supporting an infant, the frame 8, 8R being configured to form a rocker 2R with rocker rails 2610R, 2610L. The method includes releasably coupling the infant support 2 to the base 3 (FIG. 29, Block 2900) with an infant support coupling 266 so as to mount and dismount the infant support 2 to the base 3, wherein the infant support coupling 266 depends from the rocker rails 2610R, 2610L and has an integral recline adjustment mechanism 2777 of the rocker 2R. The method also includes adjusting, with the recline adjustment mechanism 2777, at least one of rocker rail incline and seat incline with respect to the base 3 (FIG. 29, Block 2920) separate from releasably coupling the infant support 2 to the base 3. As described herein, the base 3 has an actuable grip 2888 that engages the infant support coupling 266, the actuable grip 2888 being configured to actuate between a closed position and an open position to capture and release the infant support 2 to the base 3, wherein the grip actuation is separate and distinct from recline adjustment of the rocker 2R.

In accordance with more aspects of the disclosed embodiment an infant apparatus having an infant support is provided. The infant apparatus including a base, and an infant support coupling arranged so as to releasably couple the infant support to the base, the infant support coupling including a movable support movably connected to the base and disposed so as to form a support seat that engages and supports the infant support on the base, with the movable support in a first position (relative to the base), and actuable grip members configured to actuate between a closed position and an open position to capture and release the infant support to the base, the actuable grip members being automatically actuable between the closed and open positions by action of the movable support moving to the first position.

In accordance with one or more aspects of the disclosed embodiment the actuable grip members are disposed with respect to the infant support to effect grip.

In accordance with one or more aspects of the disclosed embodiment the infant support is free of grip.

In accordance with one or more aspects of the disclosed embodiment movable support has cams that cam grip members from closed position to the open position and from the open position to the closed position.

In accordance with one or more aspects of the disclosed embodiment an infant care apparatus is provided. The infant care apparatus including a base, a drive mechanism coupled to the base and having a first motion assembly and a second motion assembly, wherein the first motion assembly has a first motor dependent from the base and the second motion assembly has a second motor separate and distinct from the first motor, a vibratory mechanism connected to the base so as to cooperate with the drive mechanism, the vibratory mechanism having a vibration motor separate and distinct from the first and second motors of the drive mechanism, a movable stage movably mounted to the base and operatively coupled to the first motion assembly so that the first motor imparts, via the first motion assembly, a first cyclic motion in a first direction to the movable stage, and to the second motion assembly so that the second motor imparts, via the second motion assembly, a second cyclic motion to at least part of the movable stage in a second direction independent of the first cyclic motion in the first direction imparted by the first motion assembly and to the vibratory mechanism so that the vibration motor vibrates the movable stage, an infant support coupled to the movable stage so that the second cyclic motion and first cyclic motion is imparted to the infant support, and the infant support is configured to move cyclically in both the first direction and the second direction relative to the base, and a controller communicably coupled to the drive mechanism, and configured so as to move the infant support in a selectably variable motion profile with selectable vibration modes selected, with the controller, from different selectably variable motion profiles and selectably different vibration modes for each of the different selectable variable motion profiles.

In accordance with one or more aspects of the disclosed embodiment the controller is configured to configured so as to move the infant support with separate impetus separately imparted on the infant support by the first cyclic motion and second cyclic motion respectively driven by the first and second motors, in both the first direction and the second direction with the selectably variable motion profile.

In accordance with one or more aspects of the disclosed embodiment the controller is configured to effect selection of the selectably variable motion profile by separate variance of motion characteristic of the separate respective first cyclic motion and second cyclic motion determined from a common selection input to the controller selecting the selectably variable motion profile In accordance with one or more aspects of the disclosed embodiment at least part of the movable stage isolates the drive mechanism from the base.

In accordance with one or more aspects of the disclosed embodiment each of the different selectably variable motion profiles is deterministically defined by a selectably variable velocity characteristic of at least one of the first and second cyclic motions respectively of the first and second motion assemblies, and a selectably variable velocity characteristic of at least one of the first and second cyclic motions respectively of the first and second motion assemblies.

In accordance with one or more aspects of the disclosed embodiment the selectably variable velocity characteristic of at least one of the first and second cyclic motions respectively of the first and second motion assemblies, and the selectably variable velocity characteristic of at least one of the first and second cyclic motions respectively of the first and second motion assemblies are selected with the controller from the common selection input to the controller.

In accordance with one or more aspects of the disclosed embodiment each of the different selectably variable motion profiles includes at least one of horizontal and vertical movements.

In accordance with one or more aspects of the disclosed embodiment the first motion assembly includes the first motor having a drive shaft, and a slide crank assembly comprising a gearing assembly coupled to the drive shaft of the first motor and a crank member coupled to the gearing assembly and the movable stage, wherein operation of the first motor causes rotation of the slide crank assembly, thereby imparting the first cyclic motion to the movable stage.

In accordance with one or more aspects of the disclosed embodiment the second motion assembly includes the second motor having a drive shaft, a worm gear assembly coupled to the output of the drive shaft, and a vertical yoke having a first end coupled to an output shaft of the worm gear assembly, wherein operation of the second motor causes rotation of the vertical yoke, thereby imparting second cyclic motion to the infant support.

In accordance with one or more aspects of the disclosed embodiment the second motion assembly further includes a dual scissor mechanism coupled to a second end of the vertical yoke configured to support the infant support.

In accordance with one or more aspects of the disclosed embodiment a first encoder having a single slot is coupled to a first drive shaft of the first motor and a second encoder having a single slot is coupled to a second drive shaft of the second motor.

In accordance with one or more aspects of the disclosed embodiment the controller determines position information of the infant support based at least in part on information from the first encoder and the second encoder.

In accordance with one or more aspects of the disclosed embodiment a method is provided. The method including providing a base of an infant care apparatus, providing a drive mechanism coupled to the base, the drive mechanism having a first motion assembly and a second motion assembly, wherein the first motion assembly has a first motor dependent from the base and the second motion assembly has a second motor separate and distinct from the first motor, providing a vibratory mechanism connected to the base and arranged so as to cooperate with the drive mechanism, the vibratory mechanism having a vibration motor separate and distinct from the first and second motors of the drive mechanism, providing a movable stage movably mounted to the base and operatively coupled to the first motion assembly so that the first motor imparts, via the first motion assembly, a first cyclic motion in a first direction to the movable stage, and to the second motion assembly so that the second motor imparts, via the second motion assembly, a second cyclic motion to at least part of the movable stage in a second direction independent of the first cyclic motion in the first direction imparted by the first motion assembly and to the vibratory mechanism so that the vibration motor vibrates the movable stage, providing an infant support coupled to the movable stage so that the second cyclic motion and d first cyclic motion is imparted to the infant support, and the infant support is configured to move cyclically in both the first direction and the second direction relative to the base, and moving, with a controller communicably coupled to the drive mechanism, the infant support in a selectably variable motion profile with selectable vibration modes selected, with the controller, from different selectably variable motion profiles and selectably different vibration modes for each of the different selectable variable motion profiles.

In accordance with one or more aspects of the disclosed embodiment a first encoder is coupled to a first drive shaft of the first motor and a second encoder is coupled to a second drive shaft of the second motor.

In accordance with one or more aspects of the disclosed embodiment the first encoder and the second encoder each include no more than one slot.

In accordance with one or more aspects of the disclosed embodiment determining, with the controller, position information of the infant support based at least in part on information from the first encoder and the second encoder.

In accordance with one or more aspects of the disclosed embodiment each of the different selectably variable motion profiles is predetermined, the method further comprising selecting, by a user, one of the selectably variable motion profiles.

In accordance with one or more aspects of the disclosed embodiment infant apparatus comprises: an infant support; a base; and an infant support coupling arranged so as to releasably couple the infant support to the base, the infant support coupling including: a movable support movably connected to the base and disposed so as to form a support seat that engages and supports the infant support on the base, and a cam lock mechanism configured to lock the infant support to the base.

In accordance with one or more aspects of the disclosed embodiment the cam lock mechanism comprises: a cam lever pivotally coupled to the base, the cam lever having a cam surface; a slider moveable mounted within the base, the slider being configured to interface with the cam surface of the cam lever; and a locking arm coupled to the slider so as to move with the slider as a single unit, where pivoting movement of the cam lever causes reciprocating movement of the locking arm to effect locking the infant support to the base and unlocking of the infant support from the base.

In accordance with one or more aspects of the disclosed embodiment the infant support includes an articulated span member having a locking post extending therefrom; and the cam lock mechanism includes a locking arm that engages the locking post to lock the infant support to the base.

In accordance with one or more aspects of the disclosed embodiment the infant support includes an infant seat and two rocker supports coupled to the infant seat, where the articulated span member extends between and couples the two rocker supports to each other.

In accordance with one or more aspects of the disclosed embodiment the articulated span member comprises: a span member base from which the locking post extends; and an articulated support pivotally coupled to the span member base, wherein the articulated support engages the span member base so as to lock the articulated support in one of a plurality of predetermined angular positions relative to the base so as to adjust a recline position of the infant support relative to the base.

In accordance with one or more aspects of the disclosed embodiment the span member base includes a pivot-lock arm; and the articulated support includes a plurality of pivot stop apertures each configured to accept the pivot-lock arm therein, where the pivot lock arm is configured to be selectably retracted from one pivot stop aperture and inserted into another pivot stop aperture so as to lock the infant support in a predetermined recline position corresponding to a selected one of the pivot stop apertures.

In accordance with one or more aspects of the disclosed embodiment an infant care apparatus has an infant support, the infant care apparatus comprising: a base; the infant support having a frame with a seat configured for supporting an infant, the frame being configured to form a rocker with rocker rails; and an infant support coupling arranged to releasable couple the infant support and the base so as to mount and dismount the infant support to the base, wherein the infant support coupling depends from the rocker rails and has an integral recline adjustment mechanism of the rocker; wherein the base has an actuable grip that engages the infant support coupling, the actuable grip being configured to actuate between a closed position and an open position to capture and release the infant support to the base, wherein the grip actuation is separate and distinct from recline adjustment of the rocker.

In accordance with one or more aspects of the disclosed embodiment the rocker rails are fixed relative to the seat.

In accordance with one or more aspects of the disclosed embodiment the recline adjustment mechanism is disposed to adjust at least one of rocker rail incline and seat incline with respect to the base.

In accordance with one or more aspects of the disclosed embodiment the recline adjustment mechanism has an adjustment handle, separate and distinct from a grip actuation handle configured to actuate the actuable grip.

In accordance with one or more aspects of the disclosed embodiment a method is provided for an infant care apparatus having a base and an infant support having a frame with a seat configured for supporting an infant, the frame being configured to form a rocker with rocker rails, the method comprising: releasably coupling the infant support to the base with an infant support coupling so as to mount and dismount the infant support to the base, wherein the infant support coupling depends from the rocker rails and has an integral recline adjustment mechanism of the rocker; and adjusting, with the recline adjustment mechanism, at least one of rocker rail incline and seat incline with respect to the base separate from releasably coupling the infant support to the base; wherein the base has an actuable grip that engages the infant support coupling, the grip actuable being configured to actuate between a closed position and an open position to capture and release the infant support to the base, wherein the grip actuation is separate and distinct from recline adjustment of the rocker.

In accordance with one or more aspects of the disclosed embodiment the rocker rails are fixed relative to the seat.

In accordance with more aspects of the disclosed embodiment the recline adjustment mechanism has an adjustment handle, separate and distinct from a grip actuation handle configured to actuate the actuable grip.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of any claims appended hereto. Further, the mere fact that different features are recited in mutually different dependent or independent claims does not indicate that a combination of these features cannot be advantageously used, a combination remaining within the scope of the aspects of the disclosed embodiment.

The invention claimed is:

1. An infant apparatus having an infant support, the infant apparatus comprising:

a base; and an infant support coupling arranged so as to releasably couple the infant support to the base, the infant support coupling including:

a movable support that is separate and distinct from the infant support, the movable support is movably connected to the base and disposed on the base so as to form a support seat that engages and supports the infant support on the base, with the movable support in a first position relative to the base, and actuable grip members configured to actuate between a closed position and an open position to capture and release the infant support to the base, the actuable grip members being automatically actuable between the closed and open positions by action of the movable support moving to the first position.

2. The infant apparatus of claim 1, wherein the actuable grip members are disposed with respect to the infant support to effect grip.

3. The infant apparatus of claim 1, wherein the infant support is free of actuable grip members.

4. The infant apparatus of claim 1, wherein the movable support includes cams that cam the grip members from the closed to/from the open position.

5. A method comprising:

providing an infant apparatus having an infant support, where the infant apparatus includes a base and an infant support; and releasably coupling the infant support coupling to the base, where the infant support coupling including:

a movable support that is separate and distinct from the infant support, the movable support is movably connected to the base and disposed on the base so as to form a support seat that engages and supports the infant support on the base, with the movable support in a first position relative to the base, and actuable grip members actuating between a closed position and an open position for capturing and releasing the infant support to the base, the actuable grip members being automatically actuable between the closed and open positions by action of the movable support moving to the first position.

6. The method of claim 5, wherein the actuable grip members are disposed with respect to the infant support to effect grip on the infant support.

7. The method of claim 5, wherein the infant support is free of actuable grip members.

8. The method of claim 5, wherein the movable support includes cams that cam the grip members from the closed to/from the open position.

9. An infant apparatus comprising:

an infant support;

a base; and an infant support coupling arranged so as to releasably couple the infant support to the base, the infant support coupling including:

a movable support that is separate and distinct from the infant support, the movable support is movably connected to the base and disposed on the base so as to form a support seat that engages and supports the infant support on the base, and a cam lock mechanism having a reciprocating locking arm configured to lock the infant support to the base wherein the cam lock mechanism comprises:

a cam lever pivotally coupled to the base, the cam lever having a cam surface;

a slider movably mounted within the base, the slider being configured to interface with the cam surface of the cam lever; and the locking arm is coupled to the slider so as to move with the slider as a single unit, where pivoting movement of the cam lever causes reciprocating movement of the locking arm to effect locking the infant support to the base and unlocking of the infant support from the base.

10. The infant apparatus of claim 9, wherein:

the infant support includes an articulated span member having a locking post extending therefrom; and the cam lock mechanism includes a locking arm that engages the locking post to lock the infant support to the base.

11. The infant apparatus of claim 10, wherein the infant support includes an infant seat and two rocker supports coupled to the infant seat, where the articulated span member extends between and couples the two rocker supports to each other.

12. The infant apparatus of claim 10, wherein the articulated span member comprises:

a span member base from which the locking post extends; and an articulated support pivotally coupled to the span member base, wherein the articulated support engages the span member base so as to lock the articulated support in one of a plurality of predetermined angular positions relative to the base so as to adjust a recline position of the infant support relative to the base.

13. The infant apparatus of claim 12, wherein:

the span member base includes a pivot-lock arm; and the articulated support includes a plurality of pivot stop apertures each configured to accept the pivot-lock arm therein, where the pivot lock arm is configured to be selectably retracted from one pivot stop aperture and inserted into another pivot stop aperture so as to lock the infant support in a predetermined recline position corresponding to a selected one of the pivot stop apertures.

14. An infant care apparatus having an infant support, the infant care apparatus comprising:

a base;

the infant support having a frame with a seat configured for supporting an infant, the frame being configured to form a rocker with rocker rails; and an infant support coupling arranged to releasable couple the infant support and the base so as to mount and dismount the infant support to the base, wherein the infant support coupling depends from the rocker rails and has an integral recline adjustment mechanism of the rocker;

wherein the base has an actuable grip that engages the infant support coupling, the grip being configured to actuate between a closed position and an open position to capture and release the infant support to the base, wherein the grip actuation is separate and distinct from recline adjustment of the rocker.

15. The infant care apparatus of claim 14, wherein the recline adjustment mechanism has an adjustment handle, separate and distinct from a grip actuation handle configured to actuate the actuable grip.

16. The infant care apparatus of claim 14, wherein the rocker rails are fixed relative to the seat.

17. The infant care apparatus of claim 14, wherein the recline adjustment mechanism is disposed to adjust at least one of rocker rail incline and seat incline with respect to base.

18. A method for an infant care apparatus having a base and an infant support having a frame with a seat configured for supporting an infant, the frame being configured to form a rocker with rocker rails, the method comprising:

releasably coupling the infant support to the base with an infant support coupling so as to mount and dismount the infant support to the base, wherein the infant support coupling depends from the rocker rails and has an integral recline adjustment mechanism of the rocker; and adjusting, with the recline adjustment mechanism, at least one of rocker rail incline and seat incline with respect to the base separate from releasably coupling the infant support to the base;

wherein the base has an actuable grip that engages the infant support coupling, the actuable grip being configured to actuate between a closed position and an open position to capture and release the infant support to the base, wherein the grip actuation is separate and distinct from recline adjustment of the rocker.

19. The method of claim 18, wherein the recline adjustment mechanism has an adjustment handle, separate and distinct from a grip actuation handle configured to actuate the actuable grip.

20. The method of claim 18, wherein the rocker rails are fixed relative to the seat.

21. An infant care apparatus comprising:

a base with legs;

a drive mechanism coupled to the base so that the drive mechanism is elevated, the drive mechanism having a first motion assembly and a second motion assembly, a movable stage movably mounted to the base and operatively coupled to the first motion assembly so that the first motion assembly imparts a first cyclic motion in a first direction to the movable stage, and the second motion assembly is dependent from the movable stage so that the second motion assembly imparts a second cyclic motion in a second direction independent of the first cyclic motion in the first direction imparted by the first motion assembly;

an infant support disposed to effect stand-alone infant care support of an infant on the infant care apparatus and coupled to the second motion assembly so that the second cyclic motion and the first cyclic motion are imparted to the infant support, and the infant support is configured to move cyclically in both the first direction and the second direction relative to the base; and a controller communicably coupled to the drive mechanism, and configured so as to move the infant support, with separate impetus separately imparted on the infant support by the first cyclic motion and the second cyclic motion, in both the first direction and the second direction with a selectably variable motion path selected, with the controller, from a number of different selectably variable motion paths, wherein the controller is configured to effect selection of the selectably variable motion path by separate variance of motion characteristic of the separate respective first cyclic motion and second cyclic motion determined from a common selection input to the controller such that the controller effects the selection corresponding to only one of the selectably variable motion paths so that selection of each selectably variable motion path by separate variance of motion characteristic of the separate respective first cyclic motion and second cyclic motion is effected with a corresponding common selection input.

22. The infant care apparatus of claim 21, wherein the infant support is an infant bed, a bassinet, or a cradle.

23. The infant care apparatus of claim 21, wherein each of the different selectably variable motion paths is deterministically defined by a selectably variable velocity characteristic of at least one of the first and second cyclic motions respectively of the first and second motion assemblies, and a selectably variable velocity characteristic of another of the first and second cyclic motions respectively of the first and second motion assemblies.

24. The infant care apparatus of claim 23, wherein the selectably variable velocity characteristic of at least one of the first and second cyclic motions respectively of the first and second motion assemblies, and the selectably variable velocity characteristic of another of the first and second cyclic motions respectively of the first and second motion assemblies are selected with the controller from the common selection input to the controller.

25. The infant care apparatus of claim 21, wherein the controller is mounted within the base.

26. The infant care apparatus of claim 21, wherein the controller includes a user interface configured to receive the common selection input from a user for selecting the different selectably variable motion paths.

27. The infant care apparatus of claim 21, wherein each of the different selectably variable motion paths includes at least one of horizontal and vertical movements.

28. The infant care apparatus of claim 21, wherein the first motion assembly comprises:

a first motor having a drive shaft; and a slide crank assembly comprising a gearing assembly coupled to the drive shaft of the first motor and a crank member coupled to the gearing assembly and the movable stage;

wherein operation of the first motor causes rotation of the slide crank assembly, thereby imparting the first cyclic motion to the movable stage.

29. The infant care apparatus of claim 28, wherein the second motion assembly comprises:

a second motor having a drive shaft;

a worm gear assembly coupled to the output of the drive shaft; and a vertical yoke having a first end coupled to an output shaft of the worm gear assembly, wherein operation of the second motor causes rotation of the vertical yoke, thereby imparting second cyclic motion to the infant support.

30. The infant care apparatus of claim 29, wherein the second motion assembly further includes a dual scissor mechanism coupled to a second end of the vertical yoke configured to support the infant support.

31. The infant care apparatus of claim 29, wherein the first motor provides horizontal motion to the infant support and the second motor provides vertical motion to the infant support.

32. The infant care apparatus of claim 29, wherein a first encoder having a single slot is coupled to a first drive shaft of the first motor and a second encoder having a single slot is coupled to a second drive shaft of the second motor.

33. The infant care apparatus of claim 32, wherein the controller determines position information of the infant support based at least in part on information from the first encoder and the second encoder.

34. A method for controlling an infant care apparatus, the method comprising:

providing a base of the infant care apparatus, the base having legs;

providing a drive mechanism coupled to the base so that the drive mechanism is elevated, the drive mechanism having a first motion assembly and a second motion assembly, wherein the first motion assembly has a first motor dependent from the base and the second motion assembly has a second motor separate and distinct from the first motor;

providing a movable stage movably mounted to the base and operatively coupled to the first motion assembly for imparting, via the first motor of the first motion assembly, a first cyclic motion in a first direction to the movable stage;

providing an infant support disposed to effect stand-alone infant care support of an infant on the infant care apparatus and coupled to the second motion assembly for imparting, via the second motor of the second motion assembly dependent from the movable stage, a second cyclic motion in a second direction independent of the first cyclic motion in the first direction imparted by the first motion assembly, wherein the second cyclic motion and the first cyclic motion are imparted to the infant support moving the infant support cyclically in both the first direction and the second direction relative to the base;

moving, with a controller communicably coupled to the drive mechanism, the infant support, with separate impetus separately imparted on the infant support by the first cyclic motion and the second cyclic motion respectively driven by the first and the second motors, in both the first direction and the second direction with a selectably variable motion path selected, with the controller, from a number of different selectably variable motion paths; and effecting, with the controller, selection of the selectably variable motion path by separate variance of motion characteristic of the separate respective first cyclic motion and second cyclic motion determined from a common selection input to the controller such that the controller effects the selection corresponding to only one of the selectably variable motion paths so that selection of each selectably variable motion path by separate variance of motion characteristic of the separate respective first cyclic motion and second cyclic motion is effected with a corresponding common selection input.

35. The method of claim 34, wherein the infant support is an infant bed, a bassinet, or a cradle.

36. The method of claim 34, wherein a first encoder is coupled to a first drive shaft of the first motor and a second encoder is coupled to a second drive shaft of the second motor.

37. The method of claim 36, wherein the first encoder and the second encoder each include no more than one slot.

38. The method of claim 36, further comprising determining, with the controller, position information of the infant support based at least in part on information from the first encoder and the second encoder.

39. The method of claim 34, wherein the different selectably variable motion paths include movement of the infant support in a horizontal direction and a vertical direction relative to the base.

40. The method of claim 39, wherein the movement of the infant support in the horizontal direction and the movement of the infant support in the vertical direction is coordinated such that a repeatable, visually distinctive motion path is obtained.

41. The method of claim 34, wherein each of the different selectably variable motion paths is predetermined, the method further comprising selecting, by a user, one of the selectably variable motion paths.

42. The method of claim 34, further comprising adjusting, with the controller, a speed of the first motor and the second motor.

* * * * *